US010077553B2

(12) United States Patent
Neumayr

(10) Patent No.: US 10,077,553 B2
(45) **Date of Patent: *Sep. 18, 2018**

(54) MODULAR WALL SYSTEM WITH INTEGRATED CHANNELS

(71) Applicant: Michael Neumayr, Los Angeles, CA (US)

(72) Inventor: Michael Neumayr, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/784,569

(22) Filed: Oct. 16, 2017

(65) Prior Publication Data

US 2018/0038103 A1 Feb. 8, 2018

Related U.S. Application Data

(63) Continuation-in-part of application No. 15/011,568, filed on Jan. 31, 2016, now Pat. No. 9,790,684, which (Continued)

(51) Int. Cl.
*E04C 2/34* (2006.01)
*E04C 2/32* (2006.01)
(Continued)

(52) U.S. Cl.
CPC ..... *E04C 2/324* (2013.01); *E04B 1/14* (2013.01); *E04B 2/02* (2013.01); *E04B 2/44* (2013.01);
(Continued)

(58) Field of Classification Search
CPC ..... E04C 2/3405; E04C 2002/3455; E04C 2002/3444; E04C 2/324; E04C 2/322
USPC ..... 52/264, 267, 265, 270, 783.1, 783.11, 52/783.17, 793.18, 783.19, 798.1, 220.1, 52/220.2, 220.4, 582.1, 586.1, 586.2
See application file for complete search history.

(56) References Cited

U.S. PATENT DOCUMENTS 1,987,798 A * 1/1935 Ruppricht ..... F16L 59/07 261/112.2
2,034,489 A * 3/1936 Scherer ..... E04C 2/3405 220/DIG. 9

(Continued)

*Primary Examiner* — Adriana Figueroa
*Assistant Examiner* — Jessie T Fonseca
(74) *Attorney, Agent, or Firm* — Creativenture Law, LLC; Dennis J M Donahue, III; Kevin Staed

(57) ABSTRACT

Prefabricated wall assemblies for the construction of buildings have a corrugated panel and preferably include at least one backside panel. The corrugated panel has one or more vertical channels and several horizontal channels. The vertical channels extend the entire panel height and are recessed from the front face. The horizontal channels extending the entire panel width and are also recessed from the front face so they intersect with the vertical channel. The horizontal channels are almost as wide as the vertical channels, and are greater than one-half the vertical channel width. The backside panel is connected to the corrugated panel to form a structural panel assembly. The backside panel can be a shear panel or other backside flat panel, a backside corrugated panel symmetrically mirroring the corrugated panel, a backside corrugated panel asymmetrically mirroring the corrugated panel, a sandwiched corrugated panel, a relief panel or any combination thereof.

20 Claims, 49 Drawing Sheets

Related U.S. Application Data is a continuation-in-part of application No. 12/901,700, filed on Oct. 11, 2010, now Pat. No. 9,249,572.

(51) Int. Cl.

| | |
|---|---|
| ***E04C 2/52*** | (2006.01) |
| ***E04B 1/14*** | (2006.01) |
| ***E04B 2/02*** | (2006.01) |
| ***E04B 2/44*** | (2006.01) |
| ***E04B 2/00*** | (2006.01) |
| *E04B 1/61* | (2006.01) |
| *E04B 2/74* | (2006.01) |

(52) U.S. Cl.

CPC ..... *E04C 2/322* (2013.01); *E04C 2/326* (2013.01); *E04C 2/3405* (2013.01); *E04C 2/46* (2013.01); *E04C 2/521* (2013.01); *E04C 2/523* (2013.01); *E04C 2/525* (2013.01); *E04B 1/6166* (2013.01); *E04B 2001/6195* (2013.01); *E04B 2002/7488* (2013.01); *E04C 2002/3444* (2013.01); *E04C 2002/3455* (2013.01)

(56) References Cited

U.S. PATENT DOCUMENTS 2,039,601 A * 5/1936 London ..... E04L 31/74 428/116
2,065,433 A * 12/1936 Dercum ..... E04C 2/3405 52/220.4
3,024,879 A * 3/1962 Kandra ..... E04C 2/3405 219/137 R
3,321,826 A * 5/1967 Lowy ..... B21D 47/00 29/423
3,975,882 A * 8/1976 Walter ..... E04C 2/40 156/210
4,037,379 A * 7/1977 Ozanne ..... E04C 2/3405 52/404.3
4,580,379 A * 4/1986 Nusbaum ..... H02G 3/283 174/482
4,832,308 A * 5/1989 Slonimsky ..... E04G 9/02 249/189
4,943,185 A * 7/1990 McGuckin ..... E02B 11/00 210/170.07
5,600,928 A * 2/1997 Hess ..... E04C 2/322 428/158
5,928,764 A * 7/1999 Costi ..... E04L 37/205 428/141
6,085,485 A * 7/2000 Murdock ..... E04B 7/20 52/309.11
6,205,725 B1 * 3/2001 Butler ..... E02D 27/00 52/292
6,209,273 B1 * 4/2001 Jeffers ..... E04L 32/7448 52/220.7
6,260,323 B1 * 7/2001 Hockey ..... E04L 32/74 52/238.1
6,848,233 B1 * 2/2005 Haszler ..... B23K 20/122 148/440
7,127,865 B2 * 10/2006 Douglas ..... E02D 27/02 52/270
2002/0088199 A1 * 7/2002 Linn ..... E04C 2/26 52/745.19
2003/0041547 A1 * 3/2003 Gosselin ..... B27N 5/00 52/630
2004/0074206 A1 * 4/2004 Tanase ..... E04B 1/86 52/783.17
2011/0099932 A1 * 5/2011 Saulce ..... E04L 32/845 52/426
2012/0317923 A1 * 12/2012 Herdt ..... B29C 44/1214 52/783.11

* cited by examiner

10
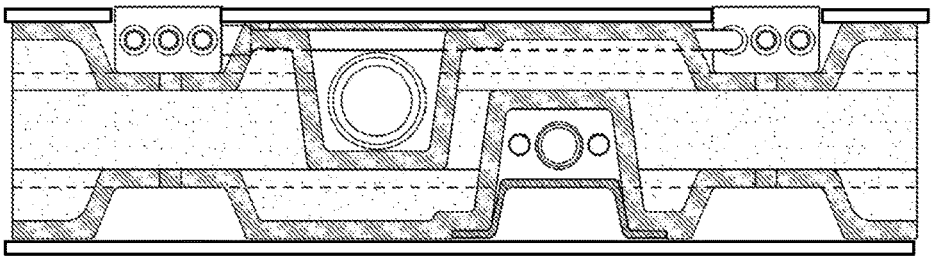
FIG. 18A
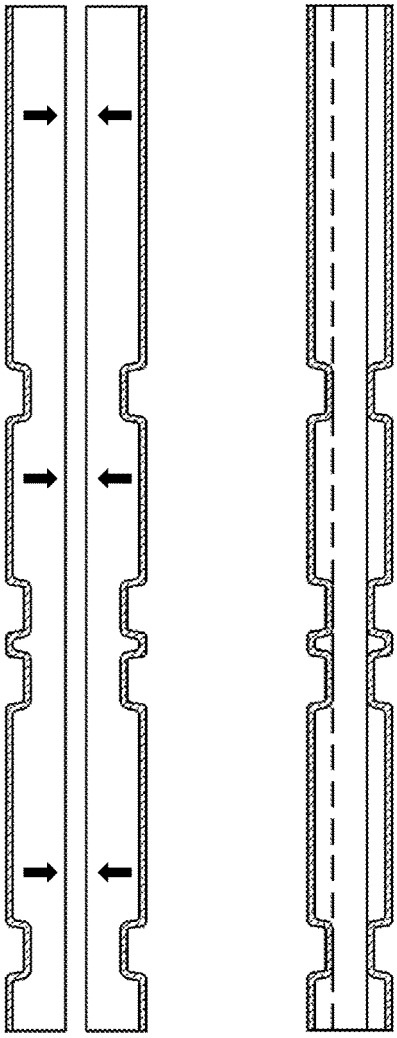
FIG. 18B
FIG. 18C
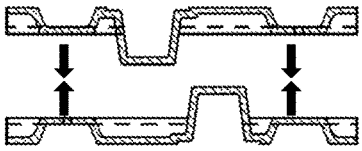
FIG. 18D
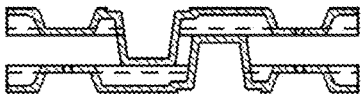
FIG. 18E

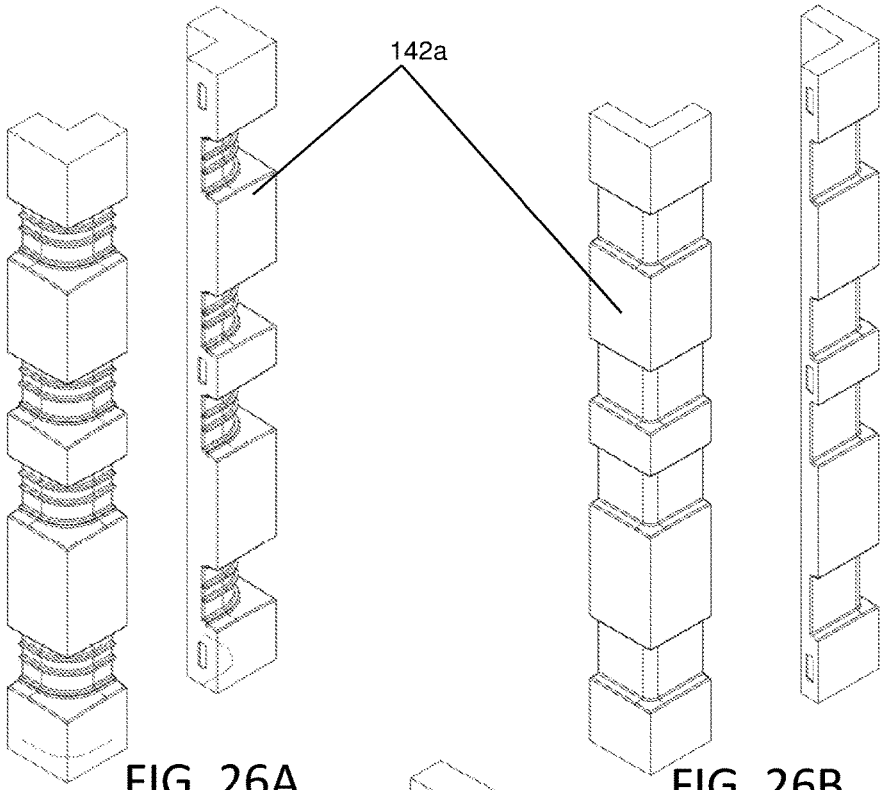
FIG. 26A
FIG. 26B
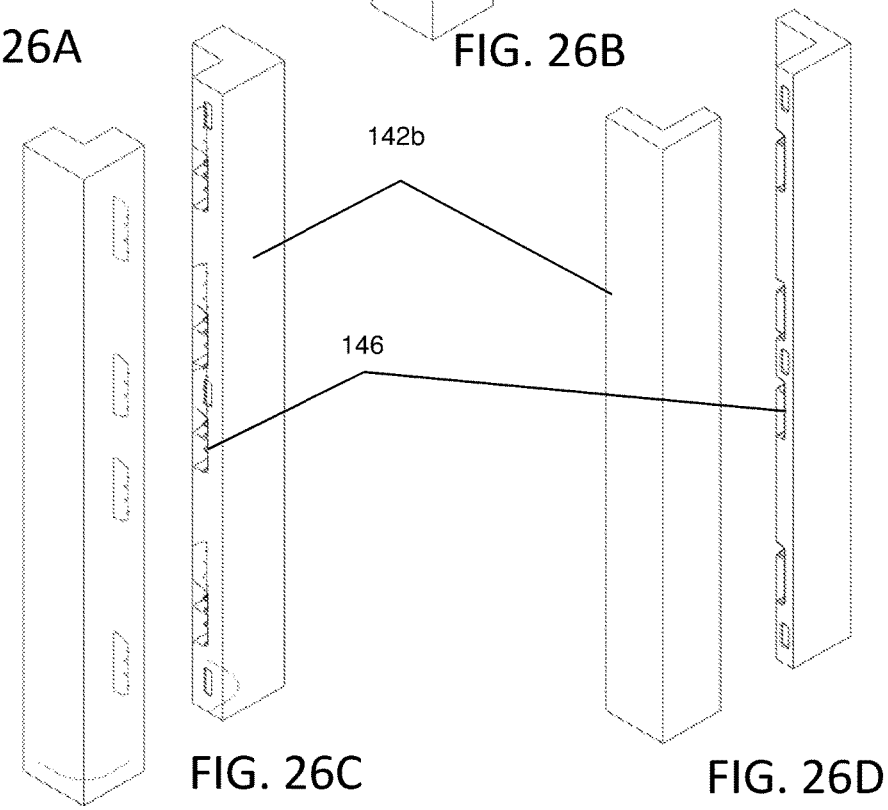
FIG. 26C
FIG. 26D

MODULAR WALL SYSTEM WITH INTEGRATED CHANNELS

CROSS-REFERENCE TO RELATED APPLICATIONS

This application is a continuation-in-part of U.S. patent application Ser. No. 15/011,568 filed on Jan. 31, 2016 which is a continuation-in-part of U.S. patent application Ser. No. 12/901,700 filed on Oct. 11, 2010 and issued on Feb. 2, 2016 as U.S. Pat. No. 9,249,572, both of which are hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention pertains to modular wall systems formed with installation channels for various conduits and junctions, including electrical power, electrical communication, plumbing, central vacuum, and heating, ventilation and air conditioning (HVAC).

Related Art

The invention relates to prefabricated modular building construction and units utilized in that construction. Prefabricated building components are used for construction because of their efficiency in installation which can potentially have expense cutting aspects and the reduction in the depletion of natural resources.

Historically the use of 2×4 studs of wood or other lumber of standard dimensions were most commonly used to fabricate the interior and exterior portions of buildings. Skilled tradesmen and a significant amount of time are needed for the fabrication of buildings by this traditional method of building construction. While prefabricated walls made from studs are available, the weight of the units makes them less efficient for installation. These prefabricated walls do not overcome the issue of the depletion of natural resources because they use standard lumber, the manufacturing of which involves a significant amount of waste material. Due to the weight and size of these types of prefabricated walls there are issues with shipping and storage. The installation of elements such as electrical, plumbing, and heating and cooling elements requires drilling, threading, blocking or other time consuming methods for installation because there are no channels for the horizontal placement of these systems.

Other systems using prefabricated walls use materials such as metal sheets or poured concrete or cement forms. These types of systems have been unable to overcome the need for skilled tradesmen for installation. Additionally the prefabricated components are heavy and are unable to be installed without the use of specialty equipment such as cranes, lifts, or other heavy mechanical equipment. In addition, many of the systems have been unable to accommodate plumbing, electrical, and HVAC or are make it difficult to install these systems because of the inability to directly install without feeding the systems through complex or small openings. Many of the systems additionally have not been made of materials that help cut costs and reduce the use of non-renewable resources, or are cumbersome and installation is inconvenient and time consuming.

One such system attempted to overcome some of the issues with standard framing techniques: U.S. Pat. No. 6,584,740 and U.S. Pat. No. 5,440,846. However, the system is made with non-renewable materials, doesn't accommodate the electrical, plumbing and HVAC systems in an easy to install manner, and are unable to work with existing structures. The system is designed to be a fully assembled system whereby the users have to use all components of the system in order to develop an entire structure. Thus, the system is unable to be integrated into already developed structures.

Thus, a prefabricated building system made of renewable materials that helps reduce waste and that is easy to install, store, and ship is needed. Additionally a prefabricated system that enables the installation of electrical, plumbing, HVAC, and insulation to be installed vertically and enables easy installation of electrical and plumbing in the horizontal direction without the need for threading, blocking or other time consuming installation issues, has yet to be developed.

SUMMARY OF THE INVENTION

According to various aspects of the present disclosure, there are provided multiple descriptions of the present invention. The present disclosure includes a prefabricated wall assembly that is made from materials which are otherwise waste products in the agricultural and forestry industry. The prefabricated building components in the present disclosure are made of natural fast growing plant fibers, such as wood chips or annually re-growing agricultural byproducts or waste products like straw, sorghum grass, corn husks, corn stalks, or corn stover, agave, coconut or bamboo fibers or similar suitable natural fibers. The present system also helps in overcoming the need for waste disposal of these byproducts in their respective industries.

In addition to overcoming the need to utilize the waste associated with the above disclosed industries, utilizing these plant fibers generates a second form of income for farmers and companies in these industries as the byproducts of farming can now be utilized as viable building materials. The use of this abundant waste product allows for the construction of the present invention to be lower in terms of raw materials costs, lower production prices, and higher profit margins for manufactures enabling a delivery of a sustainable product of equal or lower cost than conventional lumber or prefabricated metal structures. These prefabricated structures can be utilized in both new and redesigned structures because of the unique way the prefabricated structures enable all components in modern buildings (electrical, plumbing, central vacuum, and HVAC) to be run through the structures. Additionally, color coded areas which enable the ease of construction and can reduce waste by 10-15% from conventional building methods.

In one embodiment of the present disclosure the trapezoidal design of the system creates a stronger and more resilient and lighter construction. This enhances the ease of installation but also the overall sturdiness to the structure. As a closed system the wall panel system withstands stronger shear, compression and torsion forces while utilizing less material to achieve these enhanced structural properties. The panels are capable of being cut to length so that they can be utilized to build a particular desired sized structure. Additionally windows, doors and other elements can be cut into the structures for installation of these additional elements in construction.

The prefabricated wall panels in one embodiment of the present disclosure are equal or similar to standard building materials in size and thus can be installed by one or two men, eliminating the need for cranes, advanced delivery systems and installation materials, overcoming some of the obstacles of other prefabricated systems. In one embodiment the system can be mixed with conventional framing techniques and used in concert with conventional tools for installation reducing the need for a set of separately skilled laborers for the installation. Many of the other prefabricated systems, using metal or other materials are unable to accommodate horizontal and vertical installation of electrical, plumbing, central vacuum and HVAC systems. In addition, the way the channels are formed eliminates the need to thread these systems through the preformed panels. Thus, enabling the current invention to partner in both new and existing structures, while reducing time and the need for additional blocking, drilling, fishing, and feeding.

The corrugated core is the primary structural panel for the prefabricated wall assemblies. The corrugated panel is generally trapezoidal in shape in one configuration and is substantially planar with horizontal channels intersecting one or more vertical channels in another configuration. The corrugated panel creates one or more vertical channels running from ceiling to floor in the assembled unit. According to the trapezoid corrugated panel configuration, the vertical channels open alternately toward the interior and exterior of the corrugated panel. According to the intersecting channel corrugated panel configuration, the vertical and horizontal channels are recessed from the front face of the panel and are preferably mated with a structural foam core and or a backside panel. In conjunction with outer and inner shear panels, the vertical spaces create room for the installation of thermal insulation or the vertical installation of electrical, plumbing and HVAC. A chamber/channel running along each of the sides of the wall panel acts as a location for insertion of connectors and runs vertically between the corrugated panel and the external shear panel. This chamber/channel enables multiple prefabricated wall assemblies to be attached together with a straight connector to form sections of a straight wall or with a corner connection to produce walls with various angles, 90 degrees being the common angle utilized for standard construction. However, a variety of connection angles can be used to accommodate all needs.

On the interior side of the trapezoidal corrugated panel embodiment of the invention are recessed horizontal channels. As indicated above, the intersecting channel corrugated panel embodiment of the invention also has recessed horizontal channels which intersect with one or more vertical channels. The horizontal channels provide space for the installation of standard electrical outlets, light switches and other electrical implements, and the horizontal installation of plumbing. The horizontal channels are positioned at standard heights for bottom wall electrical outlets, mid-height wall outlets and switches for general purpose and kitchen counter height, and another for standard upper wall outlets and j-boxes for wall sconces and respectively for plumbing like the installation of fresh water and waste water lines underneath sinks with supply lines for surface or wall mounted faucets at standard heights. An interior shear panel is attached to the inside surface of the trapezoidal panel by adhesive fasteners such as glues, resins, epoxies, mechanical fasteners such as nails, screws, rivets, or other similar fastening means used independently or with multiple means. Drywall can be attached over the shear wall panel or over the intersecting channel corrugated panel as in standard framing and construction.

The trapezoidal corrugated panel and intersecting channel corrugated panel configurations can be varied in several different combinations and arrangements to create various types of interior walls and exterior walls. For example, the intersecting channel configuration can be used in combination with a trapezoidal panel or can be used on its own as a shear panel and core structural support. For an exterior wall in which horizontal channels are primarily required only on the interior side of the wall, the planar intersecting channel panel can be selected for the interior panel and can be mated with a flat shear panel on the exterior side. For interior walls, horizontal channels are more likely going to be used on both sides of the wall so two intersecting corrugated panels are preferably connected in a back to back configuration. In one arrangement, the back to back panels can symmetrically mirror each other or can asymmetrically mirror each other to achieve horizontal channels on both sides of the wall. In yet another arrangement, adjacent panels with horizontal channels on one side can face in different directions so that the horizontal channel is on one side of the wall for one of the adjacent panels and the horizontal channel is on the other side of the wall for the other one of the adjacent panels. Holes are prefabricated in the panels or can be cut into the panels to connect to the horizontal channels on the opposite sides of the wall and allow the conduits to traverse the wall from the horizontal channel on one side of the wall to the horizontal channel on the other side of the wall.

Channel connectors can be inserted between two adjoining prefabricated wall segments or completed assemblies. The channel connector is complimentary in shape to the chamber/channel that runs vertically along the sides of the prefabricated wall assembly. The channel connectors are the male counterpart to the female chamber/channel. The channel connectors can be fabricated from material similar to the prefabricated wall assemblies or can be made of other materials such as wood, metal, polymers, plastics, composites, or the like. Channel connectors can have a variety of shapes. In one embodiment the channel connector is comb shaped on either side and each side fits into a similarly shaped chamber/channel. The channel connectors can be simply rectangular in shape, have semicircle protrusions or any other structure similar in nature without departing from the scope of the present disclosure.

A corner can be generated by connecting two units to form an angle at a corner post. Corner posts can be made of standard lumber materials, metal, plastics, or other suitable resources. The corner post is mechanically fastened to each prefabricated wall assembly with the additional support of a post cap. The post cap has two legs that are attached to form an angle. Each leg of the post cap has male components similar in shape to the channel connectors and are inserted into the same vertical chambers as the channel connectors. These corner connectors wrap around a standard lumber post which provides structural stability to the connector. In addition to the channel connectors, hold down bolts and hold down brackets are inserted through the corner post and post caps into the prefabricated wall assembly from both sides of the corner.

Thermal insulation can be made from various materials offering superior quality. The insulation will be inserted in the outer insulation channels during production prior to the attachment of the outer shear panel. Additionally, insulation can be installed in channels before or after installation of the wall segments by either cutting insulation to fit or using spray or foam type insulation into the core. Insulation also can be installed on the interior opening vertical chambers prior to attachment of the interior shear panel, again either during production or during installation of the prefabricated wall assemblies. Insulation can also be installed in the exterior opening vertical chambers either before or during installation.

An interior channel brace is located internal to the interior shear panel and is screwed or nailed or fixed by some other similar mechanism into the sides of the core channel in the corrugated core. The channel brace is generally shaped the same as the trapezoidal shape of the corrugated core so as to provide additional integrity to the structure. The channel braces provide additional structural strength where needed, for example for the attachment of a wall connector which runs perpendicular to the main wall segment. It also provides additional mounting surface to which vertical wall rails can be attached by mechanical fasteners such as nails, screws, staples, rivets, glue, or the like, in solo or in combination.

Top plates and bottom plates are attached to the core and run parallel to each other at the top and bottom of the wall segment, respectively. Bottom plates are attached to the floor through mechanical fasteners. Bottom plates have a base and two parallel protrusions running from the base into the corrugated core and the outer shear panel. The bottom plates provide guides for installation of the prefabricated wall assemblies and provide attachment to the individual assembly. The top plates consist of a body and two vertically oriented rails protruding from the body into the corrugated core, mirroring the bottom plates. The vertical protrusions act as guides as well as attachment points for the core and outer shear panel. Wall rails are of similar design as the bottom and top rails and serve as anchor points for the interior walls which run perpendicular or non-parallel to the exterior walls. The wall rails are mounted to the walls vertically by mechanical fasteners such as glue, nails, rivets, screws, or similar equivalent mechanism as previously described.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings. The drawings constitute a part of this specification and include exemplary embodiments of the invention, which may be embodied in various forms. It is to be understood that in some instances, various aspects of the invention may be shown exaggerated or enlarged to facilitate an understanding of the invention; therefore the drawings are not necessarily to scale. In addition, in the embodiments depicted herein, like reference numerals in the various drawings refer to identical or near identical structural elements.

FIG. 18A is a top view of a representative wall panel assembly with mirroring asymmetric intersecting channel panels having shallow channels.

FIGS. 18B and 18C are side views of mirroring asymmetric intersecting channel panels with moderately deep vertical channels.

FIGS. 18D and 18E are top views of mirroring asymmetric intersecting channel panels with moderately deep vertical channels.

FIGS. 26A-26G depict corner panels according to the present invention.

DETAILED DESCRIPTION OF THE PREFERRED EMBODIMENTS

The following description of the preferred embodiment(s) is merely exemplary in nature and is in no way intended to limit the invention, its application, or uses.

Figure 1:
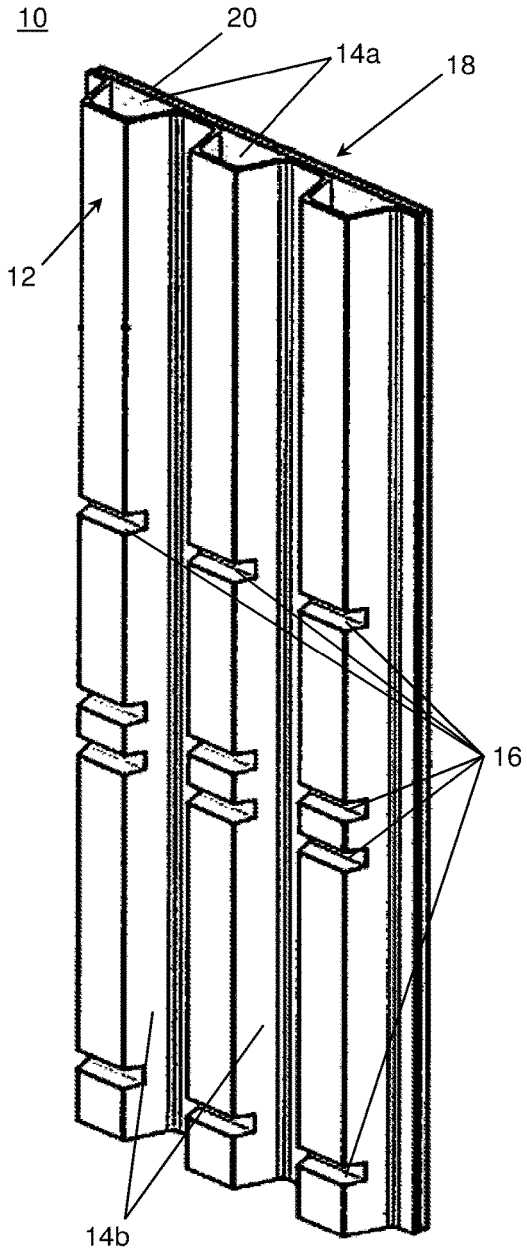
FIG. 1 depicts an isometric inside view of a wall panel assembly.

FIG. 1 is an exemplary embodiment of an isometric view of the inside of a segment of a wall panel 10 according to the present invention. The cross-section shows the corrugated core 12 which provides vertical channels 14*a* for installation of insulation 30, and the conduits and components 32 for electrical, plumbing, central vacuum, and HVAC systems. Vertical chambers 14*b* in the corrugated core are generally intended for plumbing, electrical, central vacuum, HVAC and insulation. Horizontal channels 16 allow for easy installation of electrical, plumbing and HVAC systems in the interior of the structure without the need for threading as with previously designed systems. An exterior shear panel 18*a* can be cut to accommodate individual widths of each prefabricated panel system 10 and can be connected to adjacent panels at any width. The exterior shear panel is mechanically fixed to the corrugated core by means of mechanical fasteners 60*a* such as nails, screws, rivets, bolts, and staples, adhesive fasteners 60*b* such as glues, resins, and epoxies, or any similarly suitable fastener 60.

Figure 2:
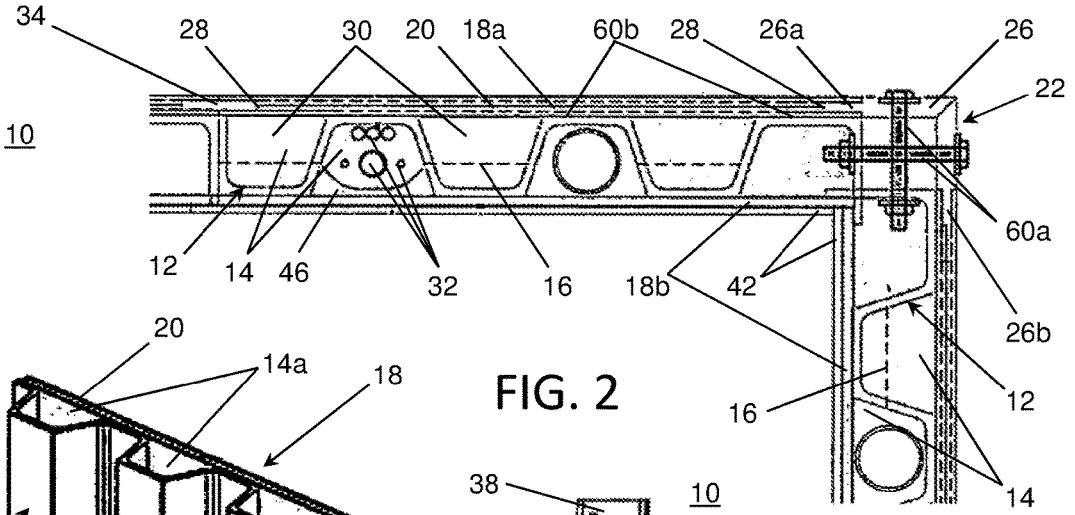
FIG. 2 is a horizontal cross-section through a corner of a wall panel assembly.

FIG. 2 is an exemplary embodiment of two units 10 connected together forming a corner 22. The image is a horizontal cross section of the two units joined in the corner by a corner post 24 and mechanical fastening means 60*a*. A post cap 26, with legs 26*a*, 26*b* that extend from either side, wraps around the corner post 24; the leg is preferably a male fitting for the slot 28 in the exterior shear panel 18*a*. The exterior shear panel 18*a* can be cut to length and installed after installation of the corrugated core 12. Vertical channels 14 run from ceiling to floor through the corrugated core 12 and enable the installation of electrical, plumbing, HVAC and insulation. Insulation batts 30 are optionally added in the prefabricated wall segment 10 either before or during installation. A channel connector 34 connects two adjacent prefabricated wall segments together by insertion of opposing two male ends 34*a* into adjacent hollow chambers/channels 36 running along either the left or the right side of the structural wall panel assembly 10.

Figure 3:
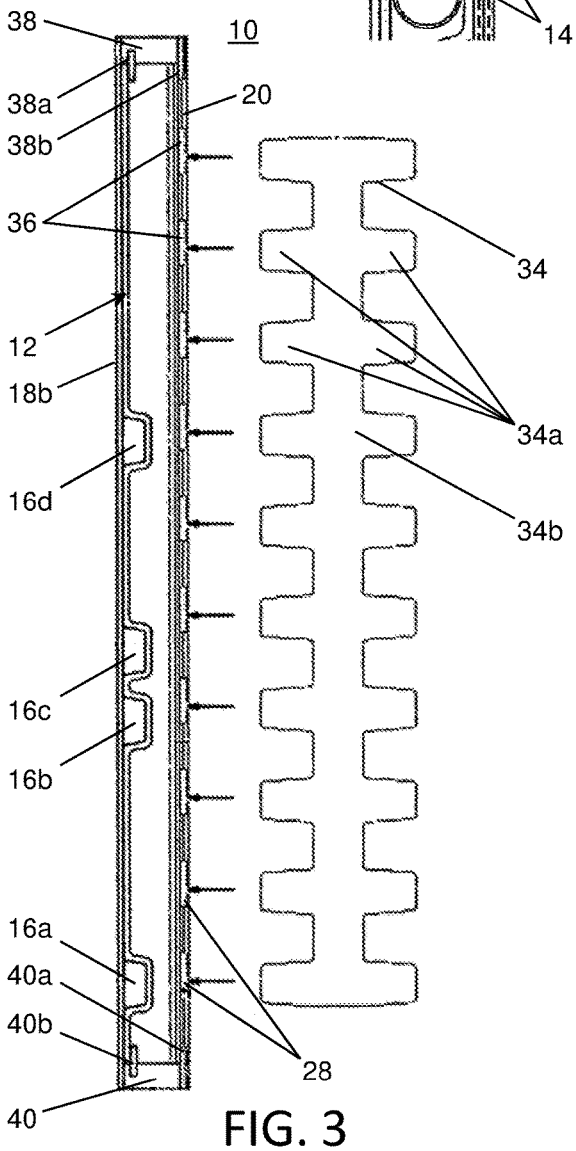
FIG. 3 is a vertical cross-section of a wall panel assembly.

FIG. 3 is a vertical cross section of a prefabricated wall segment assembly. A top plate 38 is attached at the top of the wall assembly and has two parallel protrusions 38*a*, 38*b* extending from the body into the corrugated core 12 and the exterior shear panel 18*a*. The top plate is attached to the corrugated core by mechanical fastening means. The bottom plate 40 mirrors the top plate 38 and is attached to the floor and the corrugated core by mechanical fastening means. The bottom plate 40 consists of a base and two parallel protrusions 40*a*, 40*b* extending from the base into the corrugated core 12 and the exterior shear panel 18*a*. The bottom plate 40 acts as a guide for the installation of the wall segment. A channel connector 34 is inserted in the chamber/channel on either side of two adjacent wall segments. The channel connector 34 can have a comb-like appearance with teeth 34*a* that project from either side of a central spine 34*b* or can have any variety of different shapes which are able to be inserted into the chamber/channel.

Four (4) series of horizontal channels 16*a*, 16*b*, 16*c* and 16*d* are provided for horizontal installation of conduits 32*a* and components 32*b* for electrical, plumbing, central vacuum, and HVAC systems. Electrical conduits 32*a*' include power lines, communication wires (such as cables for audio/video systems, telephony, internet, etc.). Plumbing conduits 32*a*" include pipes for fresh water and waste water. Tubes for central vacuum systems and ducts for HVAC system can also be run through the structural panel assemblies, although these conduits and the waste water pipes are much more likely to run in the vertical channels rather than in the horizontal channels. Electrical components 32*b* could include j-boxes 32*b*' (and wall sconces), switches and outlets. Similarly, plumbing components could also include switches and outlets at varying heights depending on the particular need according to the building design. Of course, there could be a lesser number of horizontal installation channels or even more horizontal installation channels. For example, a fifth horizontal channel may be used for a sink drain pipe where the t-trap enters the wall.

Generally, the horizontal channels of the present invention enable installation without the need for complex threading, looping, lacing or time consuming measures needs. Adjacent wall panel assemblies 10 have horizontal channels at the same height relative to the bottom plate so that the conduits can run the entire length of the wall if needed. The lower horizontal channel is proximate to the bottom side, with the pair of middle horizontal channels being proximate to the center of the corrugated panel, and the upper horizontal channel is above the center of the corrugated panel.

Figure 4A:
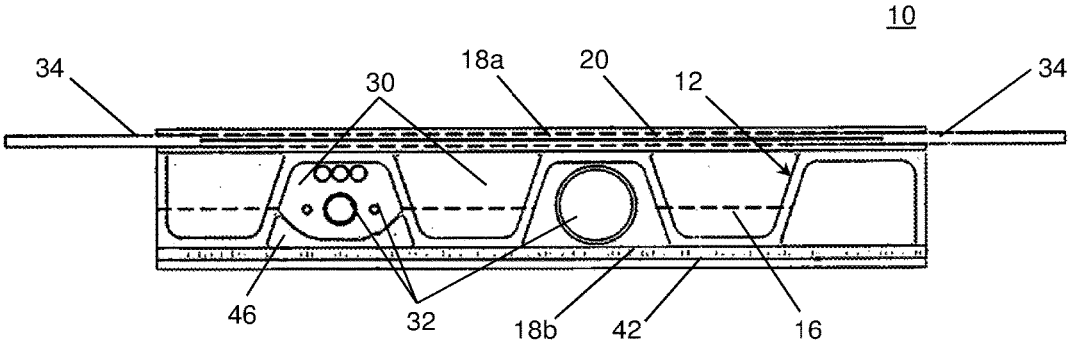
FIG. 4A is a horizontal cross-section of an installed wall panel assembly.

FIG. 4A is a horizontal section of a finished assembled prefabricated wall segment. The corrugated core 12 is the main component of the segment. The corrugated core 12 enables attachment of both an interior shear wall panel and an exterior shear wall panel 18. Channel connectors 34 enable connection of two adjacent wall assemblies with the male component to the female fitting found in the exterior shear panel 18*a* located on each side of the wall segment. The dashed line in FIG. 4A shows the depth of the horizontal channels 16 for the installation of electrical and plumbing implements at various heights along the corrugated core 12 (heights predetermined following standard design rules and outlet heights and are preferably ADA compliant). In addition to the horizontal channels 16, vertical channels 14 show locations for installation of electrical, plumbing, HVAC and insulation (optional) during installation of the wall segments.

Figure 4B:
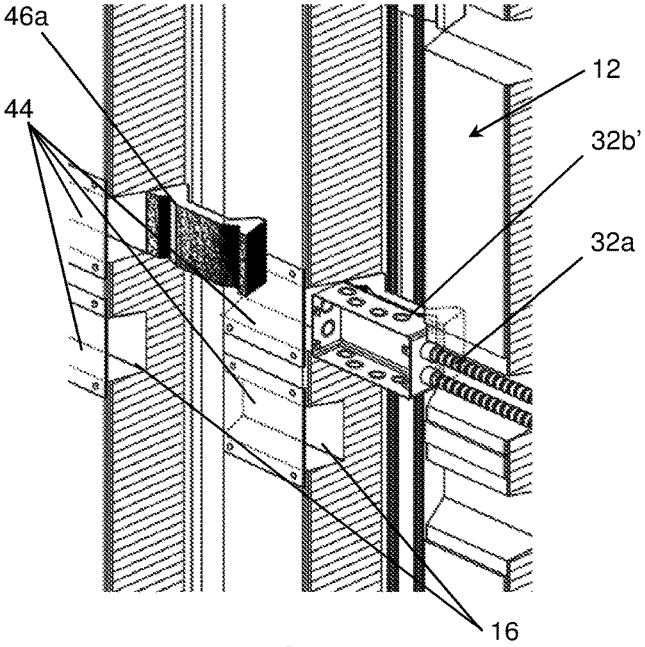
FIGS. 4B and 4C are perspective views of alternative installations of conduits, fixtures and brackets in the wall panel assembly.
Figure 4C:
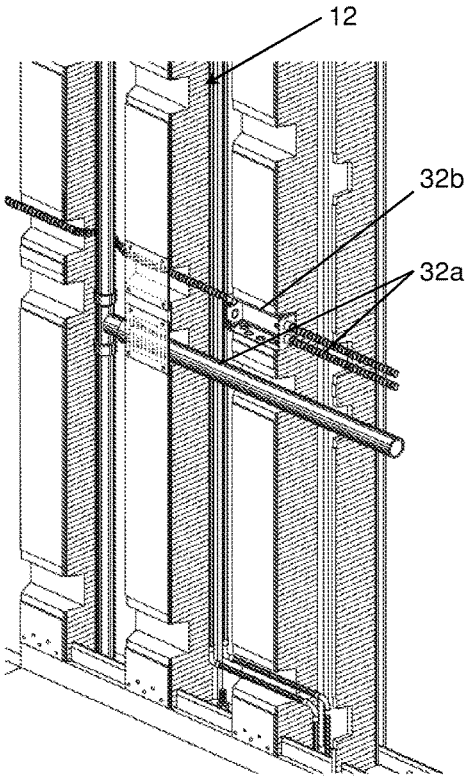

The exterior shear panel 18*a* and interior shear panel 18*b* are installed after the various conduits and components are run in the horizontal channels and the vertical channels and can be cut to various dimensions depending on the size of the corrugated core 12. FIGS. 4B and 4C show exemplary conduits 32*a* and components 32*b* that are installed in the horizontal channels and vertical channels before the walls are finished with shear panels 18 and/or wallboard 42. These drawings also show how brackets 44 and braces 46 can be used to help hold the conduits 32*a* and components 32*b* in place in the channels 14, 16 of the wall panel assemblies 10.

FIG. 4A demonstrates that drywall 42 and other types of wallboard also can be installed against the interior shear panel 18*b* during installation. Because of the unique design of the prefabricated wall segments, the segments can work with existing structures which may or may not have drywall or other commonly used surface treatments, such as plaster or other types of wallboard. It will also be appreciated that an interior shear panel may not be required. As explained in detail below, the corrugated panel could be used in combination with a structural foam and/or with another corrugated panel in a back to back arrangement which would provide sufficient strength that the panel with foam and/or mated panels also serve as the shear panels so a separate shear panel, interior or exterior, may not be required.

Various styles of channel braces 46*a*, 46*b* can be installed at various locations within the corrugated core 12 and are generally complimentary in shape and size to the trapezoidal structure of the corrugated core. Channel braces 46 generally add additional strength where needed and are mechanically fixed in place by screws, bolts, nails, glue, epoxy, resins, or similar fasteners 60. As shown in the drawings of FIGS. 4B and 4C, a localized channel brace 46*a* can be used in the vertical channel adjacent to one or more horizontal channels. Alternatively, as shown in FIG. 7, an elongated channel brace 46*b* can extend the entire length of the vertical channel.

Figure 5A:
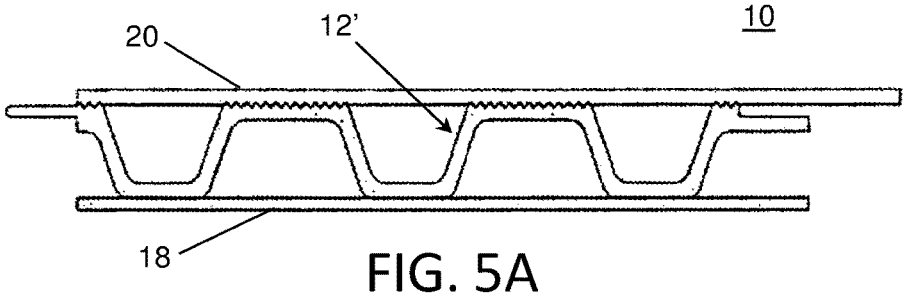
FIGS. 5A-5C are horizontal cross-sections of alternative versions for the corrugated core.
Figure 5B:
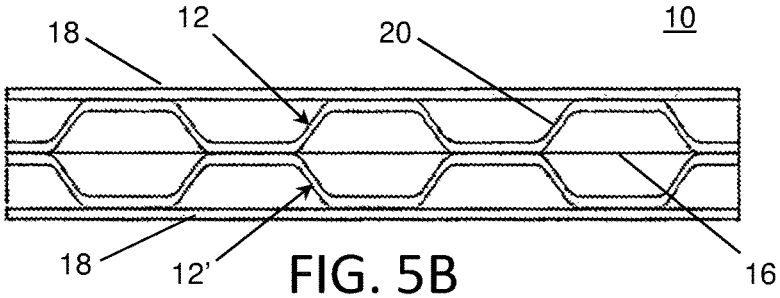
Figure 5C:
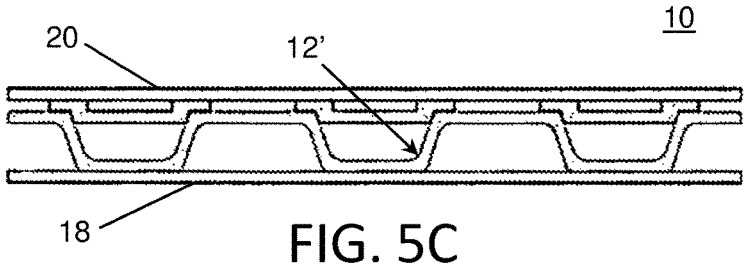

FIGS. 5A-5C show three optional versions for the structure of the corrugated core. FIG. 5A shows a front facing corrugated core 12' with a backside panel 20 attached to the solid composite corrugated core with a top joint for attaching multiple panels together (corrugated core with lap joint). It will be appreciated that the backside panel could be an interior shear panel when the wall assembly 10 is used for an interior wall or an exterior shear panel when the wall assembly 10 is used for an interior wall. Depending on the strength required for the wall panel, the panel on the front side of the corrugated core 12' could be a shear panel 18 or wallboard. FIG. 5B shows another embodiment of the present invention where two corrugated trapezoidal cores 12, 12' are buttressed together, back to back, so that the interior portion of the corrugated core creates a honeycomb or hexagonal shape (double-sided corrugated core). The shear panels 18 are attached separately, and in this case, it will be appreciated that one of the corrugated cores could serve as the backside panel 20. It is evident that horizontal channels could be formed in both of the corrugated panels 12, 12' for an interior wall or only the front facing corrugated panel 12' may have horizontal channels for an exterior wall. Alternative versions of this configuration using various arrangements of the corrugated core 12, including a variety of front facing corrugated panels 12' are described in detail below with reference to as FIGS. 9-19. FIG. 5C shows a third embodiment of the trapezoidal corrugated core 12'. In between each of the vertical channels in the exterior portion of the core are channel braces 46 for added support (corrugated core with channel braces). This particular configuration could be inverted and the channel braces would be buttressed up against the interior shear panel as an alternative design. The exterior and interior shear panels would be attached separately.

Figure 6A:
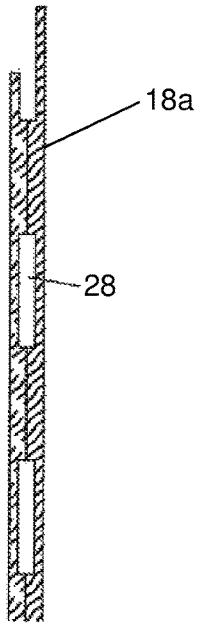
FIGS. 6A and 6B are a cross-sectional side view and a perspective view, respectively, of the outer shear panel.
Figure 6B:
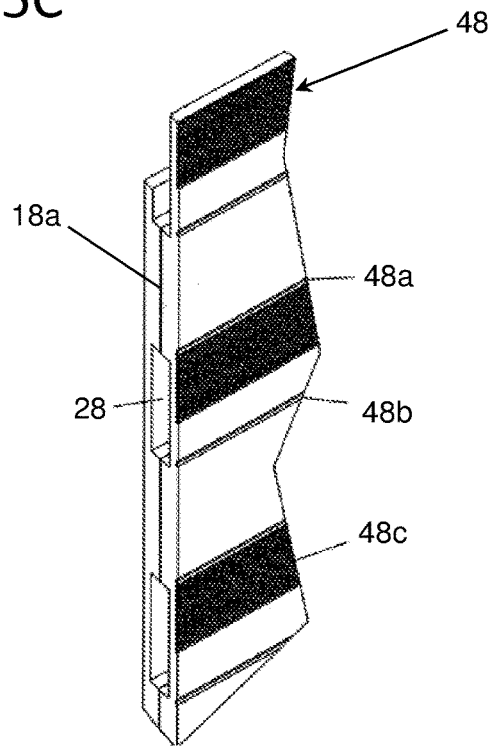

FIG. 6 depicts an isometric section of the outer shear panel 18*a*. Shadowed areas 48 define predetermined areas of the outer shear panel where the panel can be cut to allow for different wall heights. The shadowed areas allow for various cutting heights while still providing enough overlap to enable the male component 34*a* of the channel connector 34 to insert into the chamber or slot 28. The color coded regions 48*a*, 48*b* on a horizontal portion of a wall segment can also signify the lowest point where the panels can be cut and still provide enough overlap for the insertion of the top plate. Portions of the wall can be color coded by adding dye to the plant fibers to enable easier attachment of different elements of the prefabricated construction system. The lengthwise shadowed area 48*c* is also useful to show where the wall segment can be cut for any given width and still allow for connection of the top plate.

Figure 7:
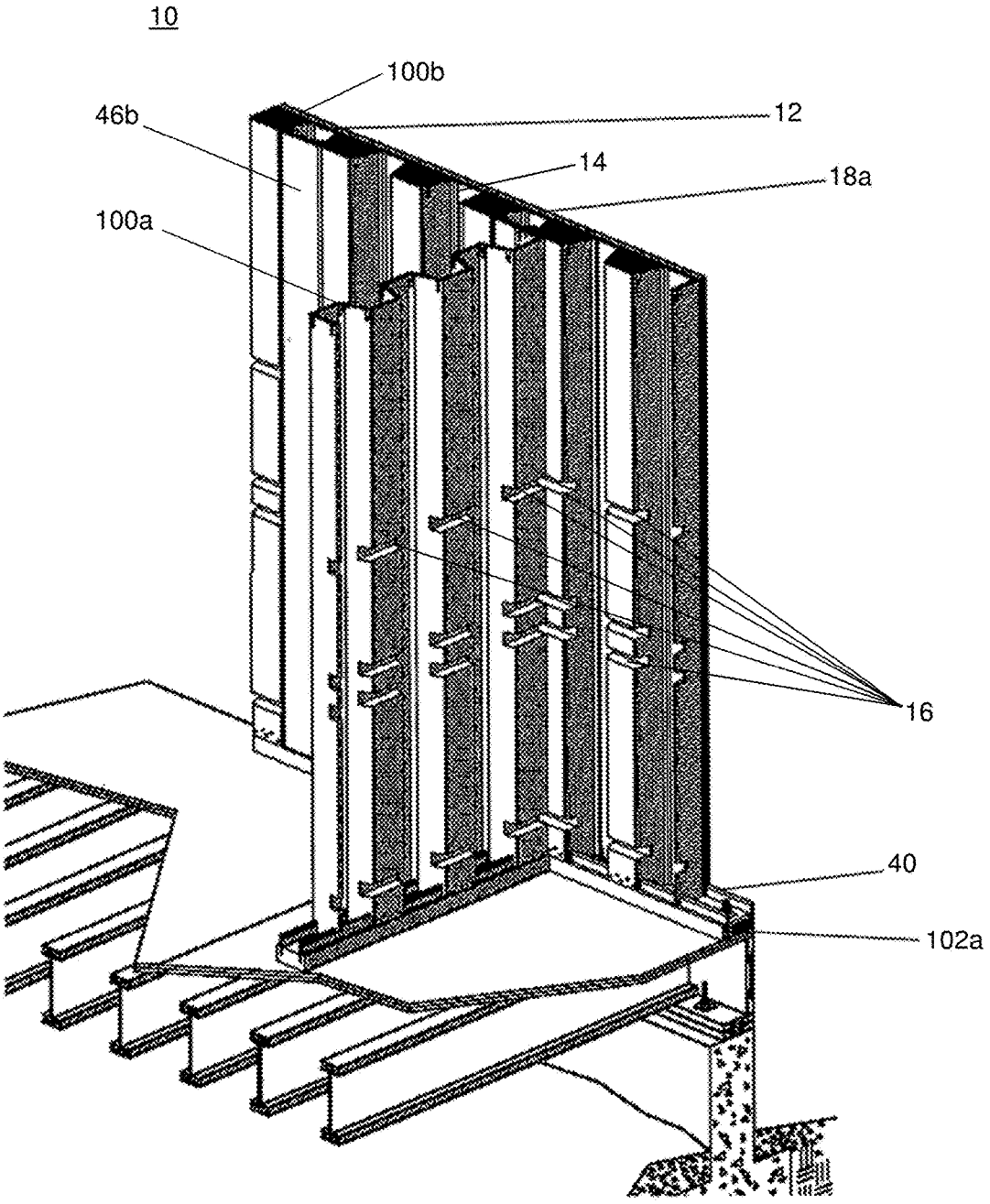
FIG. 7 is a perspective view of panel assemblies connected to form interior and exterior walls.

FIG. 7 depicts an interior wall 100*a* and an exterior wall 100*b* generated by connecting multiple wall panel assemblies 10 together at an angle. The plumbing, electrical and all other building components can be run from the channels 14, 16 in the exterior wall's assemblies throughout the channels 14, 16 of the interior wall's assemblies to reach the interior spaces of the building. As indicated above, additional support can be provided by connecting an interior channel brace 46 into the vertical spaces in the wall segment. As explained in detail below with reference to FIG. 19, the frontward facing side of the corrugated panels for adjacent wall panel assemblies can alternate the side of the wall that they face so that the conduits and components can be accessed from opposite sides of the internal wall 100*a*. Bottom plates 40 are attached to the wall segments and to the subfloor 102.

Figure 8A:
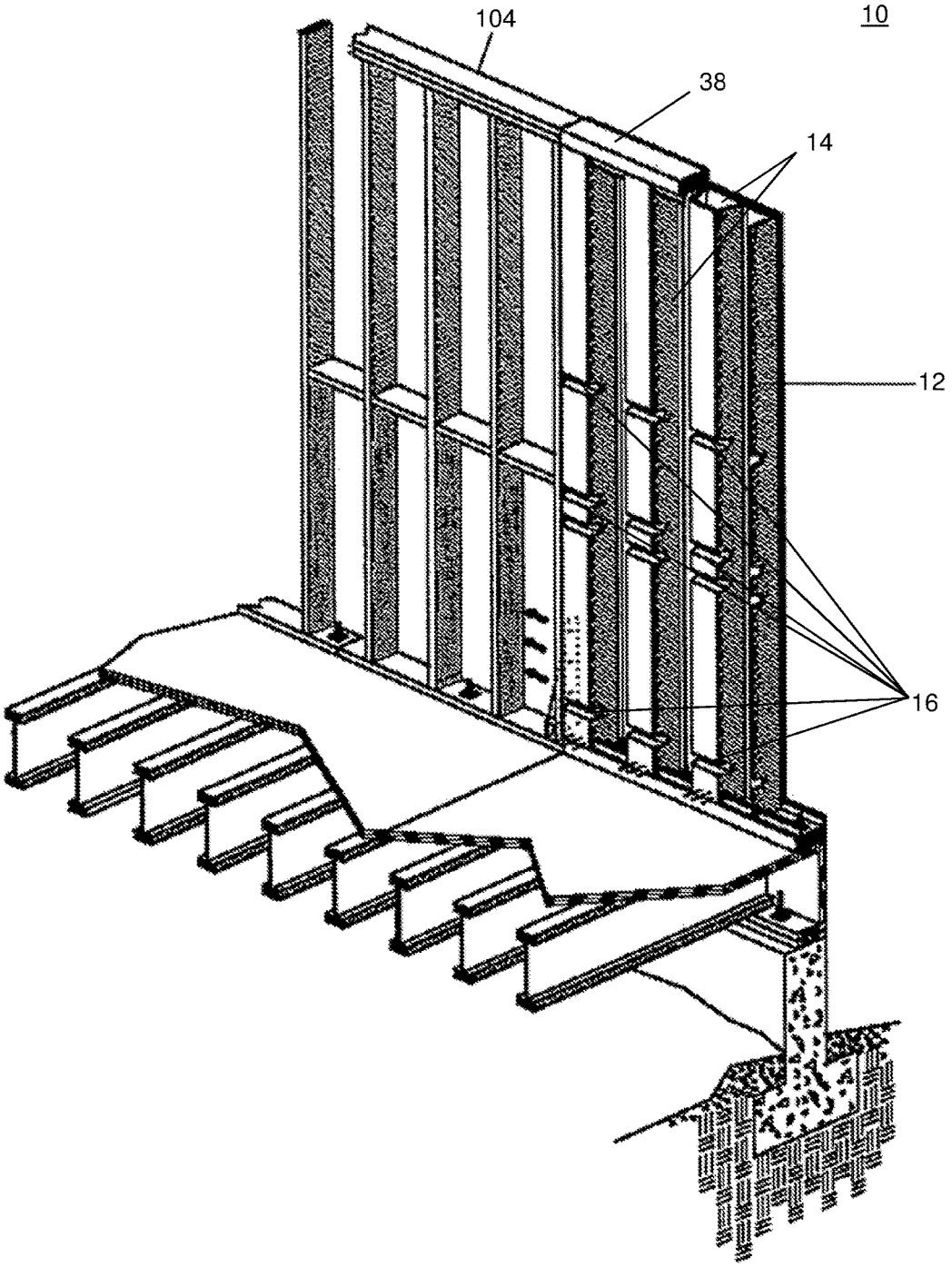
FIGS. 8A and 8B are perspective views of prefabricated exterior panel assemblies connected to standard framing.
Figure 8B:
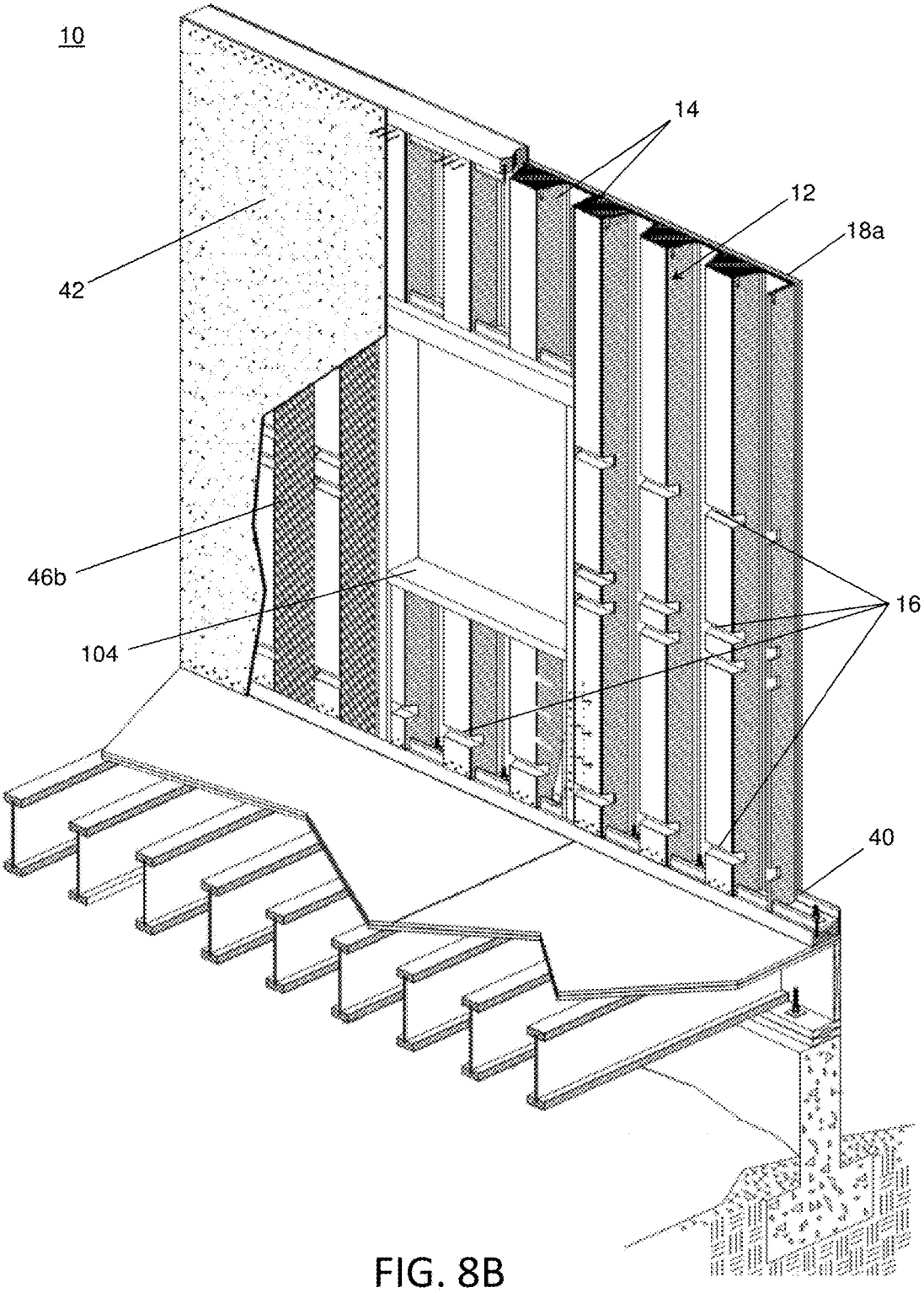

FIG. 8A depicts a portion of a prefabricated wall segment 10 connected to standard stud house framing 104. The top plate 38 of the wall panel assembly 10 connects to the double top plate used in standard stud framing. FIG. 8B shows how the wall panel assembly 10 can be cut to form various features for a building, such as a window frame 104. Even though the window frame blocks some of the horizontal channels, conduits can still be run through the horizontal channel 16 that runs along the bottom side of the wall panel assembly.

Figure 9A:
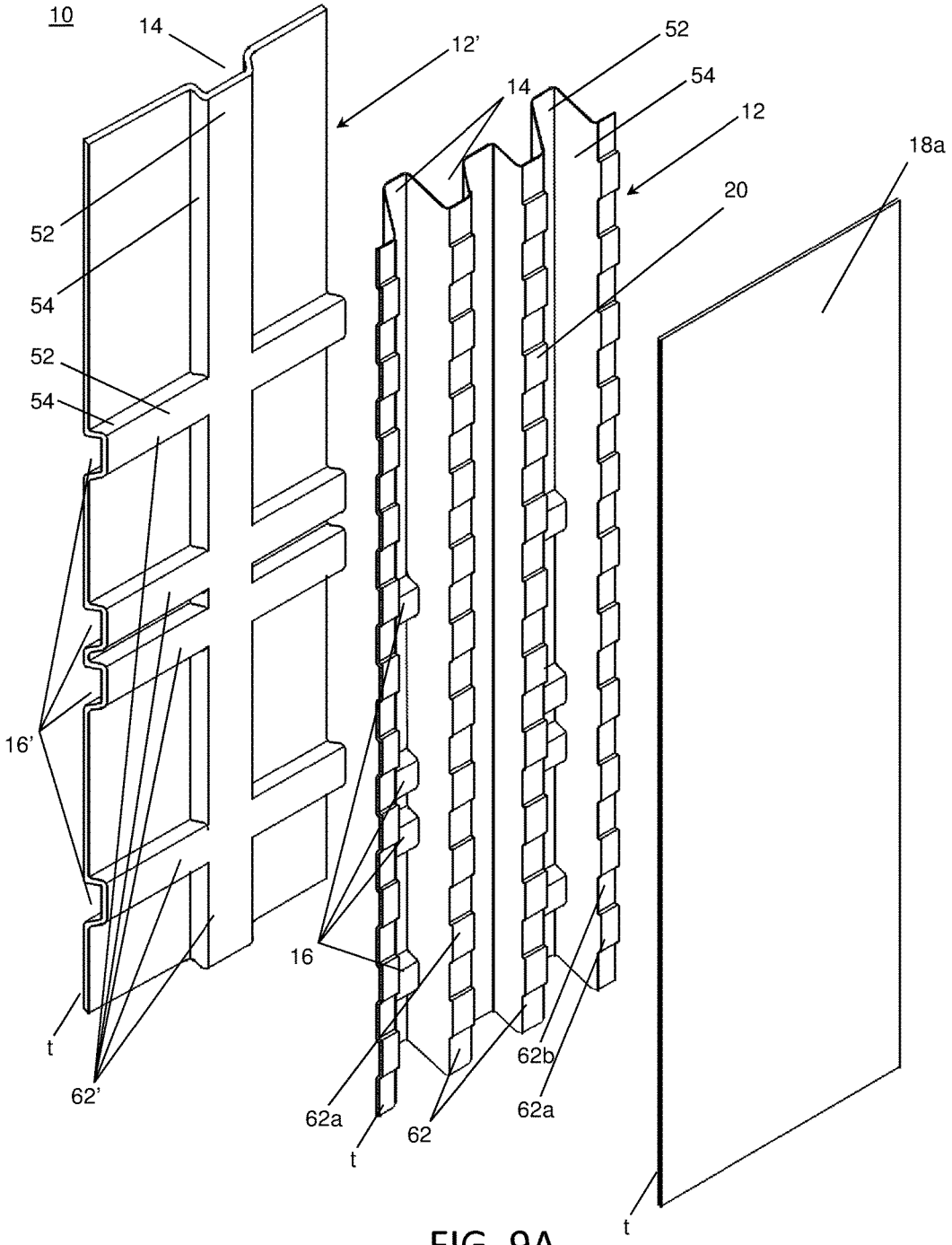
FIG. 9A is an isometric exploded view of a wall panel assembly with an intersecting channel panel, a trapezoidal corrugated core panel, and a flat shear panel.

As indicated above with reference to FIGS. 5A, 5B and 5C, the present invention encompasses alternative configurations of wall panel assemblies that have various arrangements of the innovative corrugated core 12. For example, a double-sided corrugated core embodiment is generally described and shown in FIG. 5B. The embodiment shown in FIG. 5B suggests a pair of corrugated cores that symmetrically mirror each other, but it will be appreciated that the double-sided corrugated core could have asymmetric corrugated panels and could have corrugated panels with complementary shapes without exactly mirroring each other. One such complementary shape of corrugated panels is shown in FIG. 9 and is described in detail below. Other complementary shapes are shown in FIGS. 10-14. Of course, corrugated cores that symmetrically mirror each other can come in a variety of different shapes, such as shown in FIGS. 5, 15, and 16. Corrugated cores can also asymmetrically mirror each other, such as shown in FIGS. 17 and 18. Additionally, as shown in FIG. 19, for wall panel assemblies with asymmetric corrugated panels that have horizontal and vertical channels on only one side of the panel assembly, adjacent wall panel assemblies can alternate the direction that they face so that components and other fixtures can be available on both sides of an internal wall.

Generally, regardless of whether the corrugated panel has a trapezoid horizontal cross-sectional shape 12 or is substantially planar with horizontal channels 16 intersecting one or more vertical channels 14, the corrugated panels of the present invention have one or more vertical channels in combination with horizontal channels that are recessed from the front face by either the same depth or different depths. The corrugated panels 12, 12' are rectangular with a height (H) between the panel's top and bottom, a width (W) between the side ends, a wall thickness between the front and back faces, and a corrugation depth (D) measured from a front face peak to a back face peak. The panels are preferably formed from a thin-walled material (t) so the channels 14, 16 that are recessed from the front face appear as projections on the back face. It will be appreciated that the panels could be formed from a material that is thicker than the corrugation depth so that the channels are recessed from the front face but has a flat back surface. The vertical channel has a length extending the entire panel height and a width that is less than one third (⅓) the panel width or less than one fourth (¼) the height of a full length panel, i.e., eight feet (8' or greater). The width of the horizontal channels extends the entire panel width. Additionally, at least one of the horizontal channels preferably has a width greater than one-half (½) the channel width of the vertical channel.

The wall panel assemblies 10 are preferably formed with at least one backside panel 20 connected to the corrugated panel 12, 12'. The backside panel 20 can have attachment points directly on the corrugated panel or can be connected through another structural element, such as structural foam 50. In each arrangement, the backside panel has an inner surface facing toward the corrugated panel's back face and an outer surface facing away from the corrugated panel's back face. As evident from the various wall panel assembly arrangements described below, the backside panel 20 can be a shear panel 18, a backside flat panel 76 (with or without protrusions and indentations), a backside corrugated panel symmetrically mirroring the corrugated panel 78, a backside corrugated panel asymmetrically mirroring the corrugated panel 80, a sandwiched corrugated panel 12, or a combination of these panels.

As shown in FIG. 9, the wall panel assembly has a corrugated core 12, a front facing corrugated panel 12' that serves as a corrugated inside shear panel, and a flat outer shear panel 18*a* that are mated together in a sandwiched structure. The wall panel assembly is similar to existing structural insulated panels (SIPs) but with additional shear support next to the rigid foam core with an additional inner corrugated core. The corrugated core 12 preferably has multiple corrugations 62 with a uniform pitch, but the depth of at least one of the corrugations (from the crest to the trough) is preferably shallower than the depths of the other corrugations. The front facing corrugated panel 12' has one or more vertical installation channels 14' that are aligned and mate with the shallow corrugation in the corrugated core and also has several horizontal installation channels 16' that are aligned and mate with the horizontal channels 16. Accordingly, as indicated above, the horizontal and vertical channels in the corrugated core are complementary to the horizontal and vertical installation channels in the front facing corrugated panel 12'. Each one of horizontal installation channels 16' preferably has the same depth that intersect with the vertical channel, and the channel depths could be varied as long as the depths are matched by the corresponding horizontal channels 16. The channels 14, 16 have solid bottoms 52 with sloping sidewalls 54. The sloping sidewalls allow for identically shaped corrugated panels to be stored and transported in tightly packed stacks and to be individually removed from the stack without the panels binding to each other.

Figure 9B:
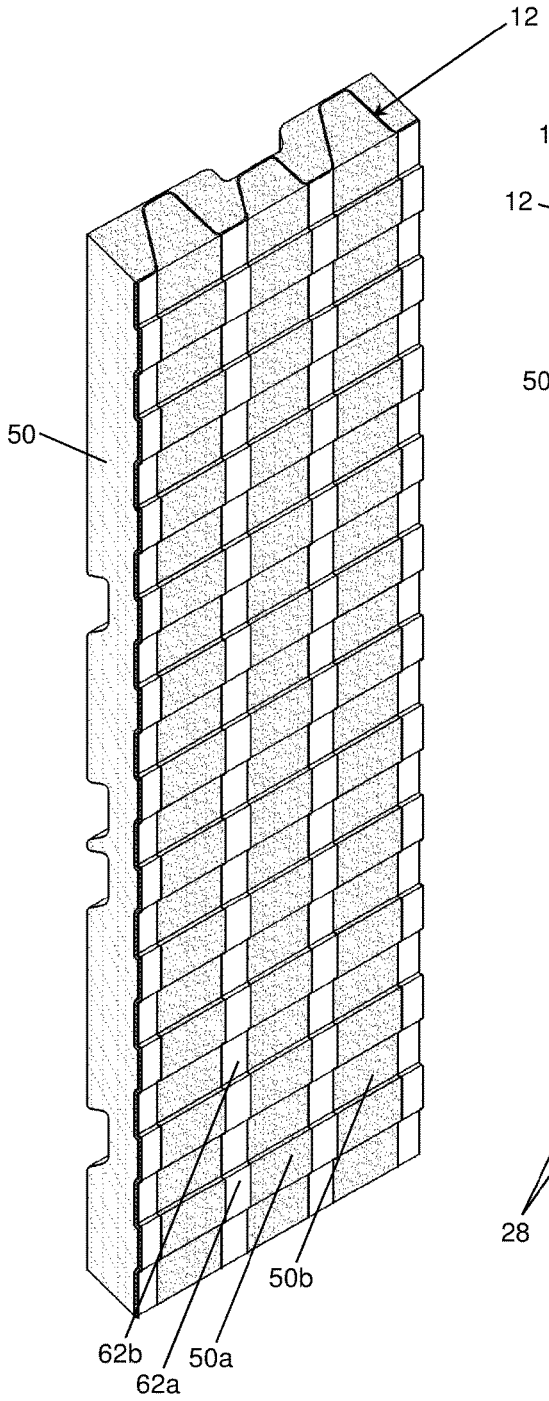
FIG. 9B is an isometric view of the trapezoidal corrugated core panel shown in FIG. 9A with insulation material.
Figure 9C:
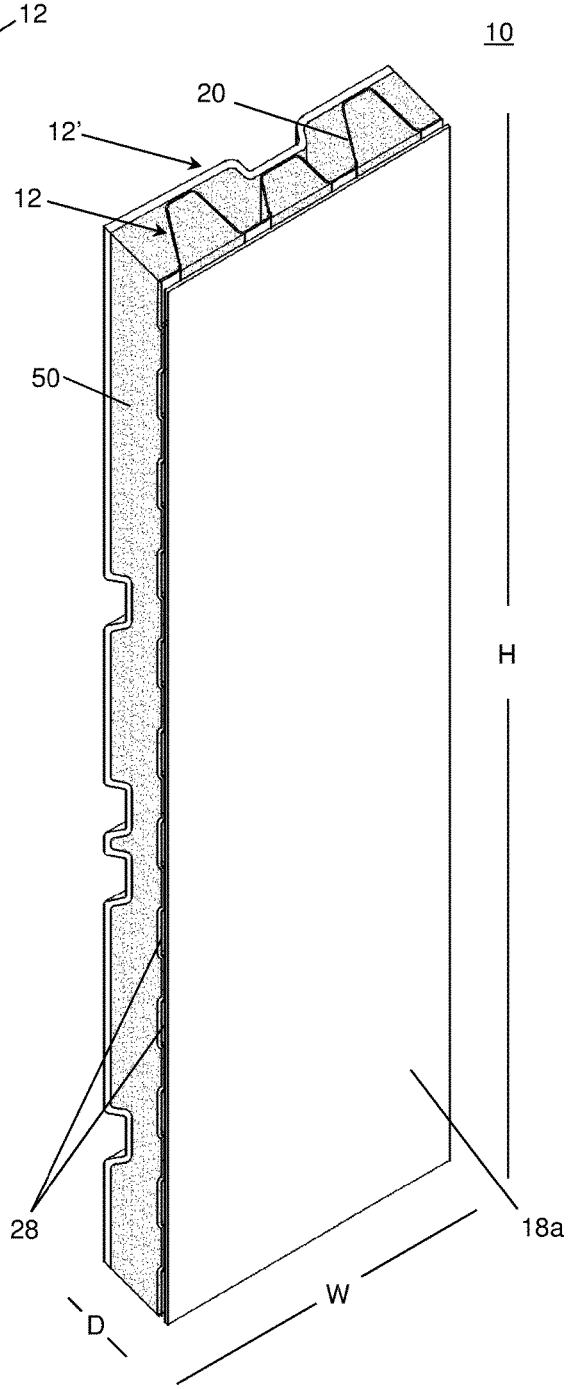
FIG. 9C is an isometric view of the assembled unit shown in FIG. 9A.

The back face of each one of the corrugated core's corrugations (i.e. the face mating with the outer shear panel and facing away from the inner shear panel) are preferably formed with a series of alternating protrusions 62*a* and indentations 62*b*. Similarly, as shown in FIG. 9B, a structural insulation, such as a foam core 50, that fits in the vertical corrugations on the back side of the corrugated core would also have the alternating protrusions 50*a* and indentations 50*b* that are aligned with the alternating protrusions and indentations on the back face of the corrugations so the alternating protrusions and indentations run horizontally across the width of the panel. When the corrugated core is mated with the outer shear panel, as shown in FIG. 9C, the protrusions contact the outer shear panel, and the indentations produce the slots 28 that receive the male end 34*a* of the channel connector 34. As indicated above, the surfaces of the corrugated inside shear panel and corrugated inner core can be attached to each other, with mechanical fasteners 60*a*, adhesive fasteners 60*b* or both, to create a rigid connection between the components.

The insulation material could be made of various materials such as synthetic foams (polyurethane, polystyrene, or polyethylene), various mineral oil based foams, or a variation of plant fiber based products which could be bound through various glues 60*b* or biological adhesion such as natural resins or mushroom based products. Rigid foam inserts could be formed in the same shape as the interior spaces between the panels, matching the corrugation patterns, to create continuous slots 28 so the assemblies can be cut to any width and co-nested with singled side comb shaped channel connectors. The lightweight materials for the wall panel assembly can be installed to create a wall by one or two individuals, depending on the particular size of the panels being installed.

Figure 10A:
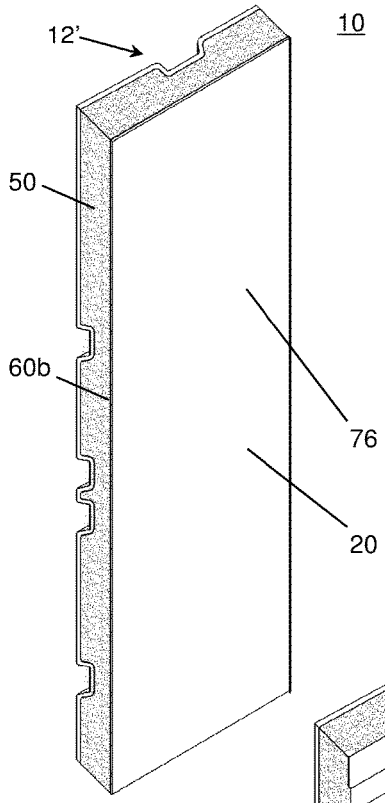
FIGS. 10A-10D are isometric views of alternative variations for the intersecting channel assembly with a structural foam core.
Figure 10B:
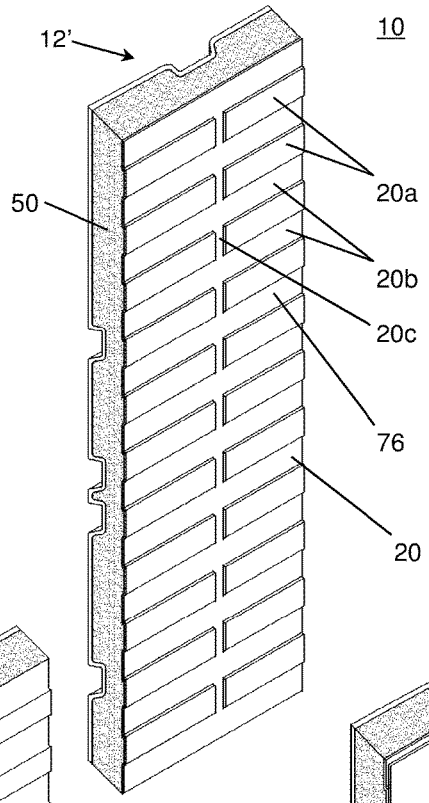
Figure 10C:
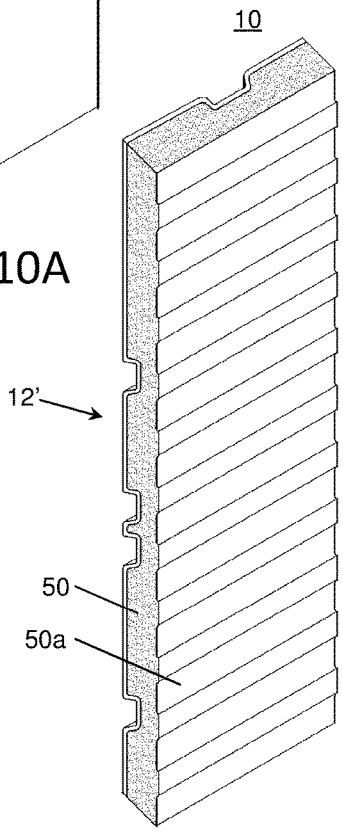
Figure 10D:
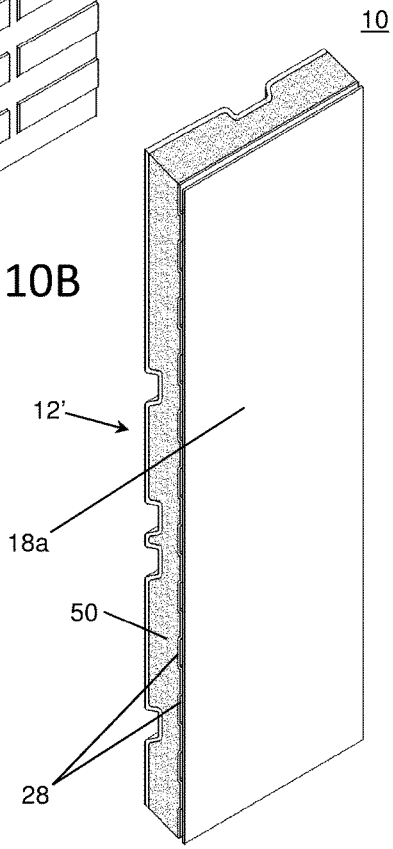

FIGS. 10A-10D show alternative variations of wall panel assemblies that are similar to the assembly described above with reference to FIG. 9, but there is no corrugated core panel between the front facing corrugated panel 12' and the backside panel 20. FIG. 10A has thermal foam insulation 50 adhesively connected with glue 60*b* between two shear layers, with the inner shear panel being corrugated with the horizontal installation channels intersecting the vertical installation channel. FIG. 10B shows the structural foam core 50 molded to the front facing corrugated panel 12'. A backside panel 20 with vertically spaced alternating horizontal protrusions 20*a* and indentations 20*b* and at least one vertical indentation 20*c* that intersects with the horizontal protrusions. The vertical indentation allows for ventilation of condensation in humid environments. As shown in FIG. 10C, the back side of the foam core 50 can also be formed with the alternating protrusions 50*a* and indentations 50*b* that run horizontally across the entire width of the foam core. FIG. 10D shows the additional outer shear panel 18*a* which is clad either directly to the foam core as shown in FIG. 10C or is clad to the backside panel to create the slots 28 for the panel connectors 34.

Figures 11A, 11B:
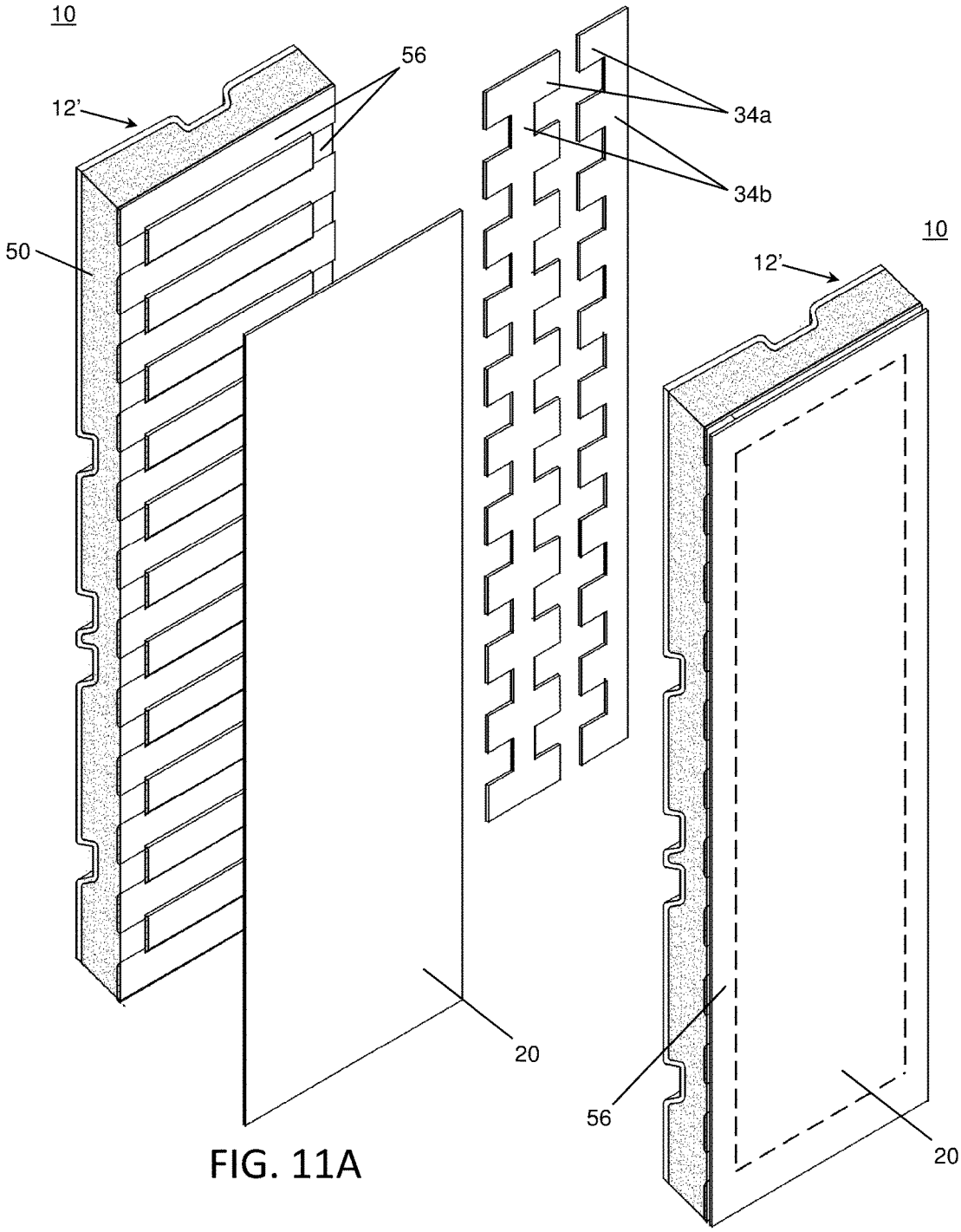
FIG. 11A is an exploded isometric view of another intersecting channel assembly with alternative connectors.
FIG. 11B is an isometric view of the assembled unit shown in FIG. 11A.
Figure 11C:
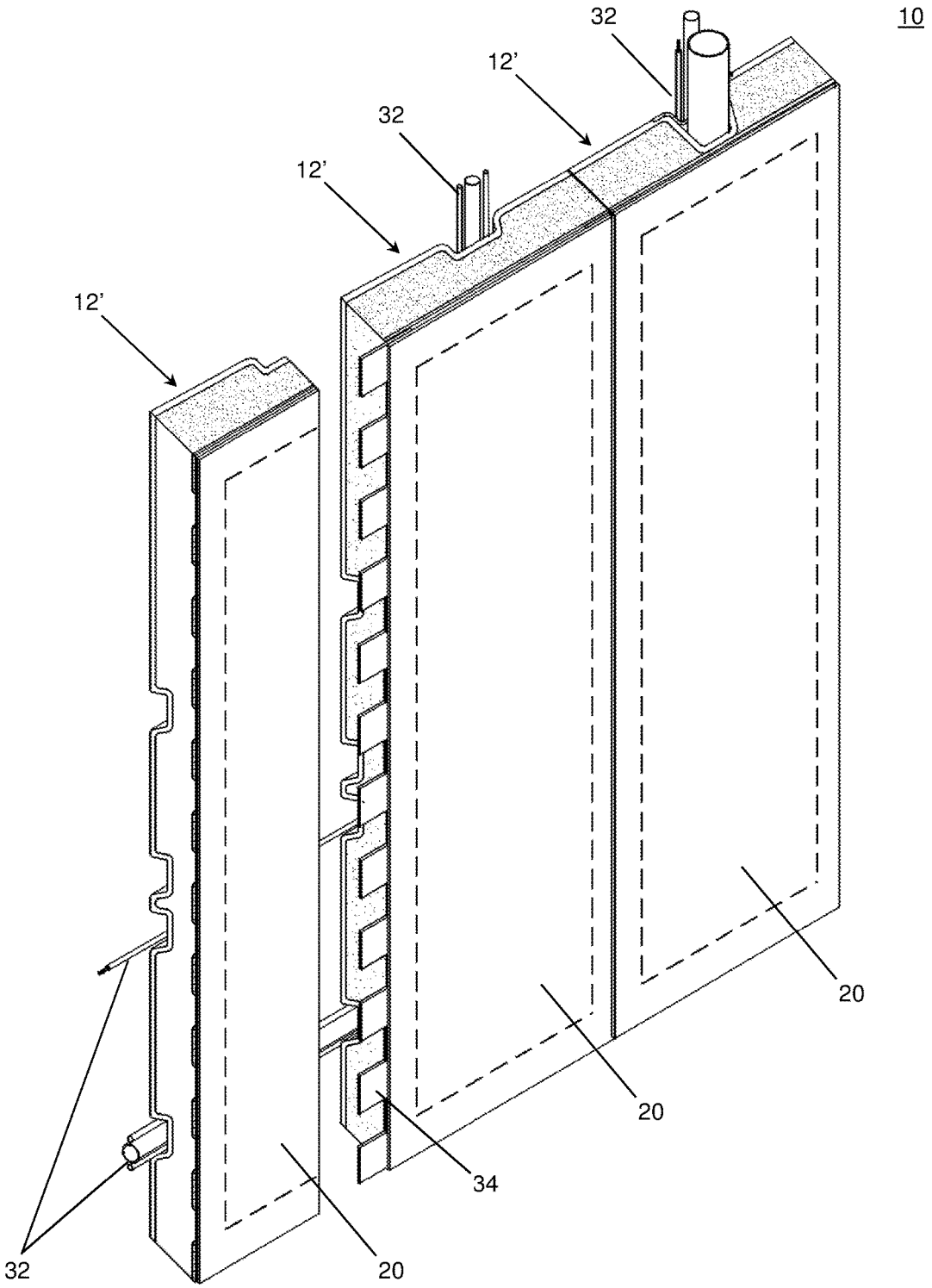
FIG. 11C is an isometric view of installed wall panel assemblies with intersecting channel panels having vertical channels of different depths and a cut wall panel assembly.

The wall panel assemblies shown in FIGS. 11A-11C are similar in construction to the wall panel assemblies shown in FIG. 10. These assemblies are reinforced have rabbets on all four (4) sides to accommodate panel connectors, the top plate, and the bottom plate. As particularly shown in FIGS. 11A and 11B, the rabbet 56 runs along each side of the SIP assembly. The outer rabbet portions of the slots 28 accommodate the spine 34*a* of the panel connectors 34. The connection of adjacent wall panel assemblies, full width and custom cut widths, using panel connectors is shown in FIG. 11C. The drawing shows plumbing and electrical conduits running in the vertical and horizontal installation channels. The slots 28 allow the custom cut assembly to be connected with a channel connector between the adjacent assemblies. The connector's spine fit within the rabbet portion of the assembly, and the connector's teeth project into the slots, allowing a strong and flush butt-joint between the adjacent wall panels assemblies.

Figures 12A, 12C:
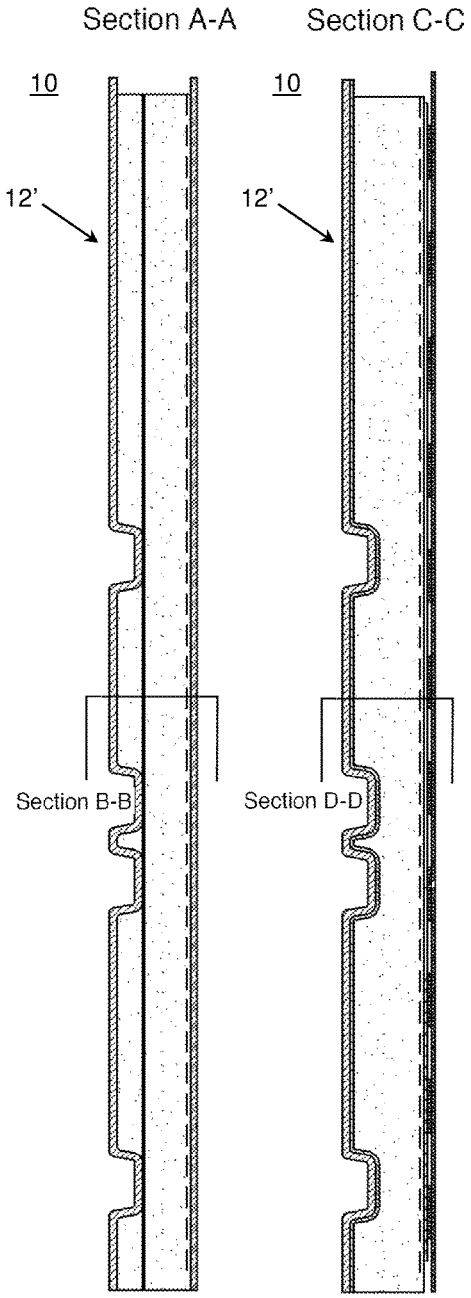
FIGS. 12A and 12C are vertical cross-sections of wall panel assemblies with trapezoidal corrugated core panels having vertical channels of different depths.
Figure 12B:
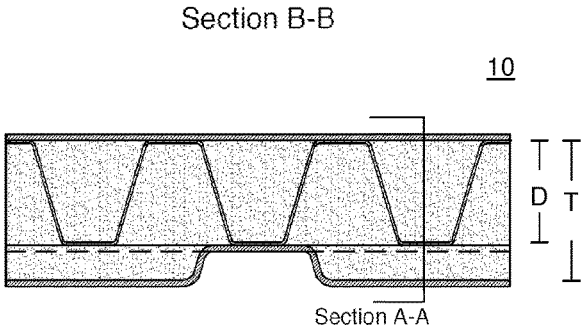
FIGS. 12B and 12D are horizontal cross-sections of the wall panel assemblies shown in FIGS. 12A and 12C, respectively.
Figure 12D:
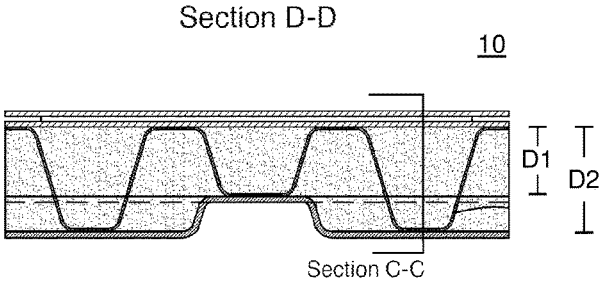

FIGS. 12A and 12C show vertical cross-sections of wall panel assemblies with trapezoidal corrugated core panels having vertical channels of different depths, and FIGS. 12B and 12D respectively show the horizontal cross-sections. As shown in FIGS. 12A and 12B, the corrugated core has multiple corrugations with a uniform pitch and a uniform depth (D), measured from the crest to the trough, that is less than the internal thickness (T) of the wall panel assembly to accommodate the depth of the vertical and horizontal recesses ($d_v$=T−D, $d_h$=T−D) in the front facing corrugated panel 12'. As shown in FIGS. 12C and 12D, the corrugated core has multiple corrugations with a uniform pitch, but the depth (D1) of at least one of the corrugations is preferably shallower than the depths (D2) of the other corrugations. The wall panel assembly shown in FIG. 12C has an outer shear panel with horizontal channels/chambers to accommodate the connectors, a front corrugated panel, and a corrugated core panel that has horizontal channels and the shallow depth corrugation to product the complementary shape to the contour of the recessed horizontal and vertical channels in the front corrugated panel. The complementary shape allows the corrugated core panel and the front corrugated panel to be attached to each other on a much larger surface area than the design with the uniform depth corrugated core as shown in FIG. 12A. The larger surface area and the complementary shape allow for stronger connections with glue or fasteners between the various components to create a more durable composite.

Figure 13A:
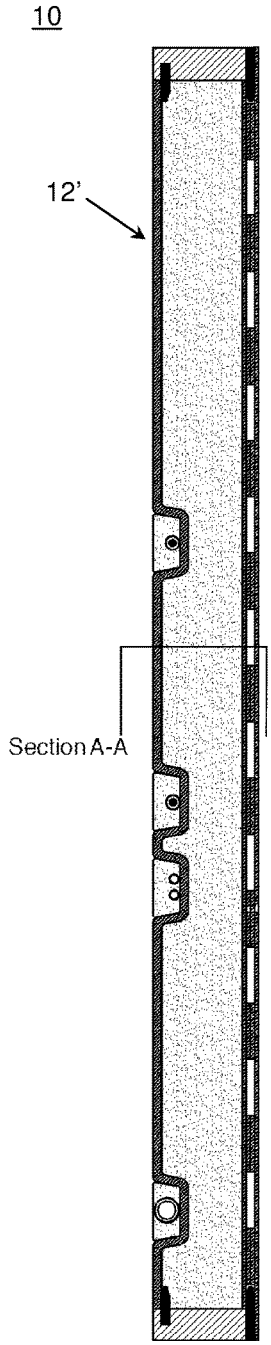
FIG. 13A is a vertical cross-section of a wall panel assembly with conduits in the horizontal channels.
Figure 13B:
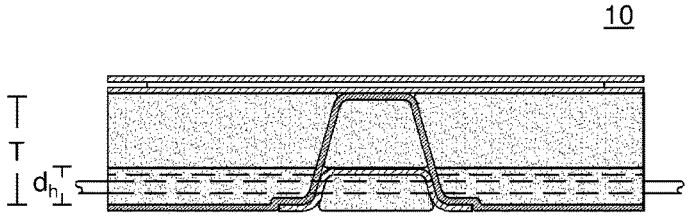
FIGS. 13B-13D are horizontal cross-sections of the wall panel assembly shown in FIG. 13A with alternative installations of conduits and braces in the vertical channel.
Figure 13C:
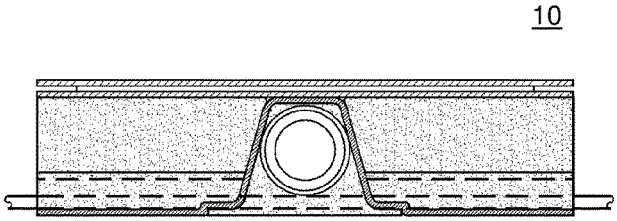
Figure 13D:
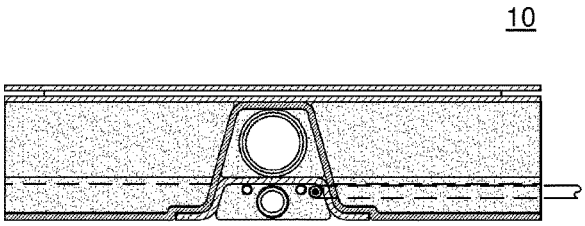
Figure 13F:
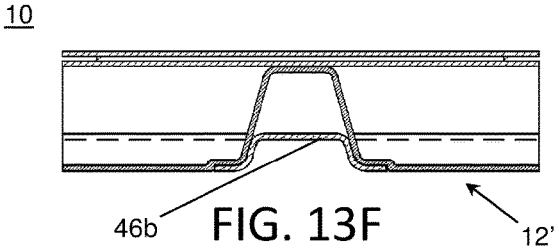
FIGS. 13E and 13F are a front view and a horizontal cross-section, respectively, of the wall panel assembly shown in FIG. 13A.
Figure 13H:
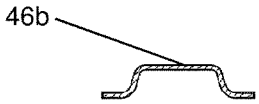
FIGS. 13G-13I are front, top and side views, respectively, of the vertical channel brace shown in FIG. 13E.
Figure 13E:
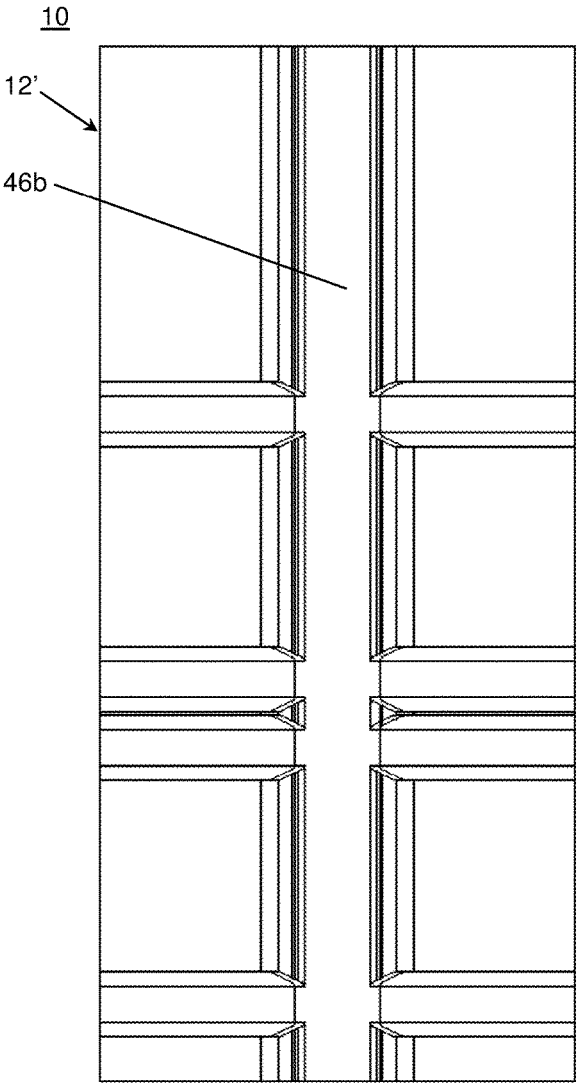

FIGS. 13A-13F show a wall panel assembly in which the front corrugated panel has a deep vertical installation channel ($d_v$) that spans the entire internal depth of the assembly (T), i.e., the vertical channel is equal to the internal thickness of the assembly ($d_v$=T), and is deeper than the depth of the horizontal channels ($d_h$). The deep vertical installation channel allows for space to accommodate larger drain and sewage pipes in the vertical channel. As explained above, the front corrugated panel also has the several horizontal channels which allows the installation of the electrical conduits and components and smaller size plumbing conduits and components, such as freshwater lines and drains for sinks. FIG. 13B shows the assembly with a channel brace and a conduit in the horizontal channel. FIG. 13C shows a variation of the assembly without a channel brace that creates sufficient space to accommodate a large sewage pipe in the vertical installation channel and to also accommodate an electrical conduit in the horizontal channel in front of the sewage pipe. FIG. 13D shows another variation of the assembly with a stacked vertical installation of a smaller size sewage line behind a channel brace and additional electrical conduits and smaller plumbing conduits in front of the channel brace. FIGS. 13E and 13F are a front view and horizontal cross-section, respectively, of the front corrugated panel with the channel brace installed.

Figures 13G, 13I:
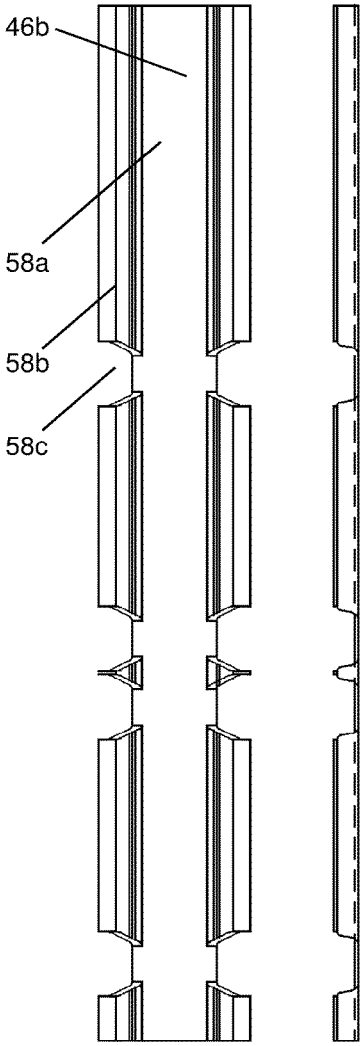

The channel brace 46*b* is shown in FIGS. 13G, 13H, and 13I. The channel brace spans the width and height of the vertical channel. The channel brace has a recessed center section 58*a* between wings 58*b* projecting from the sides of the channel brace. The wings contact the sloping sidewalls of the vertical channel and the center section is recessed from the wings by a depth that is equal to the depth of the horizontal channels. The wings also have cutout sections 58*c* at each intersection between the horizontal channels and the vertical channel.

Figure 14A:
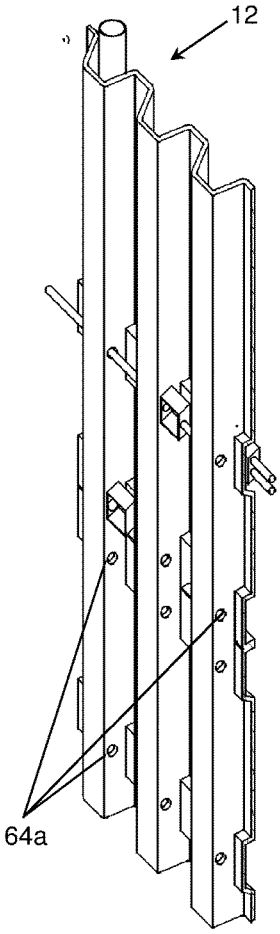
FIGS. 14A and 14B are back and front perspective views, respectively, of the trapezoidal corrugated core panels with conduits on both sides.
Figure 14B:
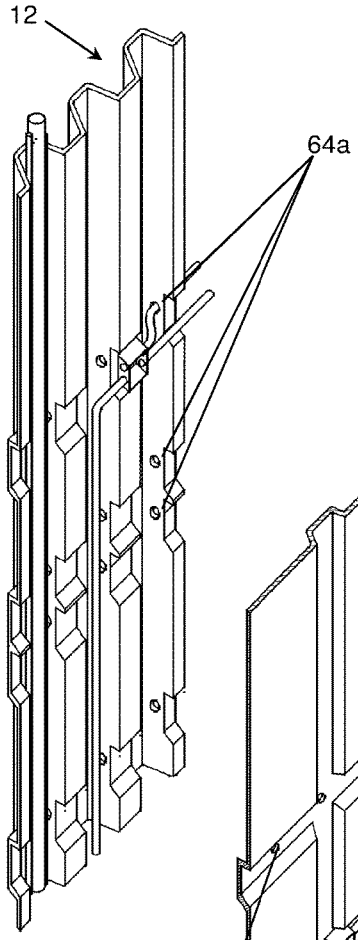

The back and front views of the corrugated core panel 12 are shown in FIGS. 14A and 14B, respectively. The panel has apertures 64*a* in the sidewalls of the vertical channels. The apertures allow conduits to be fed from one side of the panel to the other side of the panel allowing for the installation of opposite facing components, such as junction boxes (j-box) on the backside of the horizontal installation channels. As explained above, components on opposite sides of the wall is beneficial for interior walls, providing easy access to install plumbing and electrical on either side of the wall. The illustrations show various installations of plumbing and electrical conduits with a j-box and show an electrical conduit fed through a hole 64*a* from the front of the panel to the backside of the panel.

Figure 14C:
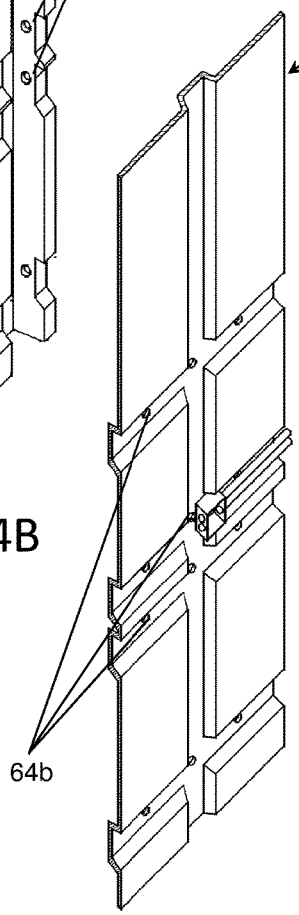
FIGS. 14C and 14D are front perspective views of an intersecting channel panel by itself and in a wall panel assembly with a trapezoidal corrugated core panel.
Figure 14D:
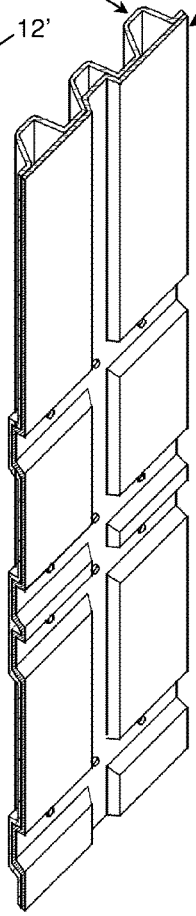
Figure 14E:
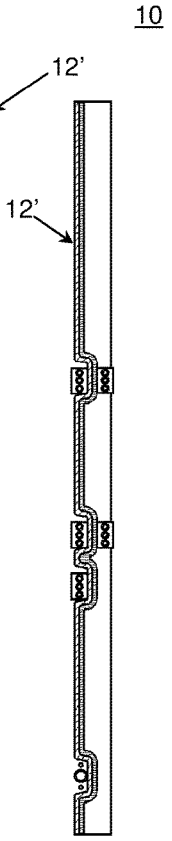
FIG. 14E is a vertical cross-section of the wall panel assembly with the intersecting channel panel mated with the trapezoidal corrugated core panel.

FIG. 14C shows the front face of a front facing corrugated panel 12' that has horizontal installation channels recessed from the front face by the same depth as the vertical installation channel. In the front corrugated panel, apertures or other cut-outs 64*b* are made in the solid bottom of the channels. The holes allow electrical and/or plumbing lines to pass through the panel between the front and back faces. By reducing the number of vertical channels, the area of the planar vertical surfaces is enlarged which increases shear resistance. As explained above and shown in FIGS. 14D and 14E, the corrugated core panel and the corrugated inner shear panel have complementary horizontal and vertical channels and are glued to each other or otherwise attached to each other. The use of the front corrugated panel with the corrugated core panel increases the surface area for a much more flexible installation and sturdier attachment of wall hung objects, such as cabinets, rails, curtains, and art work as compared to conventional stick framing which limit sturdy connections to those locations where a fastener is placed in a wall stud (usually only found every 16"). With the larger surface area for installations, fasteners can be screwed into a solid plant fiber based panel instead of less sturdy drywall with an empty space in the wall or wall studs that are only located only at distinct positions along the wall.

Figures 15A, 15B, 15C, 15D, 15E, 15F:
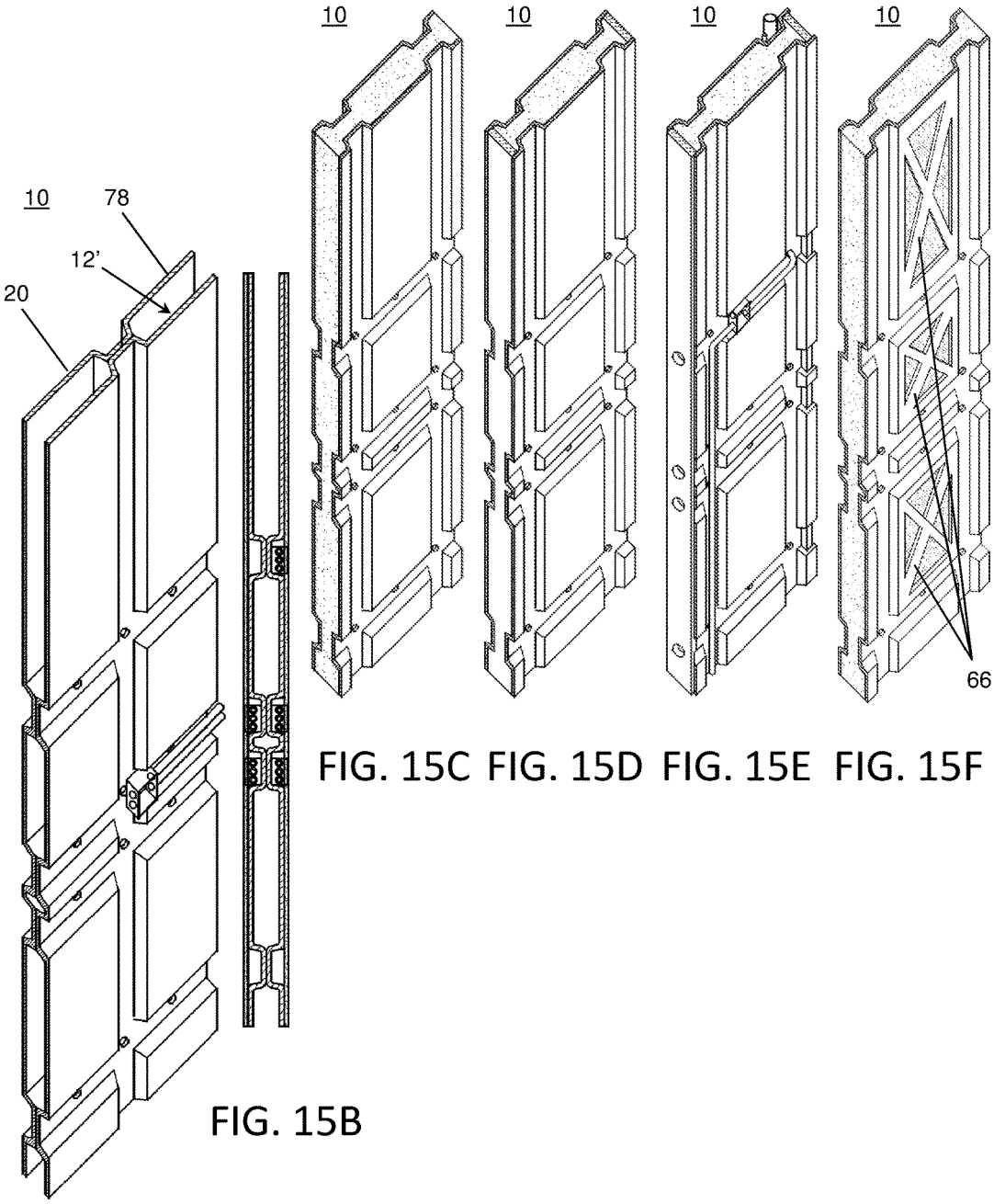
FIGS. 15A and 15B are a perspective view and a vertical cross-section, respectively, of a wall panel assembly with symmetric back to back intersecting channel panels.
FIGS. 15C-15F are perspective views of wall panel assemblies with alternative symmetric back to back intersecting channel panels.

As indicated above, double-sided corrugated cores could be formed with symmetric corrugated panels that mirror each other. Examples of symmetric mirroring corrugated panels are shown in FIGS. 15A-15F and 16A-16D. FIGS. 15A and 15B respectively show a perspective view and vertical cross-section of back to back corrugated front panels that symmetrically mirror each other. Similar to the complementary back to back corrugated panels described above, the symmetrically mirroring corrugated panels include holes in the panels to allow for the conduits to be threaded from one side of the wall to the other side of the wall. FIG. 15B also shows wallboard sheathing 42 on both sides of the sandwiched wall panel assembly.

The wall panel assembly shown in FIG. 15A has a single vertical channel on each side of the assembly, and the back to back panels contact each other directs. As evident from FIGS. 15C-15F, the panels do not need to be directly attached to each other and can be connected through a sandwiched center, such as a structural insulation core or a corrugation core. Additionally, the panels can have multiple vertical channels. As shown in FIG. 15D, a vertical structural member, e.g. a wood stud can be milled to match the contour between the back to back panels. The stud is sandwiched in between panels to create an even sturdier shear wall assembly. The contoured stud allows the conduits to span adjacent assemblies in the horizontal installation channels without making any onsite modifications to the assembly. Alternatively, as shown in FIG. 15E, a standard framing stud can be used by notching the short sides of the wall panel to fit the stud. The stud shows additional holes that allow for the conduits to span adjacent assemblies in the horizontal installation channels. In this embodiment, the stud on one side of the panel protrudes half way past the edge of the panel to provide an attachment point for the next panel. On the opposite side of the protruding stud, another stud is set back half of its thickness into the panel to accommodate space for the protruding stud of the next adjacent panel to enter this opening and provide a strong connection between the different panels. FIG. 15F shows a wall panel with additional cutouts in the large vertical surfaces of the corrugated inside shear panel. The cutouts reduce the weight and amount of material required and are preferably in the form of a planar truss structure 66 to provide structural support in the vertical surfaces.

Figure 16A:
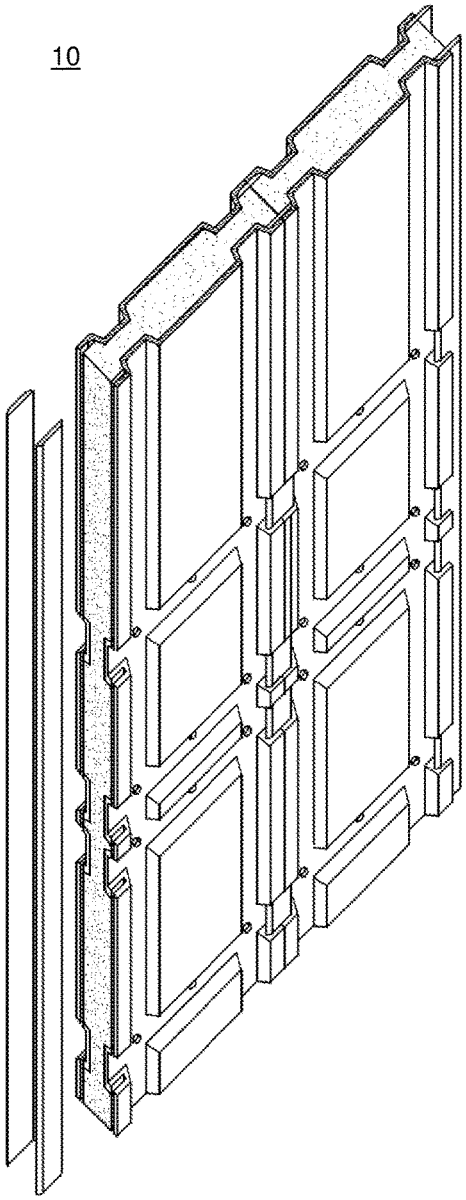
FIGS. 16A-16D perspective views of wall panel assemblies with alternative connectors between the assemblies.
Figure 16B:
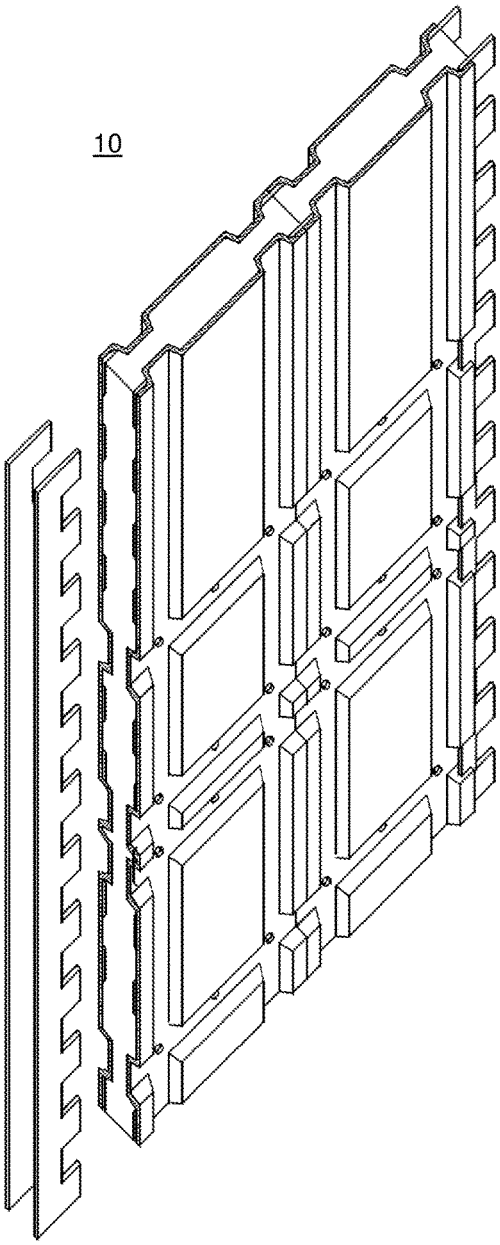
Figure 16C:
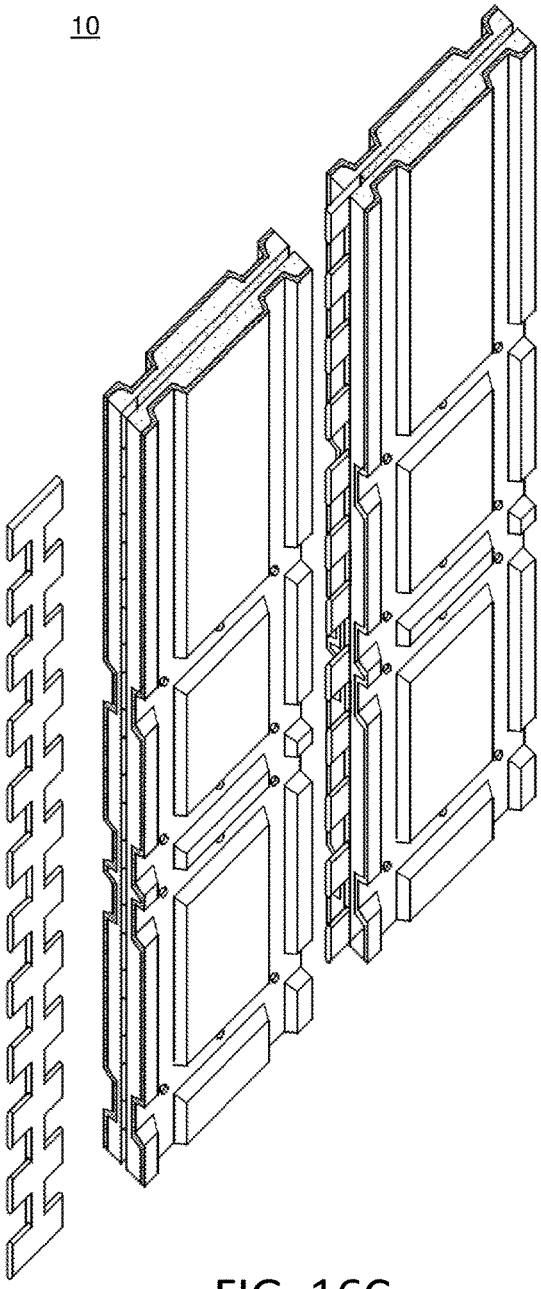
Figure 16D:
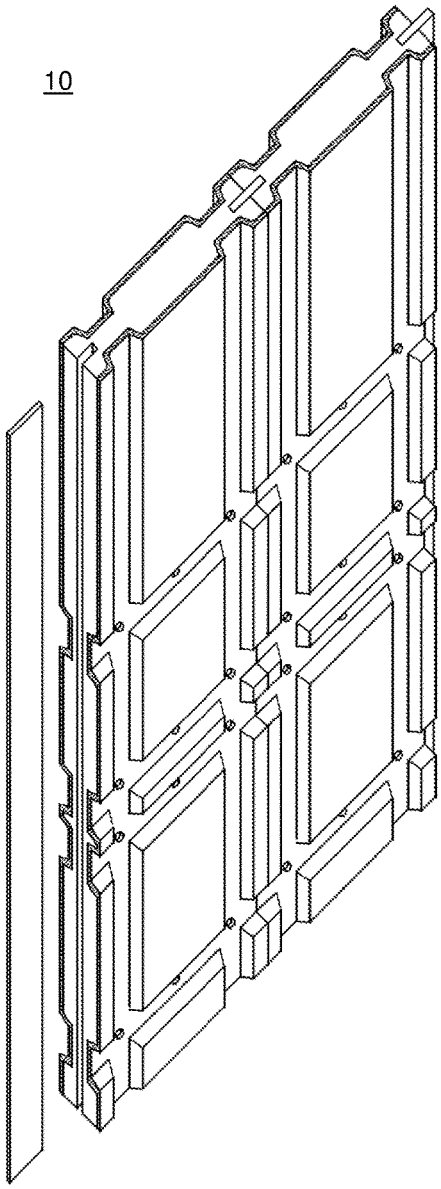

FIGS. 16A-16D show the connection of various wall panel assemblies. FIG. 16A shows two adjacent panels connected to each other using a pair of wood strips inserted into respective slots between the structural foam core and the front corrugated panels. FIG. 16B shows the teeth of a pair of the comb-shaped connectors inserted into the slots which provides a more precise connection between the assemblies. FIG. 16C has back to back structural foam cores with a rabbet on the end as shown in FIG. 11A which produces horizontal chambers corresponding to the shape of the comb-shaped channel connectors and which allows one of the adjacent assemblies to be custom cut to any width and connected by the channel connector to the uncut adjacent assembly. FIG. 16D shows wood strips inserted in rabbet slots of adjacent wall panel assemblies. If a full width and a custom cut wall panel assembly are joined, an additional vertical slot can be cut into the cut side of custom cut assembly.

Double-sided corrugated cores could also be formed with front corrugated panels that mirror each other asymmetrically, such as shown in FIGS. 17 and 18. In FIGS. 17A-17J, a double-sided corrugated core has some vertical installation channels with the same depth as the horizontal installation channel and also has a deep vertical installation channel with a depth that extends the internal depth of the wall panel assembly. In FIGS. 18A-18E, a double-sided corrugated core also has some vertical installation channels with the same depth as the horizontal installation channel and also has a vertical installation channel that is deeper than the horizontal channels, but the depth of the deeper vertical channel only extends to the recessed horizontal channels in the opposite panel. Since these configurations allow for components on opposite sides of the wall, they are well suited for interior walls.

Figure 17A:
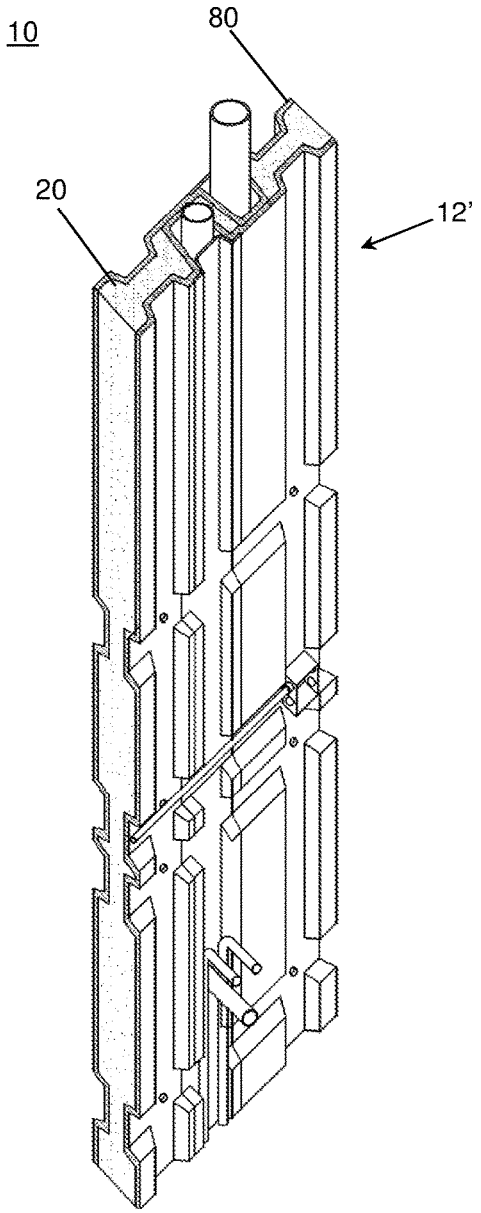
FIGS. 17A and 17C are perspective views of wall panel assemblies with mirroring asymmetric intersecting channel panels having deep channels.

The deeper vertical channels create sufficient space to install larger size drainage pipes inside the wall, especially the vertical channels having the full depth of the assembly as shown in FIG. 17A. The deep channel is preferably placed off center so that the panel can be flipped around its vertical axis and used as the counterpart on the opposite side (i.e., asymmetric mirroring) to create the wall panel assembly. This construction allows for a structurally sound connection between both panels without the need of a structural foam core, although insulation material may still be used if desired for a particular application. The outer facing surfaces of the full-depth vertical channels have horizontal recesses or cutouts at the locations of and corresponding in shape to the backside of the horizontal channels of the opposite panel, and the horizontal channels of the opposite panel fit inside these recesses or cut-outs. The recesses or cut-outs are made in such way that both panels can be stacked back to back onto each other. The intersection allows creates a large planar vertical area where both panels touch and can be connected with each other creating a strong structural connection between both back to back inner shear panels.

Figure 17C:
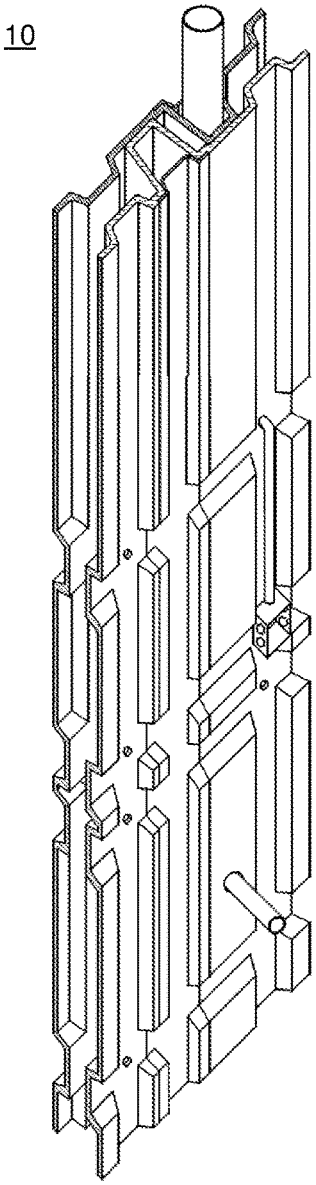
Figure 17B:
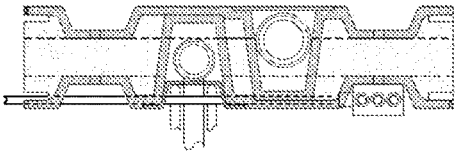
FIGS. 17B and 17D are top views of the wall panel assemblies in FIGS. 17A and 17C, respectively, with deep mirroring asymmetric intersecting channel panels.

FIG. 17B shows a top view of the wall panel assembly in FIG. 17A, showing the alternating depth of the vertical channels of both panels. The entire wall panels form an isolated core. The assembly shows the installation of electrical components and an electrical conduit running through the horizontal installation channels. Additionally, a large drain pipe is installed inside one of the deep vertical channels which is covered with a bracket, such as a strip of wood, and a smaller diameter drain pipe is installed in the other large vertical channel covered with a channel brace to create a mounting surface for various plumbing lines located in the bottom part of the wall panels. As evident, the lip of the j-box extends outwardly from the front surface of the panel into a cutout in the wallboard that covers the panels.

Figure 17D:
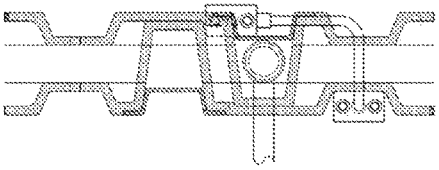
Figure 17E:
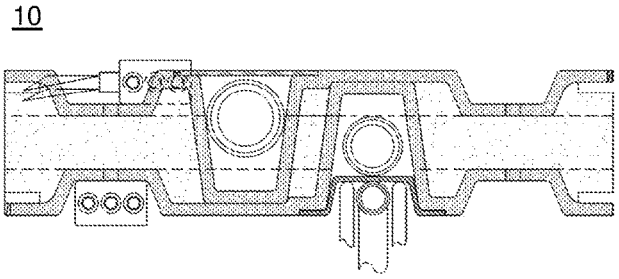
FIGS. 17E and 17F are top views of representative wall panel assemblies with deep mirroring asymmetric intersecting channel panels.
Figure 17F:
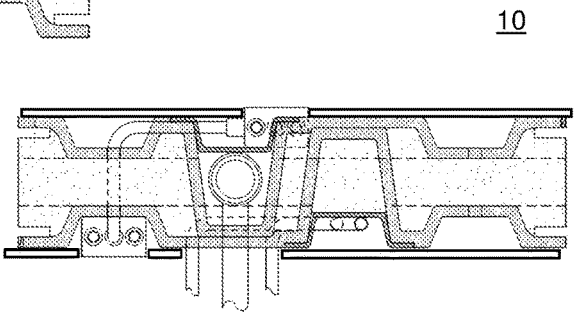
Figure 17G:
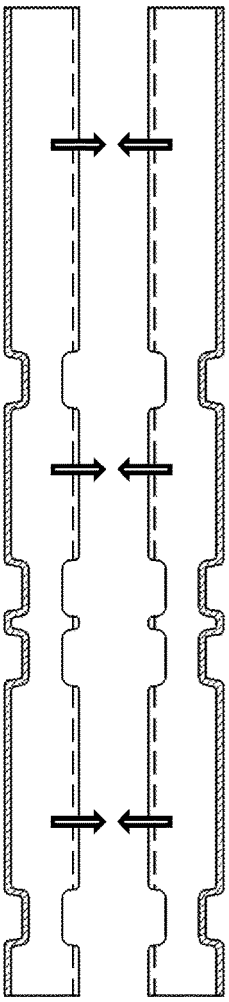
FIGS. 17G and 17H are side views of mirroring asymmetric intersecting channel panels with deep vertical channels.
Figure 17H:
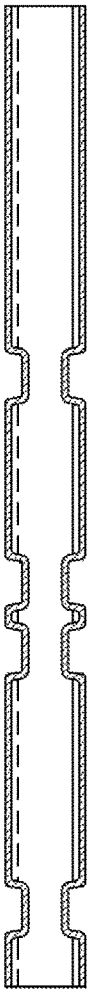
Figure 17I:
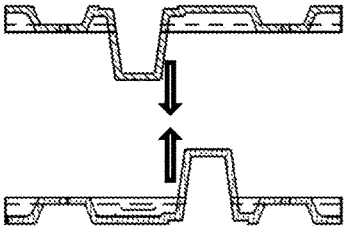
FIGS. 17I and 17J are top views of mirroring asymmetric intersecting channel panels with deep vertical channels.
Figure 17J:
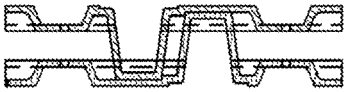

FIG. 17C has the same configuration of panels as in FIG. 17A, but it does not have any insulation between the panels. This embodiment shows the installation of electrical j-boxes on opposite sides of the wall panel assembly with an electrical conduit fed from one side to the opposite side of the panel through apertures in the panels. This embodiment also shows a plumbing conduit fed through a custom cut hole in the deep vertical channel. FIG. 17D shows a top view of the wall panel assembly in FIG. 17C, showing how the electrical conduit is led from one side of the panel through the center to the opposite side of the panel and how the drain pipe is fed through the custom cut hole in the deep vertical channel and through the vertical surface in the opposite panel. The side views in FIGS. 17G, 17H, 18B, and 18C and the top views in FIGS. 17I, 17J, 18D, and 18E show how the panels overlap with their mirroring asymmetric designs.

Figure 19A:
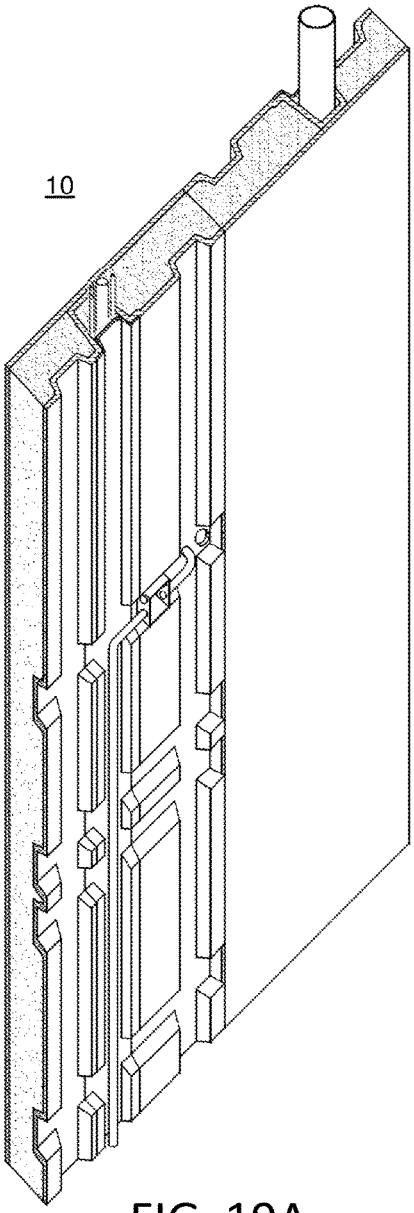
FIGS. 19A and 19B are perspective views of non-mirroring asymmetric wall panel assemblies facing in different directions.
Figure 19B:
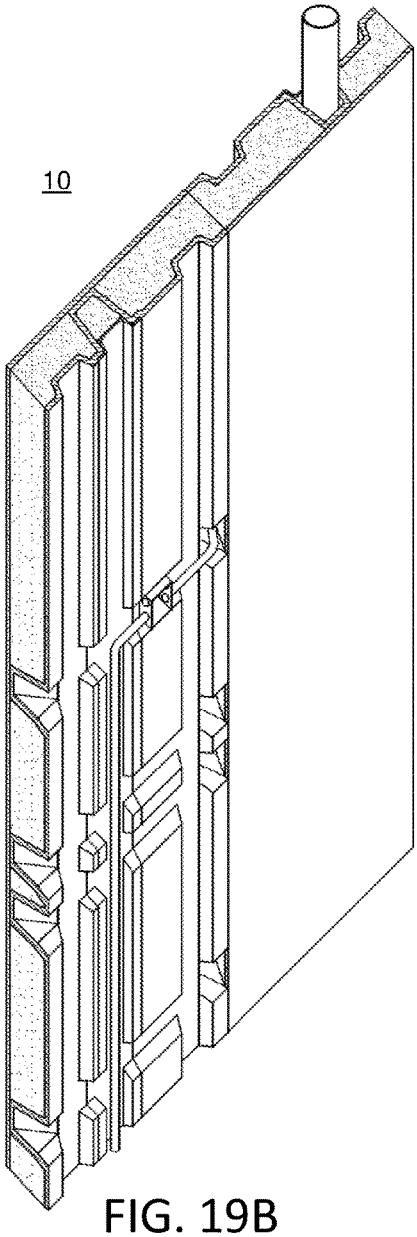
Figure 19C:
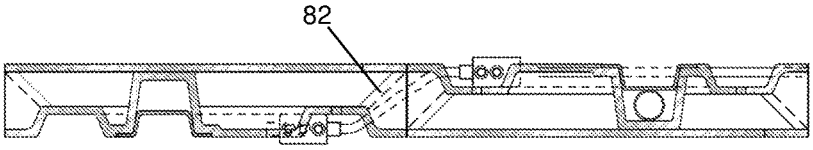
FIG. 19C is a horizontal cross-section of the wall panel assembly in FIG. 19B.

The non-mirroring asymmetric wall panel assemblies shown in FIG. 19 also allow for components to be installed on opposite sides of the wall so they are also well suited for interior walls. However, these wall panel assemblies alternate the side of the wall to which the horizontal and vertical channels open. As shown in FIGS. 19A and 19B, two (2) adjacent wall panel assemblies are placed with the channels opening to different sides of the wall. In the configuration shown in FIG. 19A, to connect the horizontal installation channels on one side with the horizontal installation channels on the other side, a hole can be cut in the assembly between the channels. In the configuration shown in FIG. 19B, the vertical back part of the beginning and end section of the each horizontal installation channel is angled towards the inside surface of the outer shear panel creating a diagonal passage 82 from the front side towards the backside of each panel, allowing for an easy transition of electrical and plumbing conduits between the alternating assemblies. The horizontal cross-section of the assembly of FIG. 19B, shown in FIG. 19C, shows an electrical conduit passing through the diagonal passage from front face of one assembly to the front face of the other alternating assembly.

Figure 20A:
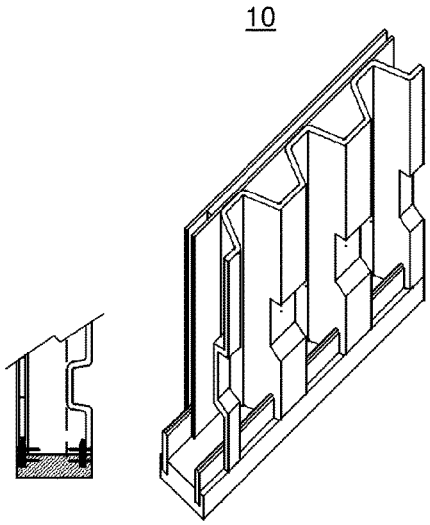
FIGS. 20A-20C are detail perspective views and corresponding vertical cross-sections of wall panel assemblies mounted to a bottom plate.
Figure 20B:
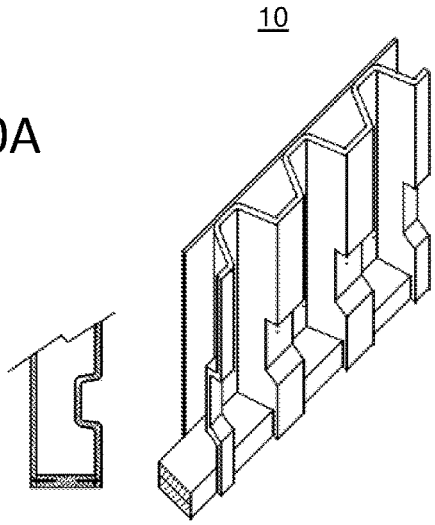
Figure 20C:
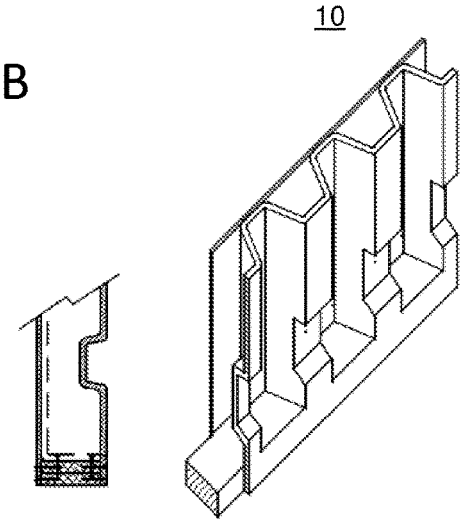

FIGS. 20A, 20B, and 20C show how the various panels are connected to a bottom plate. In FIG. 20A, the bottom plate has two (2) rails projecting up into the wall panel which fit into matching slots running parallel to the short side on the inside and the outside of the wall panel. The bottom plate and the wall panel would be nailed, screwed, stapled or bolted through the corrugated core/the outer shear panel into the matching rail. In FIG. 20B, a standard size framing stud without any rails is used for the same purpose. The corrugated core is notched on the bottom to match the contour of the bottom plate. In FIG. 20C, the bottom portion of the corrugated core is formed in such a way that it creates a nailing surface parallel to the top of the bottom plate and the turn 90° towards to run parallel to the side of the bottom plate. This allows the corrugated core to be attached to the bottom plate both vertically and horizontally.

Figure 21:
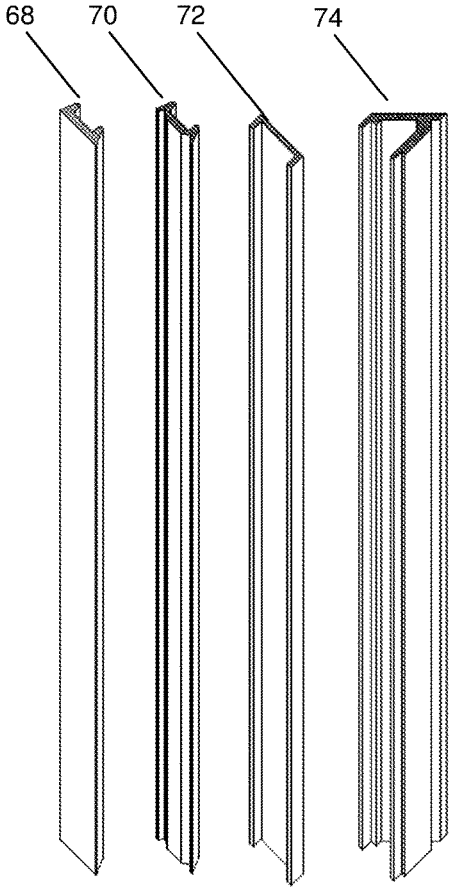
FIG. 21 is a perspective view of various wall panel connectors.

FIG. 21 shows various connectors. A U-shaped channel bridge 68 is inserted into the vertical installation channels in such way that the two (2) legs face the side of the vertical channel and the long side of the channel bridge creates a flat surface parallel to the interior side of the inside shear panel. This channel bridge is used to create a strong connection with perpendicular wall panels. An alternative bridge 70 has two (2) angled, recessed vertical surfaces which allow the placement of mechanical connectors, like screws or nails at an angle to create a strong structural bond between the wall panel and the channel bridge. This alternative bridge avoids nail or screw heads from protruding past the inside surface of the wall panel, which would result in an interference with connecting parts and imprecise installation. A U-shaped extrusion 72, or end connector, is used to connect perpendicular wall panels with each other. The flat side of the U-shaped end connector is mechanically fastened to the wall panel perpendicular to the next wall panel, with the legs face the short side of the next panel. The U shaped extrusions or legs are inserted into the matching vertical slots found on the short side of the perpendicular wall panels and nailed or screwed to the perpendicular wall panel. A V-shaped extrusion 74, such as a 45° connector, can be used connect wall panels to each other in a 45° angle (or other angle corresponding with the connector angle). The long flat side of the extrusion is attached to the adjacent wall, with the parallel protrusions or legs protruding outwards 45° away from the standing wall. The wall panel that is to be connected to the 45° connector features two vertical slots on the short side of the panels, corresponding in shape to the two parallel protrusions on the 45° connector. The wall panel is slipped over the two parallel protrusions of the 45° connector and is mechanical fastened to the 45° connector.

Figure 22:
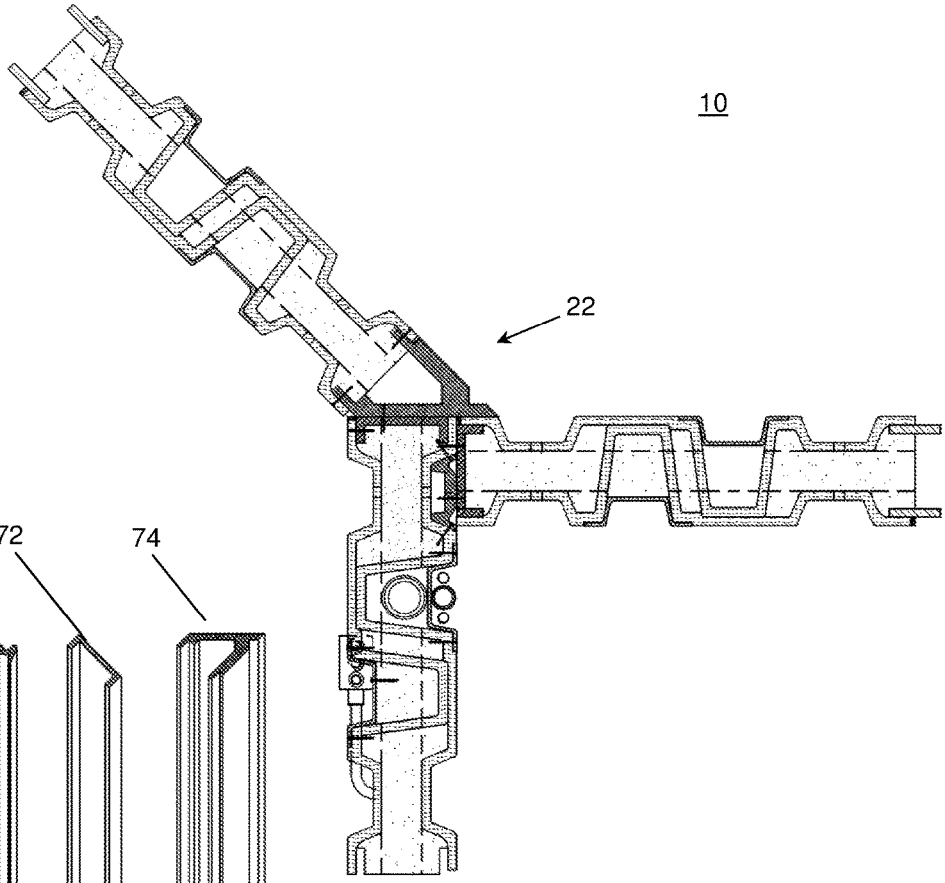
FIG. 22 is a horizontal cross-section through a corner of a wall panel assembly with varying wall angles.

FIG. 22 shows an assembly of various wall panels at different angles. The channel brace, channel bridge, end connector and 45° connector connected the adjacent wall panel assemblies. The connectors are mechanically connected using nails in the particular example.

Another aspect of the wall panel described herein is a perimeter frame 86 around the perimeter edge 92 of the wall panel. As shown in FIG. 23, the perimeter frame is made up of a pair of side frames 86*a* and 86*b* extending from the side ends of the panel and has a depth 94 that is at least equal to the depth of the horizontal channels and in the preferred embodiment has a longitudinal axis that is perpendicular to the front face of the panels. In operation, the wall panels described above are generally installed between traditional studs with FIG. 8A depicting a portion of a prefabricated wall segment connected to standard stud house framing. However, traditional studs and the panel connectors described herein are replaced when a perimeter frame is integrated with the wall panel and multiple panel sections can be connected without necessarily having separate studs or connector pieces.

Figure 23A:
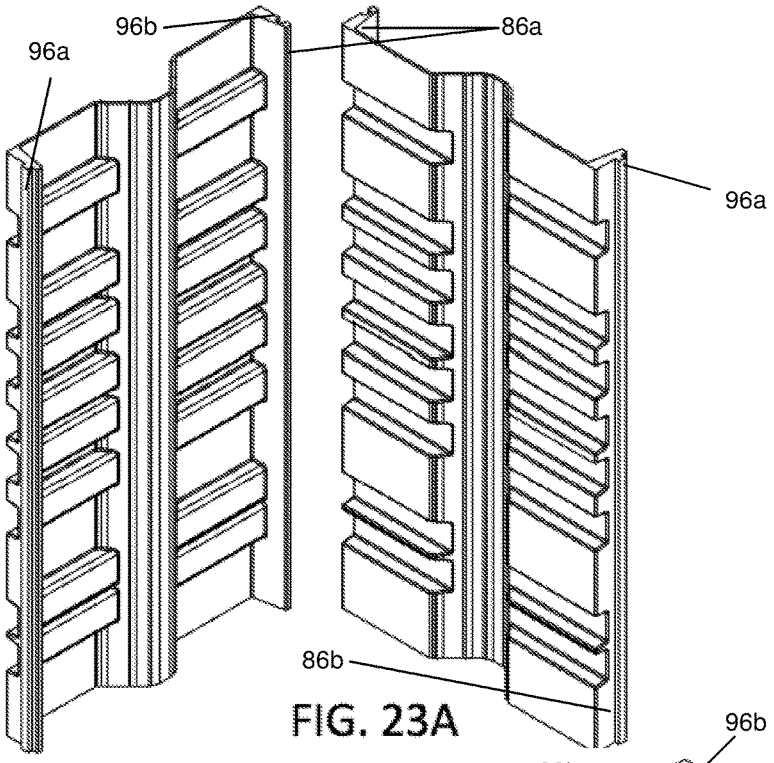
FIGS. 23A-23W are a perspective views of alternative corrugated panels with various side and perimeter frames.

The perimeter frame is located around the periphery of the panels and may have both vertical and horizontal frame sections. The horizontal frames form a top frame 86*c* extending from the topside and a bottom frame 86*d* extending from the bottom side of the panel parallel to the horizontal channels and in the preferred embodiment span between the sides of the panel. The vertical side frames extend from and span the length of the side ends between the top and bottom of the panel and are parallel to the vertical channels. In the preferred embodiment a panel has a full perimeter frame with a pair of side frames on each side and a pair of horizontal frames on the top and bottom. Alternatively, the wall panel may have less than a full perimeter frame, for example when only side frames are used to connect a pair of adjacent wall panels as shown in FIG. 23A. The perimeter frame of the wall panels extend a frame distance to a frame depth from the perimeter of the panels and are preferably angled 90° from the front face of the panel. Additionally, the frame depth is preferably equal to the depth of the vertical channel but may vary. For example, when a perimeter frame is used with a corrugated panel assembly having a backside the perimeter frame has a depth necessarily greater than the depth of the vertical channel considering the perimeter frame connects the panel and the backside as described below. Further, the 90° bend allows a user to butt two panels together and attach a first panel to a second panel by the use of mechanical fasteners without using any other separate stud or connector.

To provide sufficient structural support to adequately replace traditional studs or panel connectors, the frames have a thickness 90 that is at least as thick as the panel thickness and in the preferred embodiment is 50% thicker than the panel thickness, although in some cases, the increased panel thickness may only need to be approximately 10%. The thickness provides a sturdier connection between two adjacent panels and allows the panels to be attached together or to an existing wall or structure without the need of installing a separated stud or support. Where this thickened frame is running around the entire perimeter of the panel, creating a solid perimeter frame around the panel, the frame defines both vertical studs and horizontal plates that connect the panel to other panels, structures, floors and ceilings. Additionally, the perimeter frame is preferably molded with the panel and thereby the panels can be assembled and installed without additional supports. However, the perimeter frame can also be created by attaching a solid member, either molded out of the same or similar material as the corrugated core, milled out of solid lumber or made of other suitable materials. It will also be appreciated that the frame portions preferably include a taper 87 on the side facing the vertical channel to accommodate a draft angle that gets narrower towards the end of the frame portion and helps remove the part from the mold, resulting in a variation in the thickness.

Figure 35:
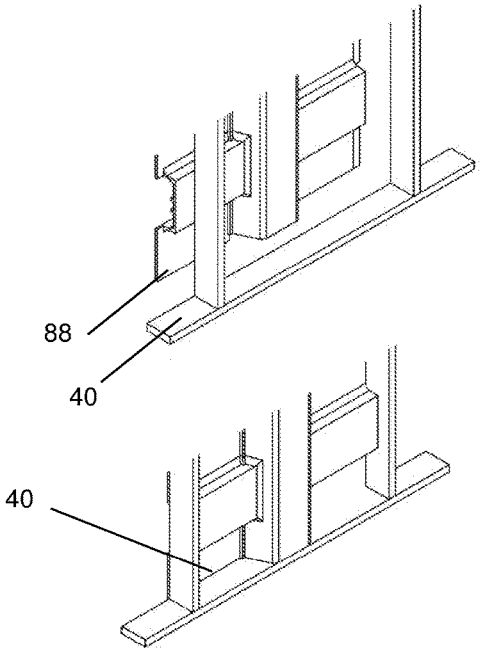
Figure 37A:
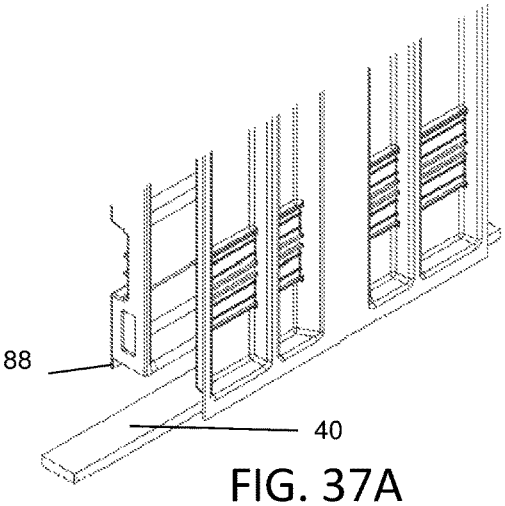
Figure 37B:
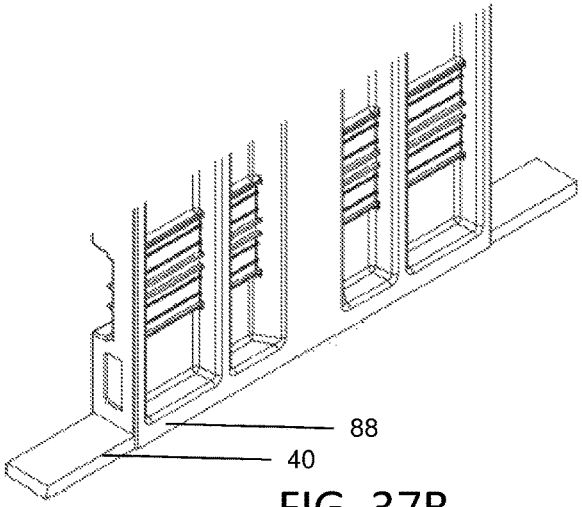
Figure 38A:
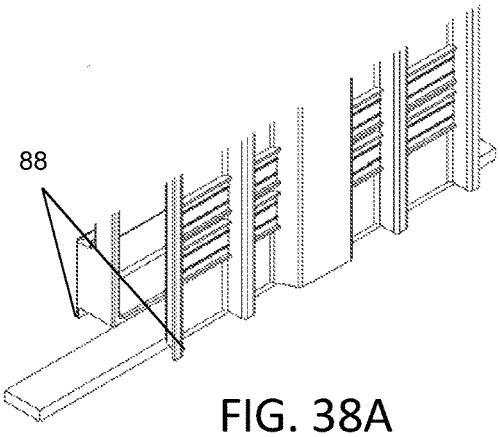
Figure 38B:
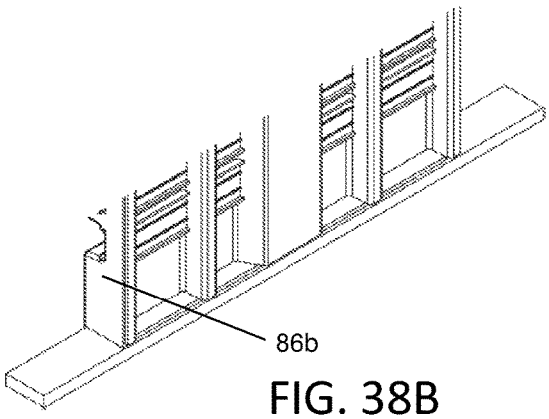
Figure 39:
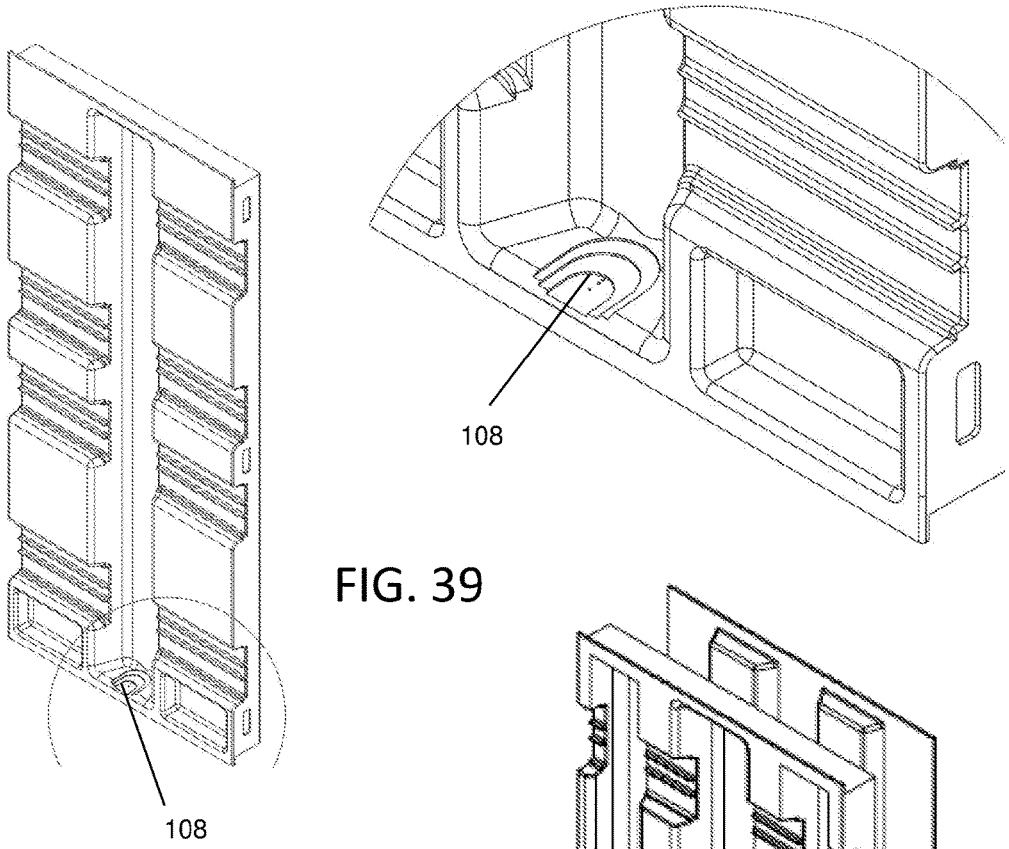

In an alternative perimeter embodiment the side frames may have an angle greater than or less than 90° to facilitate various connection angles between the panels. For example, it may be desirable to have a vertical side frame angled more than 90° from the side end of the panel in order to connect another panel thereto at an angle greater than 90°, such as the connection angle shown in FIG. 22. In another alternative embodiment the frame may be within the same plane as the front face of the panel, such as shown in FIG. 23C. In such a case, the horizontal frame sections define flanges 88 along the top and bottom side of the panel which respectively connect to the top and bottom plates described herein. Accordingly, the panel with a thickened frame is set around the periphery of the panel and the perimeter flange protrudes past the bottom and top sides of the panel with the thickened frame attaching the panel assembly to the plates. Once assembled, the flange rests against the top plate 38 or bottom plate 40 as shown in FIG. 35. Similar variations can also be seen in FIGS. 37 and 38.

Another aspect of the thickened perimeter frame is it use in a panel assembly having a corrugated panel and at least one backside panel 20 separated by an interior space. As described above the backside panel may be a shear panel, a backside flat panel, a backside corrugated panel symmetrically mirroring the corrugated panel, a backside corrugated panel asymmetrically mirroring the corrugated panel, a sandwiched corrugated panel, a relief panel or any combination thereof. In any case, the vertical side frames extend from the periphery of the corrugated panel and connect the corrugated panel to the backside panel. Additionally, the corrugated panel may also have horizontal top and bottom frames that connect the corrugated panel to the backside panel. In such an assembly the necessity for a stud is eliminated as the vertical and horizontal edges within each panel can be attached to one another by the perimeter edges, which form the flush butt-joint between the adjacent wall panel assemblies.

In another embodiment the vertical sides and horizontal top and bottom frame also feature a tongue 96*a* and groove 96*b* connection for more secured connecting adjacent panels. In this embodiment one of the side frames has a protrusion extending away from the side of the panel and the opposite side frame has indentations corresponding with the protrusions. Accordingly, the protrusions of one panel can be inserted into the indentations of another panel to form a male-female connection between adjacent panels. Thus, panels having perimeter frames with corresponding protrusions and indentations allow the panels to be connected with a sturdier vertical alignment and a stronger panel to panel connection.

Figure 36A:
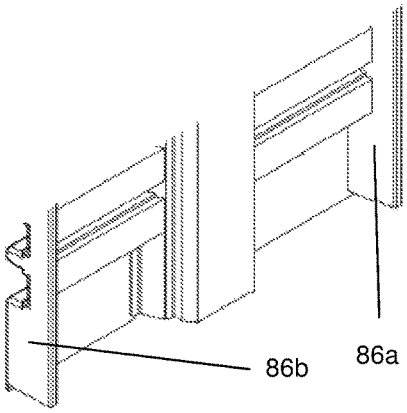
Figure 36B:
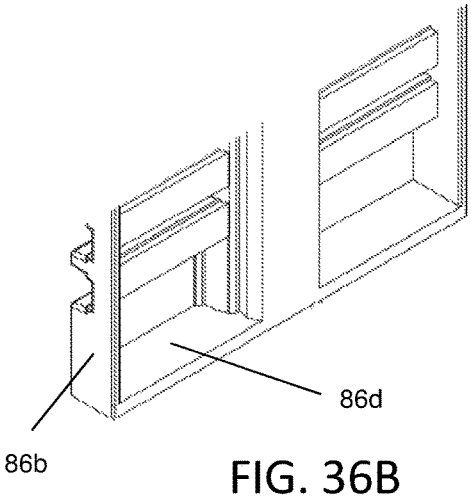

Detail views of the perimeter frame can be seen in FIGS. 36A and 36B, respectively. Accordingly, a bottom corner detail view of the corrugated interior panel with a thickened 90° vertical is seen in FIG. 36A without top and bottom frame. Subsequently, both a pair of side frames, top frame and bottom frame are shown in FIG. 36B. In addition to these detail views of variations of the corrugated wall panel having at least one thickened perimeter frame are shown in FIG. 23. In particular, FIG. 23A depicts a thickened side frame perpendicular to the front face on both the top side ends of the panel. Additionally, the vertical perimeter is conformed to mimic the shape of the horizontal channels recessed from the front face of the panel. In operation, such a panel would be mounted adjacent to another panel having the same horizontal channels and thus the contoured perimeter does not prevent conduits from being run through the horizontal channel is described herein. In another aspect of the perimeter it replaces the need of a user to produce or modify traditional studs, for example cutting holes in the studs to allow the passing of electrical wires or other conduits like plumbing or HVAC lines.

Figure 23B:
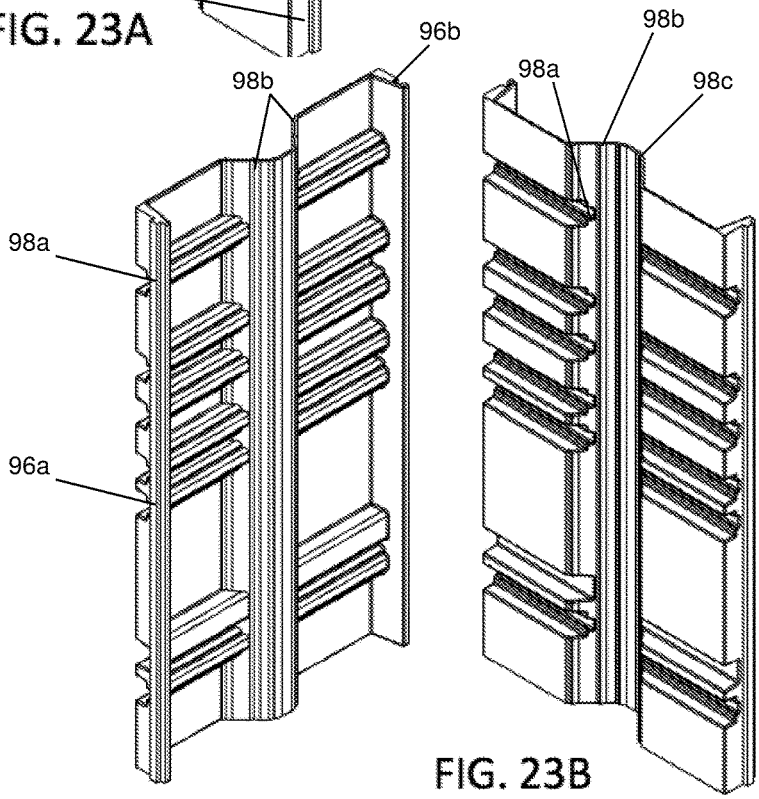
Figure 23C:
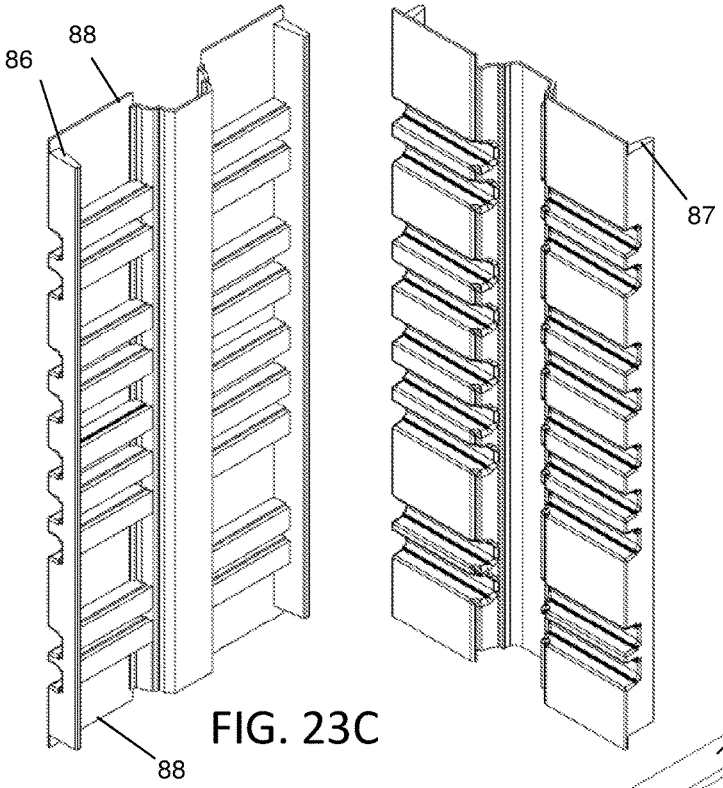

FIG. 23B depicts another variation of a corrugated panel having a side frame with one vertical channel of a first depth spanning the entire panel height and a plurality of horizontal channels of a second depth spanning the entire panel width, whereas the panel side ends are bent 90° to form a vertical side frame extending to at least the depth of the horizontal channel depth. In addition to the side frames, FIG. 23B depicts horizontal channels having sloped sides feature with at least one stepped shoulder 98*a* to form a resting point for j-boxes at a first height and a second depth to create extra depth to accommodate larger waste water lines. Similarly, the vertical channel features various stepped shoulders 98*b* at different depths relative to the panel's front face to serve as resting points to attach cover panels or channel braces at a various depths. In operation, the first step relative to the panel's front face is for the attachment of a filler panel 106 which spans the entire width and height of the vertical channel. The vertical side ends of the filler panel rest on these steps and is attached to these steps with mechanical fasteners. The filler panels front side is flush with the font side to the corrugated interior panel to provide a continuous mounting surface for the attachment of a second wall panel, which sits perpendicular or at an angle towards the first wall panel. The corrugated interior panel may also feature a second step 98*c* to accommodate a second narrower filler panel to cover the vertical channel at the same depth as the bottom of the horizontal channels. The second step is recessed the same distance as the filler panel thickness to allow for a continuous mounting surface at the same depth as the horizontal channel depth.

Figure 23D:
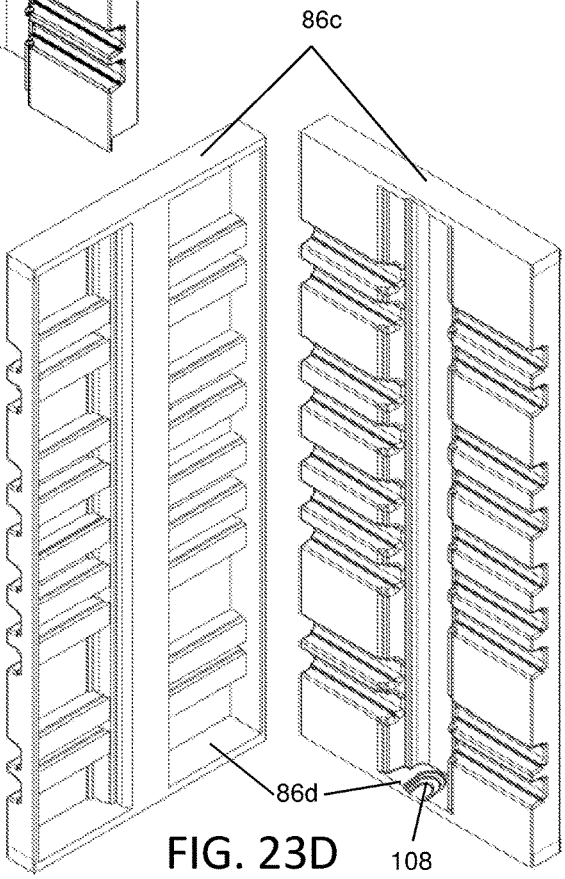

In another embodiment the horizontal perimeter frame can also be a continuous frame on all four sides of the panel, perpendicular to the backside of the front panel, spanning the entire panel depth such as shown in FIG. 23D. Additionally, the thickened bottom and top frames may feature semi-circular stepped markings 108 centered at the center of the vertical channel, which function as a drilling guide to define the exact hole position of plumbing pipes of various diameters needing to be led through the bottom or top plate.

Figure 23E:
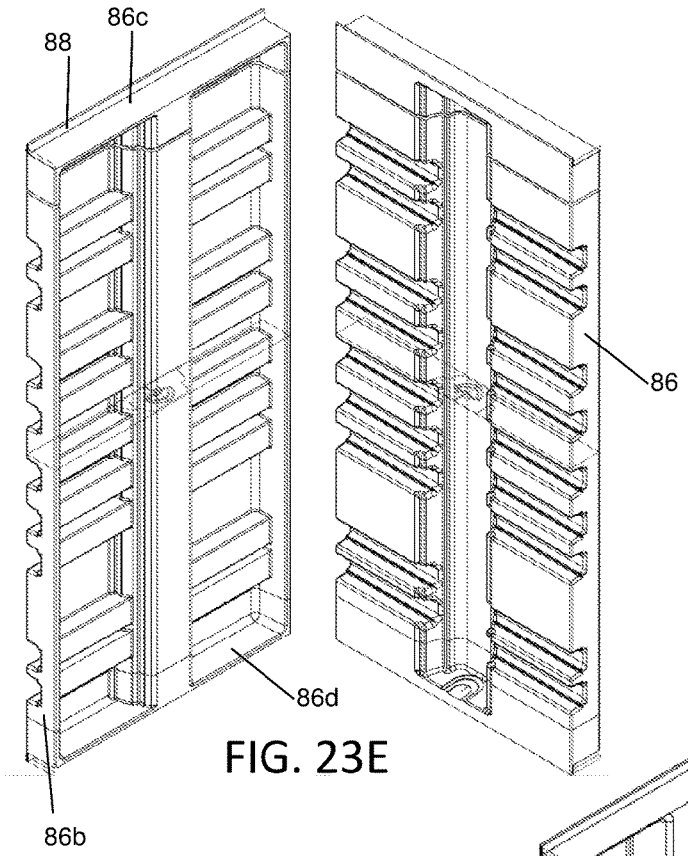
Figure 23F:
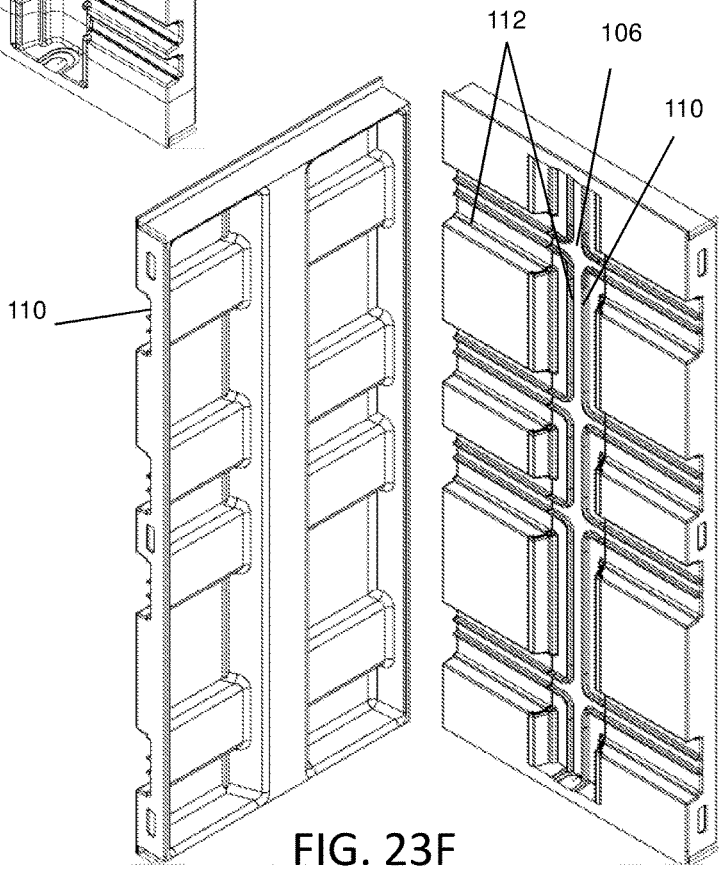

FIG. 23E illustrates another variation of the horizontal top and bottom frame with an additional bend defining a flange for attaching the panel to the plate described herein. Accordingly, although the frame may replace the plates and studs in some embodiments, they may also be used in combination with a plate or stud to provide a sturdier panel and stronger connection. Another embodiment having the perimeter frame and a top and bottom flange can be seen in FIG. 23F. However, the horizontal channels in this embodiment have been consolidated 110 to allow for more installation space for electrical and plumbing conduits. Generally, the consolidated channels have a similar or the same width but a different depth than the vertical channel, and as shown in FIG. 23F, a filler panel 109*a* may be inserted into the vertical channel to create a flush mounting surface equal to the depth of the horizontal channels as described in detail below. Regardless of the whether a filler panel has been inserted, consolidated channels may be used in the corrugated panels of the present invention Further, FIG. 23F also shows an inserted filler panel in the front view to create a flush mounting surface equal to the depth of the horizontal channels for the installation of electrical and plumbing. The corrugated interior panel features recesses on the sides of the panel's thickened vertical side ends to allow for flush mounting of mechanical connectors to connect a second panel to the first panel. Optional ridges 112 on the bottom of the horizontal channels, running parallel to the horizontal channel, serve as guides or mounting supports to allow for the installation of j-boxes which are shallower then the horizontal channel depth. The filler panel can feature both horizontal and vertical ridges to provide the same function along the entire vertical channel height. Both the ridges in the horizontal channels as well as the ridges on the filler panel can either be continuous or they can be segmented as well being able to be broken off to create more installation space.

Figure 23G:
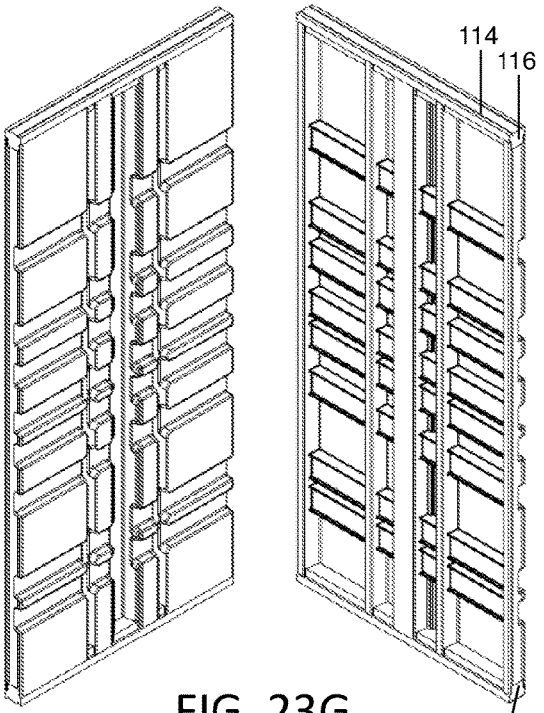
Figure 23H:
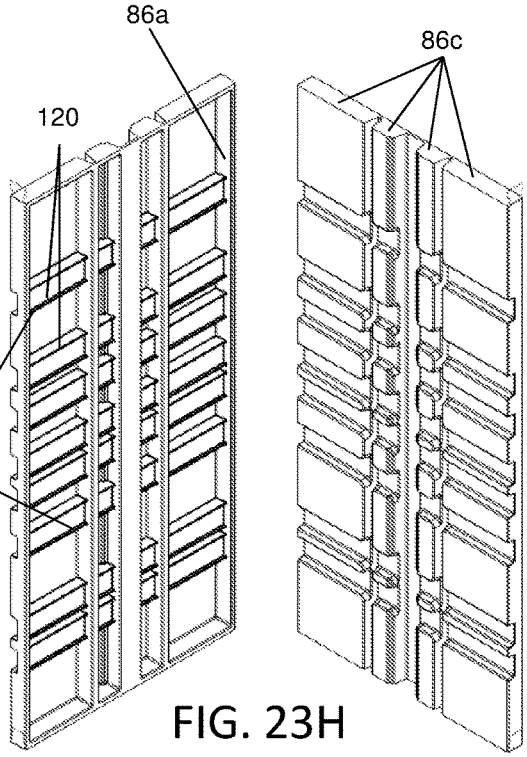
Figure 23I:
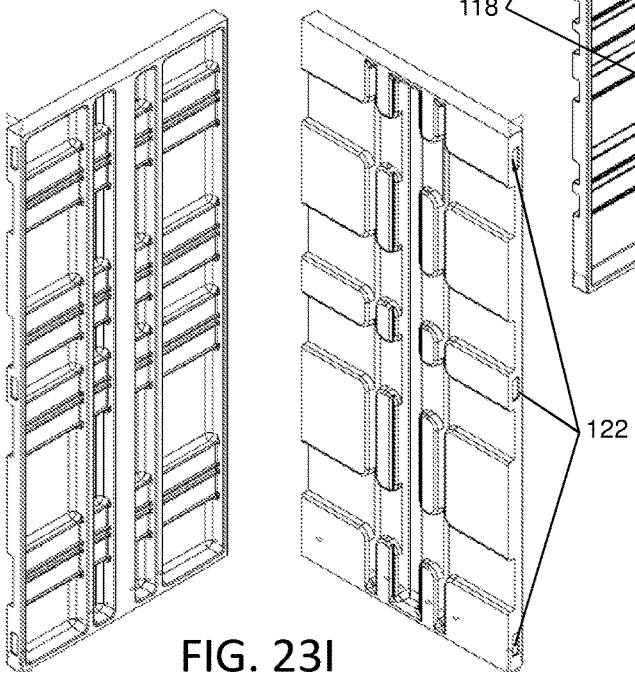

Another aspect of the corrugated panels with thickened perimeter frame is shown in FIG. 23G-FIG. 23I where the vertical channels feature different widths including a central channel having the same width as the horizontal channel or a vertical channel having half the width of the horizontal channel and at least one second vertical channel with a width less than half of the vertical channel width. This embodiment also depicts a recessed groove 114 in the top and bottom side end, between the panel's front face and the panel's back side to accommodate a T-shaped 116 top and bottom plate. The T-shaped plate can feature one or more grooves on the plate's wider side, facing away from the corrugated panel, running parallel to the plates long side to accommodate the insertion of flexible seal strips to allow for an improved thermal and acoustic seal between the wall panel and the floor or ceiling. The backside of the horizontal channels can feature horizontal ridges 118 forming shallow horizontal channels 120 which function as guides and mimic the same position as the horizontal channels on the panel's front side, to be able to position additional installation of J-boxes, on either side of the partition wall. The wider vertical channel can feature an additional recessed step on the vertical perimeter of the channel facing towards the center of the vertical channel, where the vertical channel intersects with the horizontal channels. These recessed steps function as attachment points to mount either a filler panel or channel brace to cover the vertical channel to either accommodate an additional mounting surface for the installation of J-Boxes, or to cover the entire vertical channel from top to bottom to create a flush surface with the front surface of the corrugated interior panel. The filler panel's function is to create a sturdy attachment surface to connect a second wall panel perpendicular or at an angle to the first wall segment.

Similarly, FIG. 23H shows a thickened vertical side frame and a partial horizontal top and bottom frame, thickened between the vertical side frame and the first vertical channel as well as a thickened frame between all other vertical channels. However, this embodiment leaves all vertical channels open to the top and bottom side rather than having a thickened top and bottom frame covering the vertical channel. Similarly, FIG. 23I depicts another variation of a corrugated wall panel having a perimeter frame except the horizontal channels are widened and consolidated as described above. Further, the side frames also have apertures 122 aligned opposite from the horizontal channels in order to accommodate mechanical fasteners for connecting adjacent panels.

Figure 23J:
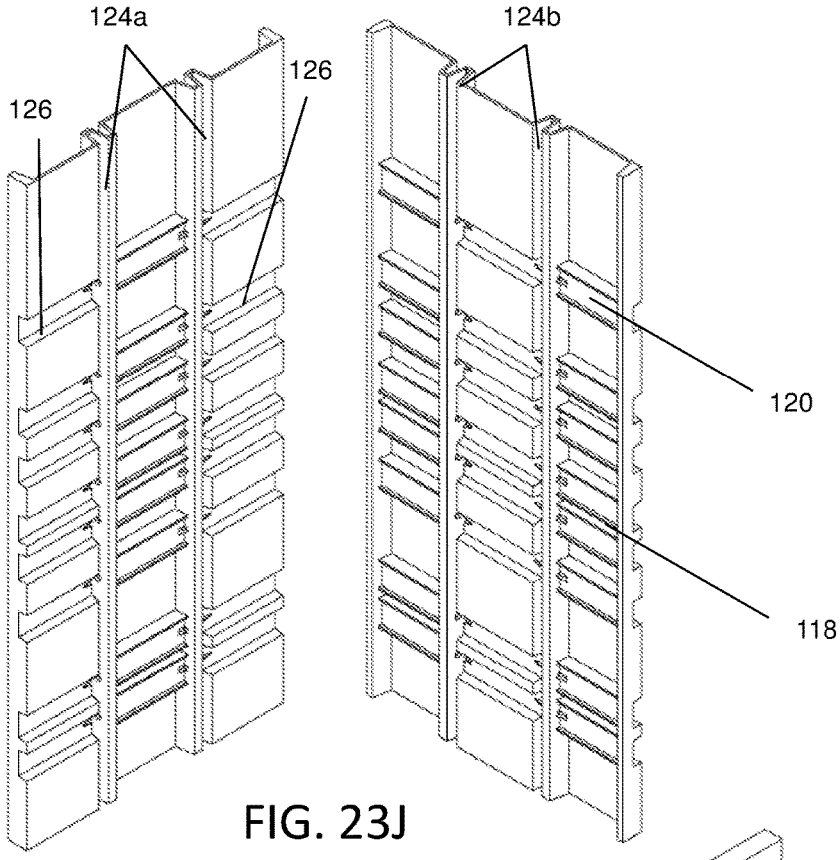
Figure 23K:
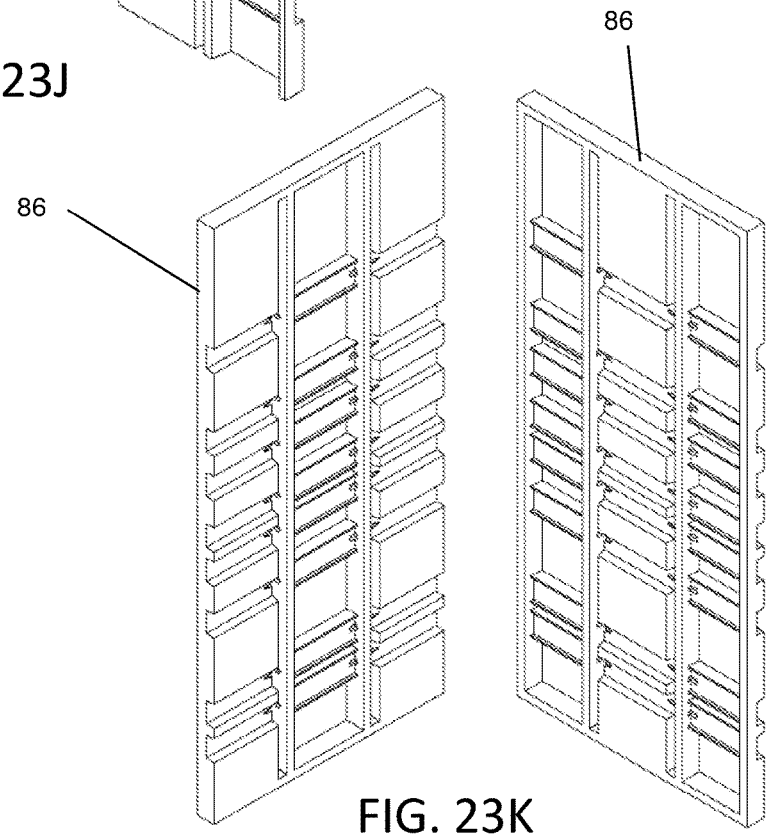
Figure 23L:
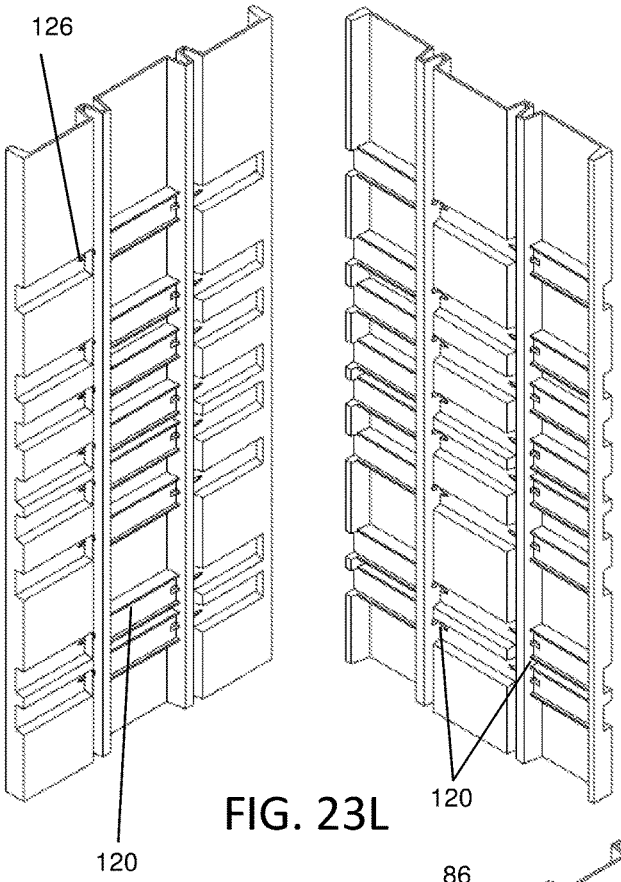
Figure 23M:
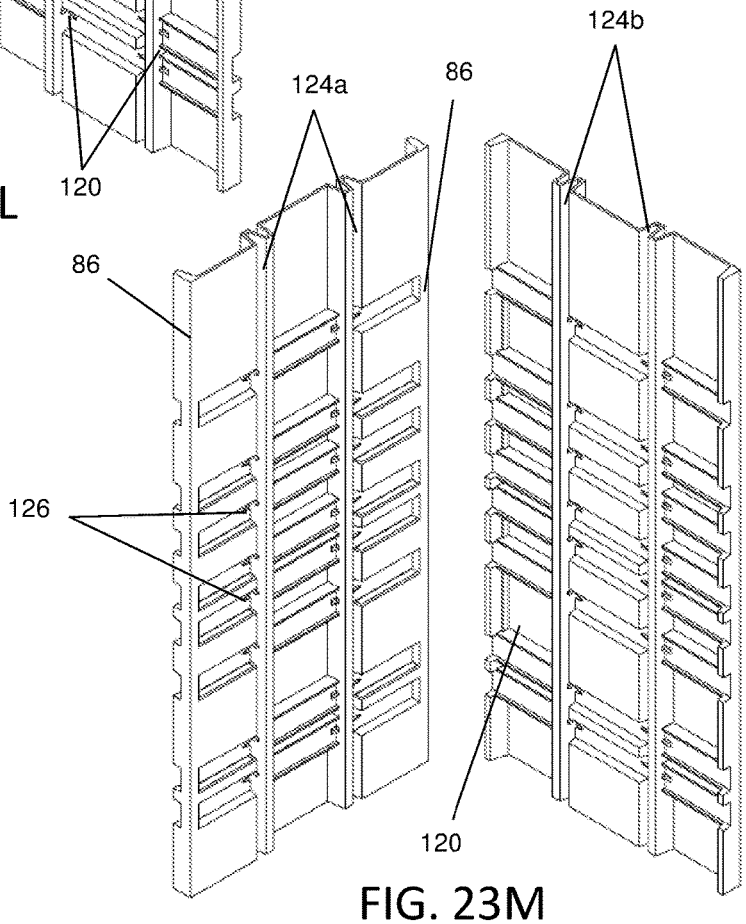

Another aspect of the present invention is a corrugated panel with various alternating vertical channels 124 that open to either the front face 124*a* or the backside 124*b* of the panel. FIG. 23J depicts a panel having a series of discontinuous horizontal channel segments 126 spaced from each other at different heights spanning across the panels front face and backside with the spanning distance between the panel's first side frame and front face vertical channel being at least twice the width of the first vertical channel. Additionally a second set of horizontal channels is on the panel's backside formed by at least two horizontal ridges protruding from the backside and forming shallow horizontal guide channels thereon. These channels span between the pair of vertical channels open to the panel's backside and have a span distance at least twice the width of the first vertical channel opening. Lastly, another third set of horizontal channels is found on the panel's front side spanning from another vertical channel open to the panel's front side to the opposite side frame of the panel, with this span being at least twice the width of the first vertical channel opening. In operation these continuous uninterrupted vertical channels allow for easier and faster installation of drywall following standard screwing patterns. Additionally, the reversing channels can be combined with a perimeter frame as shown in FIG. 23K as well as having apertures between the sets of alternating vertical channels so conduits may be passed therethrough, depicted in FIG. 23L.

Figure 23N:
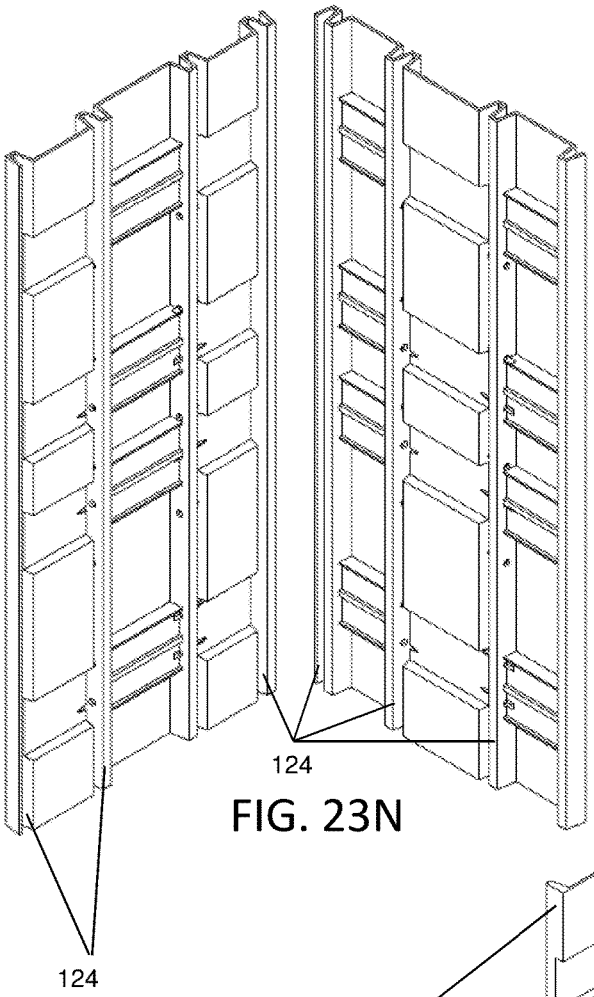
Figure 23O:
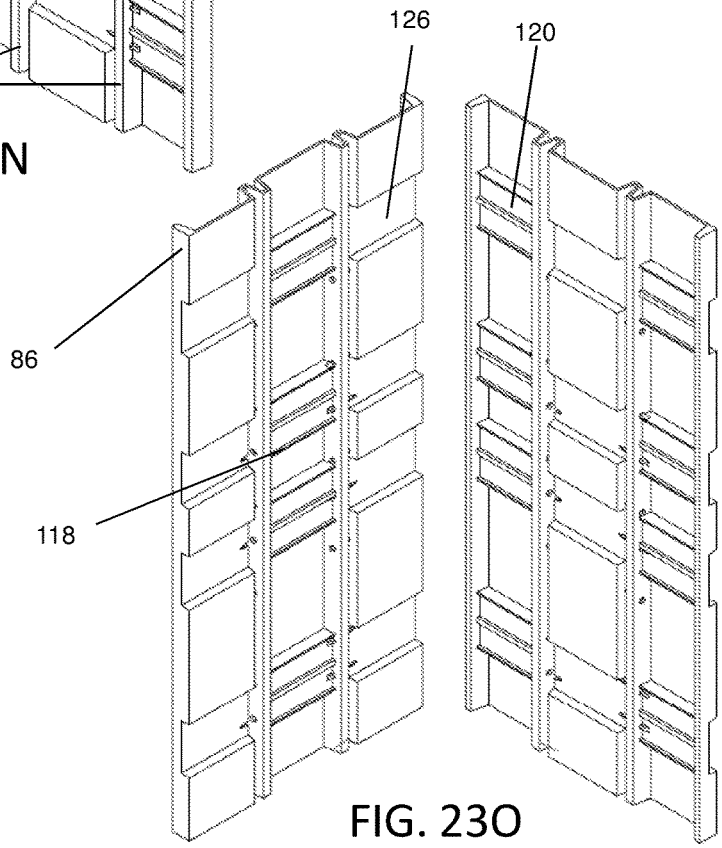

FIG. 23O depicts another embodiment of a panel with various alternating vertical channels, with openings to either the front side or the backside of the panel. A plurality of recessed horizontal channels starting inset from a continuous side frame on the front of the panel, spans across the panels front side to the first vertical channel. Additionally, another set of horizontal channels on the panel's backside spans between a pair of vertical channels open to the panel's backside. Another third set of horizontal channels on the panel's front side spans from a second vertical channel, open to the panel's front side to a position inset from an opposite continuous side frame on the front side of the panel. Additionally, this embodiment may also have apertures between the vertical channels as well as ridges on the backside defining the shallow horizontal channels. Further still, this embodiment can also have consolidated larger horizontal channels and a pair of vertical channels proximate to the side ends of the panel as shown in FIG. 23N and FIG. 23O.

Figure 23P:
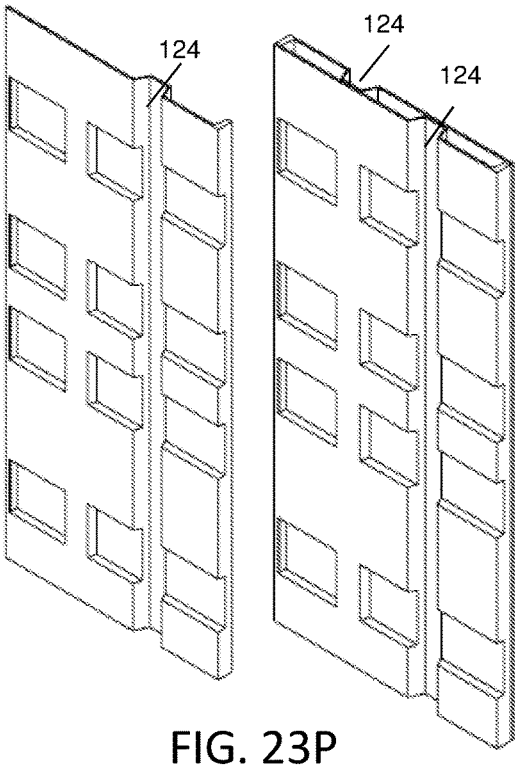
Figure 23Q:
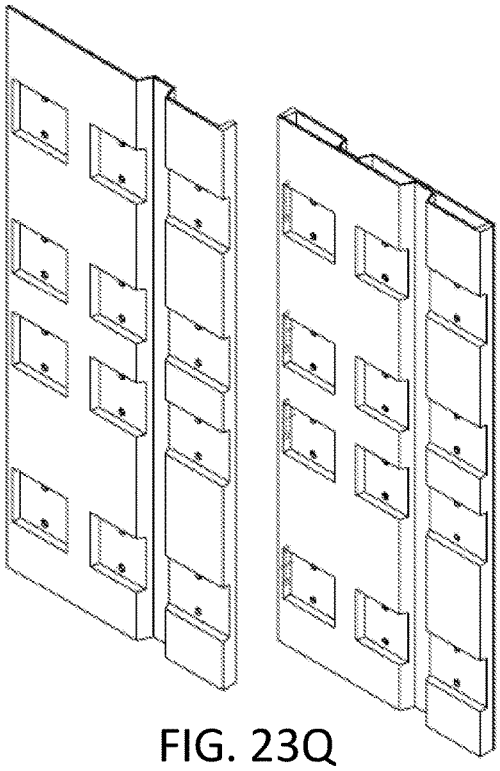
Figure 23R:
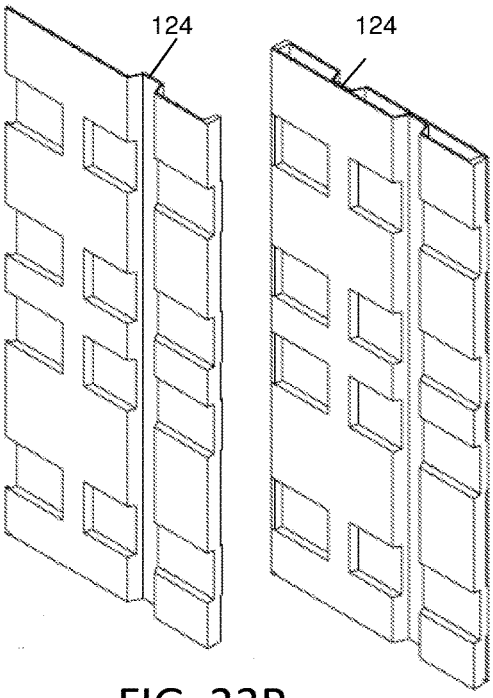

FIGS. 23P-23R depict another version of the corrugated panel with multiple horizontal channels and a pair of vertical channels with one being open to the front side of the panel and the other being open to the backside of the panel. In these embodiments the front vertical channel has an opening width greater than the width of the vertical channel open to the backside. In the preferred embodiment this panel assembly is created by taking two panels with the first panel defining the front side and the second panel defining the backside of the assembly. When arranged in an assembled configuration the backside panel is rotated 180° about its vertical axis and nests with the first panel to form a sandwiched assembled arrangement. Accordingly, the vertical channel open to the front side slides over the backside of the vertical channel recessed from the backside panel. Additionally, it should be appreciated that this embodiment can also have a perimeter frame and apertures within the front or back face as described above.

Figure 23S:
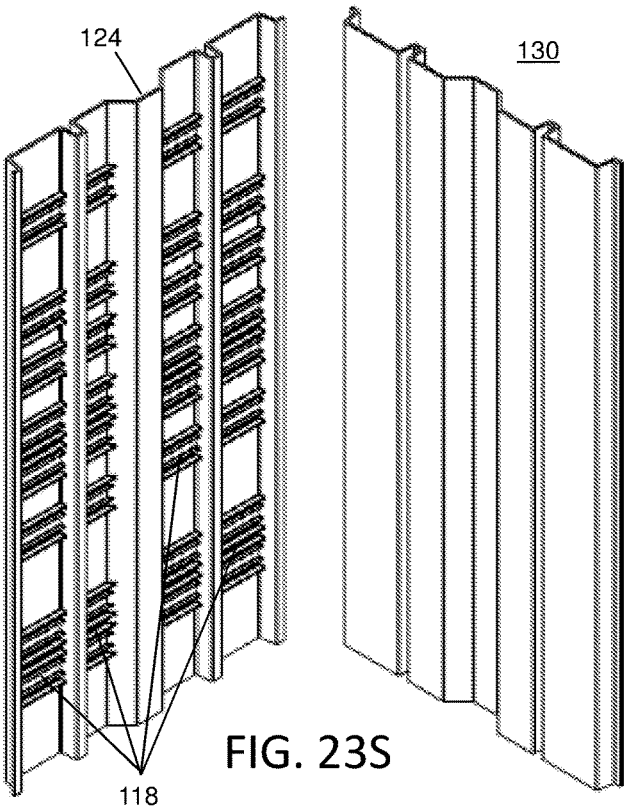
Figure 23T:
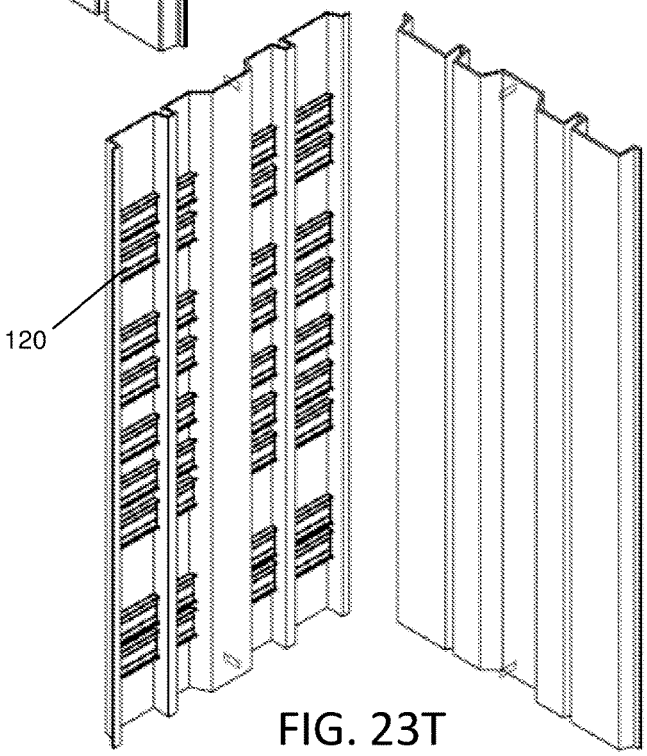

In another aspect of the corrugated panels described herein, a structural corrugated core 130 may be attached to the inside of the panel to provide structural strength. FIG. 23S depicts the structural corrugated core with vertical channels of various widths recessed from the panels backside spanning the entire panel height. At least one vertical channel has an opening width larger than the interior corrugated panel's vertical channel backside width in order to be able to nest the structural corrugated core over the backside of the interior corrugated panel. In another version the structural core has horizontal channels featuring ridges forming shallow horizontal channels of various depths and different heights spanning the space between the various vertical channels on the backside of the structural core. Ridges on the bottom of the horizontal channels serve as mounting guides for the installation of J-boxes and can either be continuous or segmented. Further, the shallow channels defined by the ridges may have a raised mounting surface as shown in FIG. 23T.

Figure 23U:
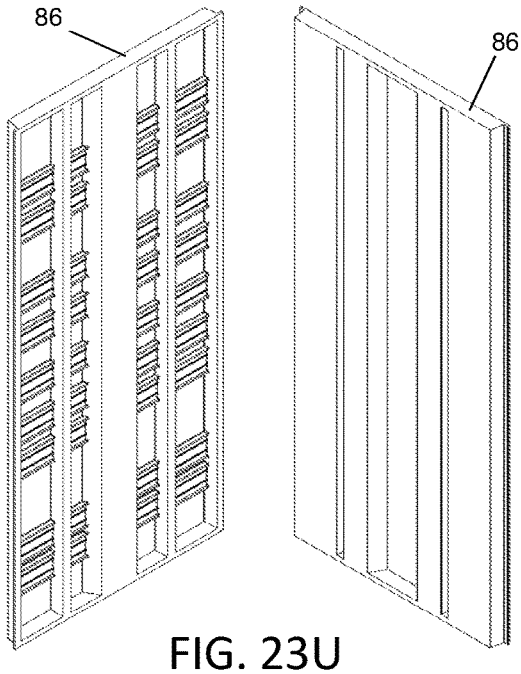
Figure 23V:
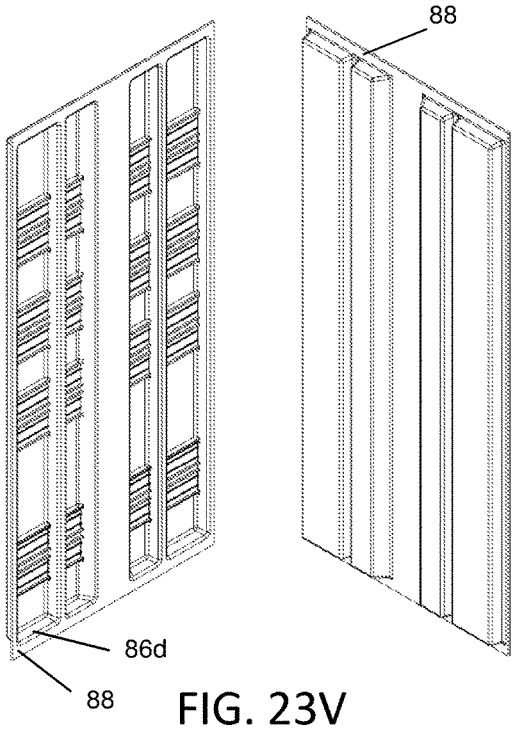
Figure 23W:
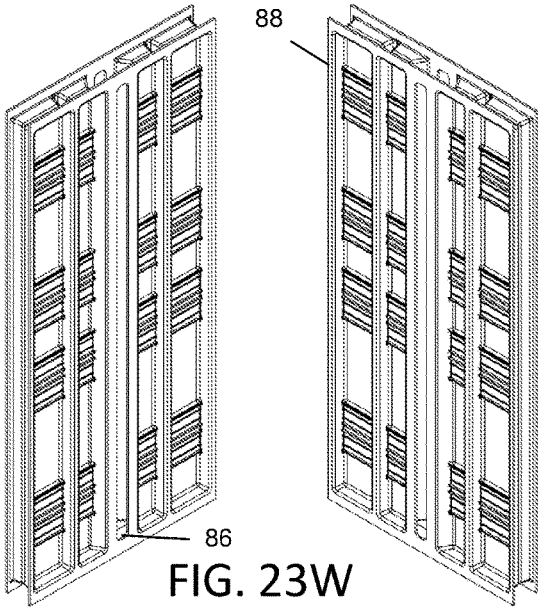

Additionally, the structural core can have the same plate attachments, thickened side frames shown in FIG. 23U, thickened frames with a flange as shown in FIG. 23V and be incorporated into a panel assembly as described herein and shown in FIG. 23W. When assembled the structural cores are mirrored and attached to each other at their respective backsides to form a structural interior wall panel. Further, apertures can be cut into each panel to allow fasteners or other fastening means to attach the pair of sections as well as to allow access to the cavity between the two facing vertical channels for installation of vertical plumbing lines or other conduits.

Figure 24A:
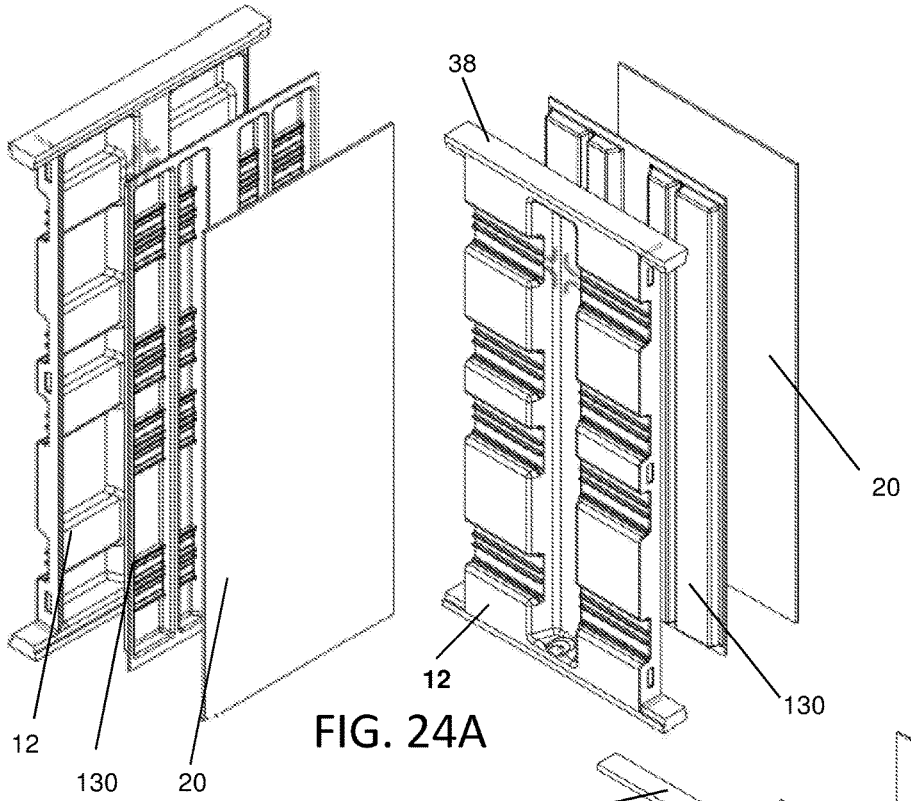
FIGS. 24A-24K illustrate embodiments of corrugated structural panels according to the present invention.

The corrugated wall panels can also be assembled as shown in FIG. 24A depicting an overview of different stages of assembly of the structural wall panel, featuring the corrugated interior panel 12 with the installation channels and the structural corrugated core 130 which has undisturbed vertical corrugations, but features channels between the vertical corrugation to mirror the horizontal channels on the opposite side of the corrugated interior panel to provide mounting areas for electrical j-boxes. Accordingly, these two panels sandwiched together create a structural wall segment. By adding an additional flat panel which functions as an exterior shear panel, the structural wall assembly becomes an exterior wall panel as a sandwich of the corrugated interior panel, the structural corrugated core and the flat exterior shear panel. Accordingly, the assembly is made up of a corrugated interior panel and an outer flat shear panel sandwiching the structural corrugated core with a top and a bottom plate. It should be appreciated that this section description is representative for all variations of the various panels. The various panels can be with or without thickened frames, without thickened frames on all sides of the panels or all thickened frames can be replaced in their entirety or in part with individual plates of solid lumber or other suitable materials.

The exterior shear panel can be made of pressed wood fiber or other suitable material and can feature different three dimensionally formed patterns, which mimic traditional wood cladding like horizontal shiplap siding, or vertical siding, brick veneer or other graphic patterns. The pressed exterior panel can be waterproofed through the use of chemical additives or a waterproof coating. Additionally these panels can be primed to and or painted. The exterior panel can be a sandwich of the aforementioned fiber board, plywood or other suitable material as a substrate and other weather proof materials such as sheet metal, plastic sheeting, wood siding or stucco. These additional treatments allow for the delivery of a fully finished exterior side of the panel, where besides installation no additional waterproofing or additional exterior surface work is needed. The cavities between the corrugated interior panel and the structural corrugated core and between the structural corrugated core and the flat exterior panel can be filled with thermal or acoustic insulation. The open horizontal and vertical channels on the interior side of the assembly can also be filled with thermal or acoustic insulation either through rigid, removable molded inserts, batt, spray-in, or blow-in insulation.

Figure 24B:
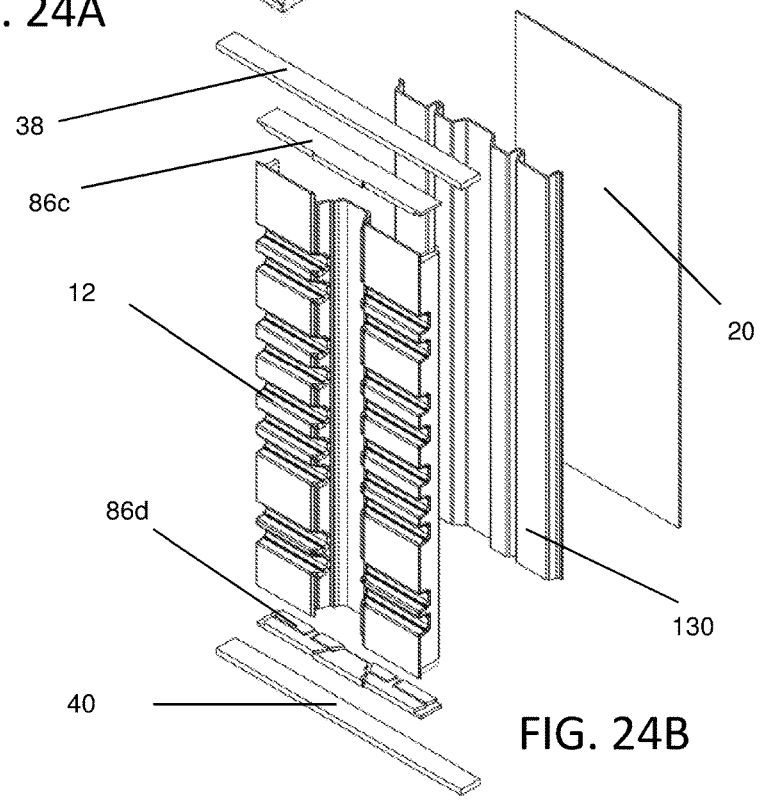

FIG. 24B shows another view of a wall panel assembly where the corrugated interior panel features perimeter frames which are perpendicular to the backside of the corrugated interior panel, a structural corrugated core and an inside-top and-bottom plate. The inside-top and inside-bottom plate feature milled recesses mimicking the horizontal contour of both the corrugated interior panel and the structural corrugated core. Additionally, the corrugated interior panel and the structural corrugated core slide into the groves provided in the inside-top and inside-bottom plate and are bonded to the inside-top and inside-bottom plate, either by gluing or mechanical fasteners to create a sturdy connection between the corrugated panels and the inside-top and inside-bottom plate. To assemble several panels to form a wall, the finished individual wall assemblies are positioned on a longer top and bottom plate and attached to the plate through mechanical fasteners.

Figure 24C:
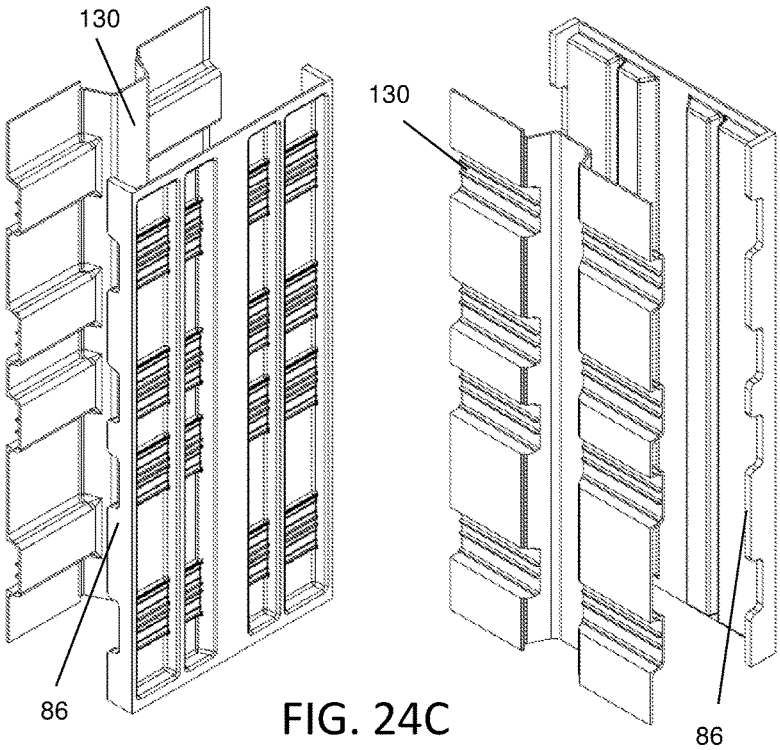
Figure 24D:
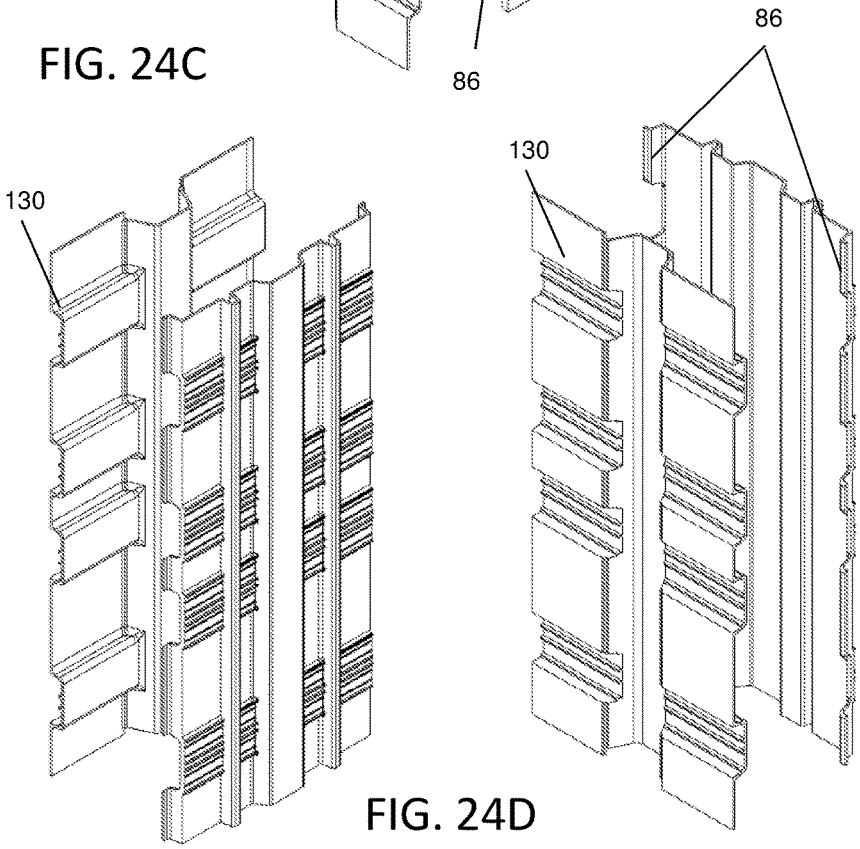
Figure 24E:
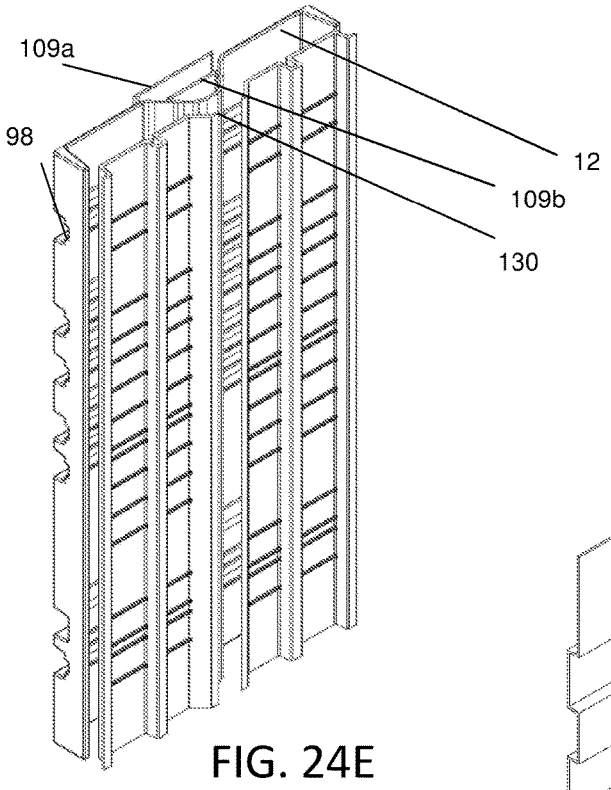

FIG. 24C show another variation of a wall panel assembly where the structural corrugated core features thickened side ends matching the backside contour of the corrugated interior panel. Similarly FIG. 24D shows a panel assembly with a perimeter frame but the frames are bent 90° and have the same material thickness as the overall panel in addition to having another 90° flange, perpendicular to the side end. Further, FIG. 24E shows a horizontal section of a complete wall panel assembly consisting of a corrugated interior panel, two structural corrugated core sections flanking the backside of the vertical channel of the corrugated interior panel and an exterior flat panel covering the backside of the corrugated structural core panel.

Figure 24F:
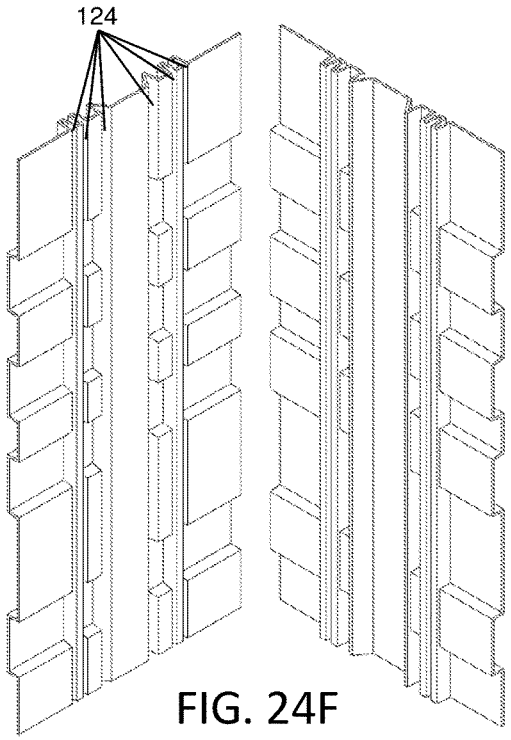
Figure 24G:
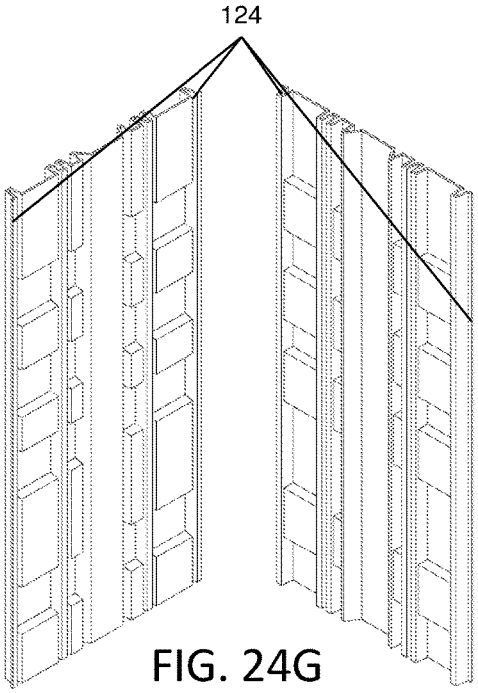
Figure 24H:
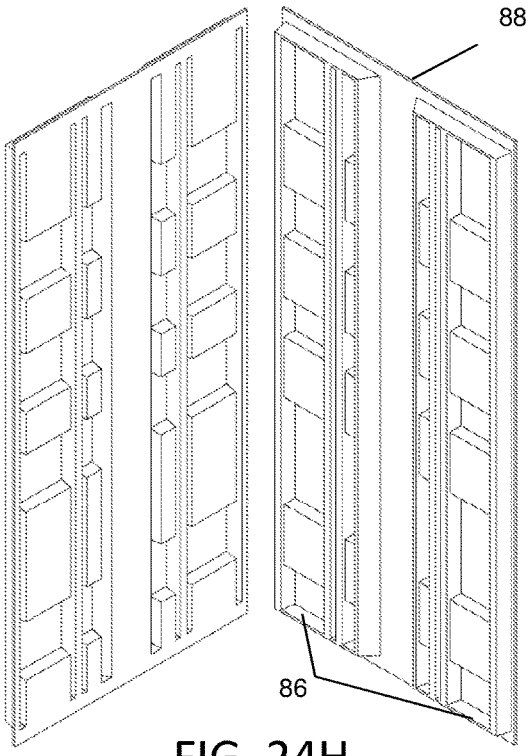
Figure 24I:
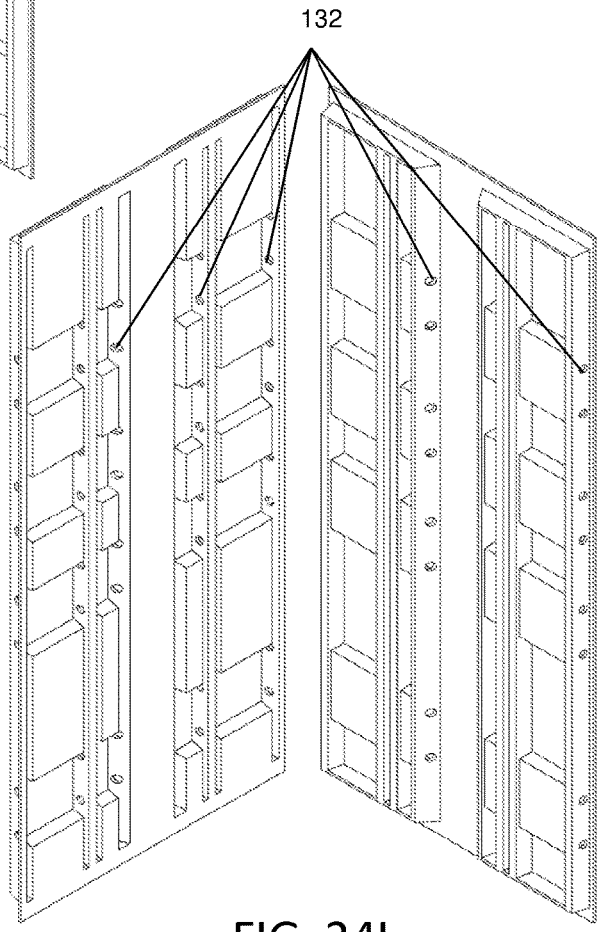
Figure 24J:
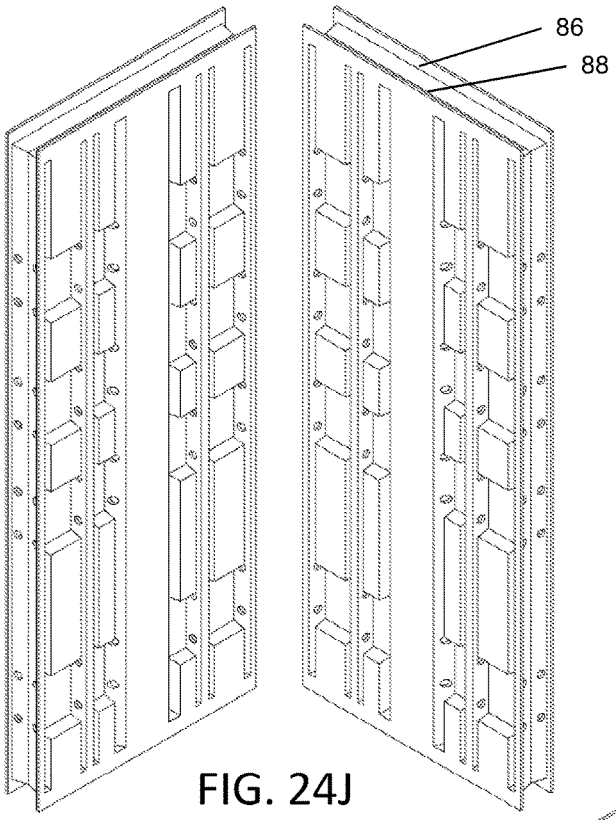
Figure 24K:
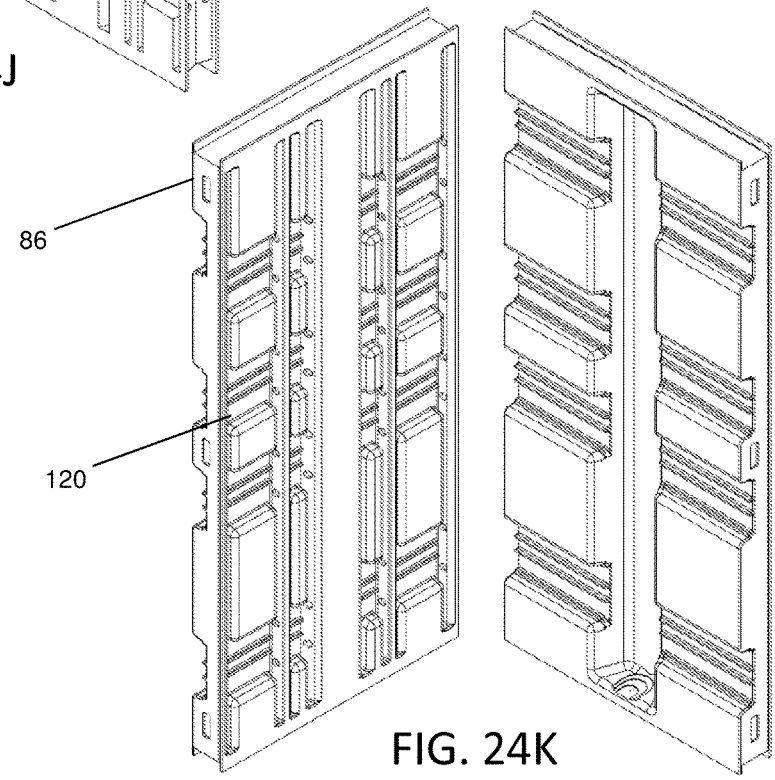

Another variation of the corrugated wall panel may have a plurality of horizontal installation channels and various vertical channels 124 of at least two different widths and depths as shown in FIG. 24F. In this embodiment at least one vertical channel has a first width open to the panel's front side and a second vertical channel with a second width open to the panel's back side. Further, the series of horizontal channels spans the distance between the first channel open to the panel's front side and the second channel open to the panel's front side. Accordingly, the panel may also have a third vertical channel proximate to the side end of the panel. Similarly, FIG. 24G shows a panel with various vertical channels of differing widths and depths having a thickened perimeter side frame running parallel to the panel's front face. As explained in the variations above this embodiment can also have a thickened perimeter frame and flange extending around the entire periphery of the panel, shown in FIG. 24H, as well as apertures 132 between the various vertical channels as shown in FIG. 24I. Additionally, FIG. 24J shows a pair of mirrored panels described above attached at their respective backsides and it should also be appreciated that this corrugated interior panel embodiment can also be combined with a corrugated structural panel to form a structural interior wall as shown in FIG. 24K.

Figure 25A:
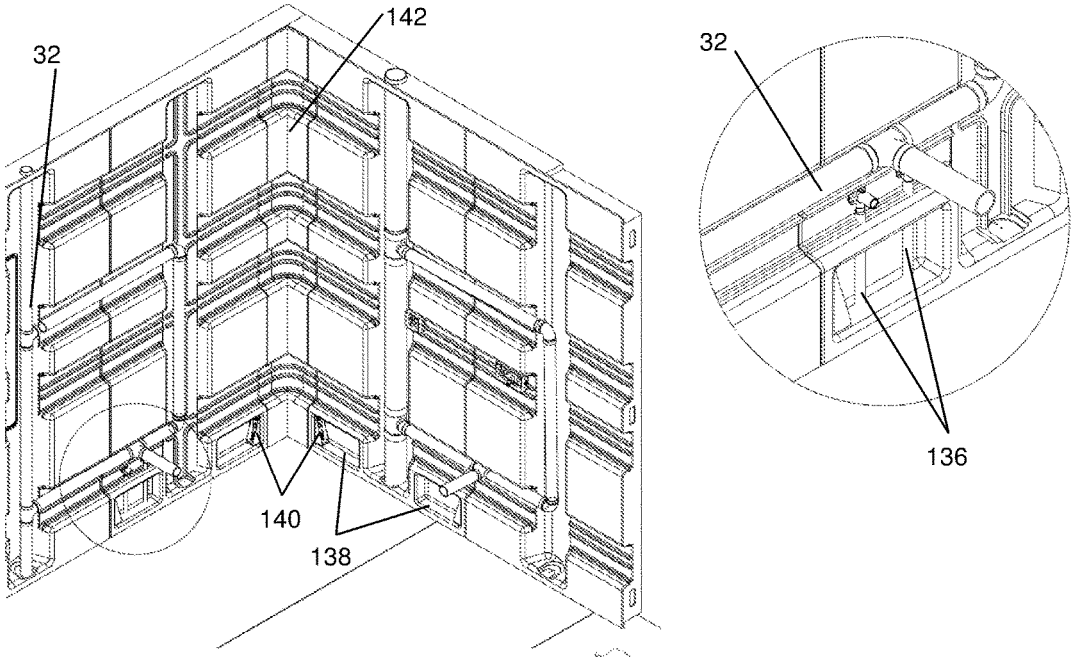
FIGS. 25A and 25B depict alternative assemblies of corrugated panels according to the present invention.
Figure 25B:
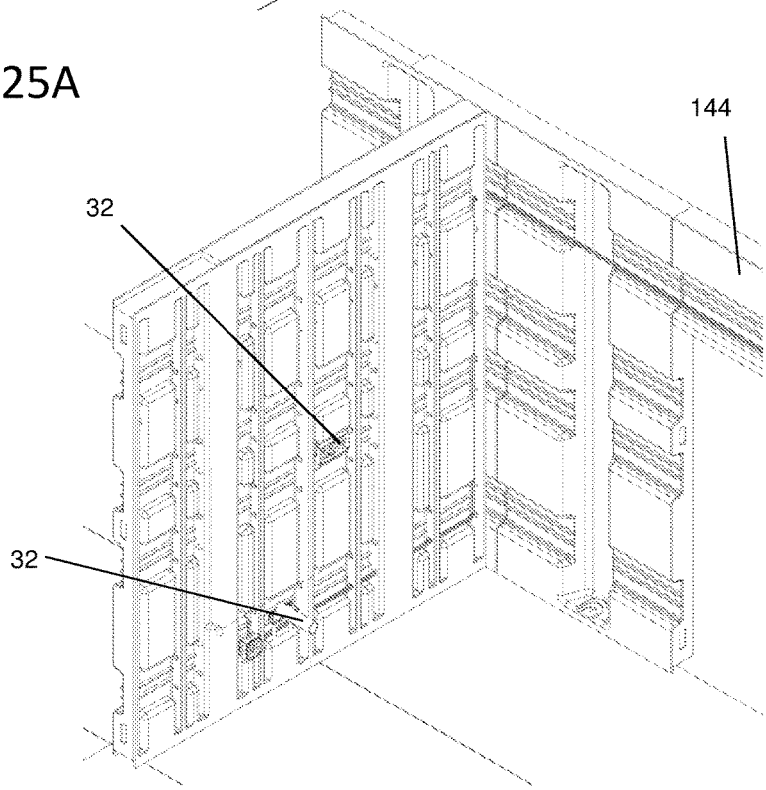

FIGS. 25A and 25B show different variations of panel assemblies and different panel types within the wall system as well as the installation of various plumbing and electrical installations 32 on the inside, the outside and transitioning between both sides of the various wall panel assemblies. As can be seen in the drawings, variations of the panel assembly can support vent lines, cold and hot water lines 136 (shown in the detail view of FIG. 25A), drain lines, plumbing and door headers, as well as various features integrated with the panel assembly such as the corner bays 138, ground anchors 140 and corner panels 142 more particularly described below.

Another aspect of the corrugated panels are corner panels for inside and outside corners as shown in FIG. 26. Generally, examples of outside corners 142*a* can be seen in FIGS. 26A and 26B and inside corners 142*b* can be seen in FIGS. 26C and 26D. The corner connectors are structural connectors to connect wall panels to create inside or outside corners. They can be made of solid lumber, pressed out of plant fiber, a combination thereof or made from other suitable materials. They feature horizontal channels of the same shape and contour as the channels found in the wall panels. Inside corner posts have channels 146 running on the interior side of the post, where the channels run perpendicular to each other to form a continuous channel run, between two perpendicular panels and vice versa for outside corners.

Figure 26E:
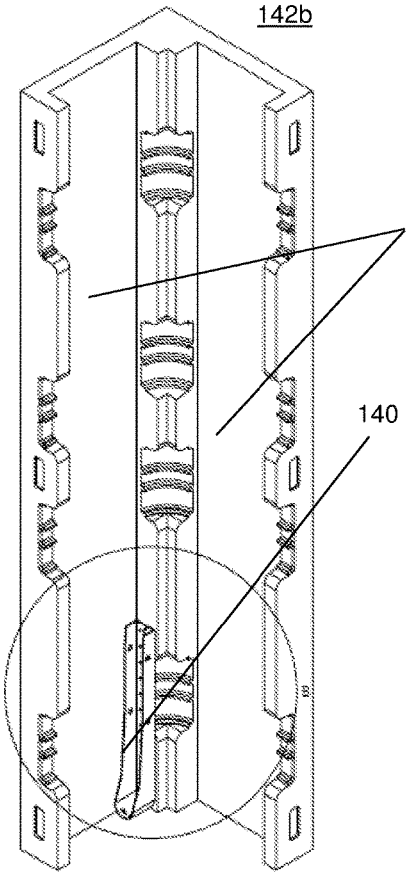
Figure 26F:
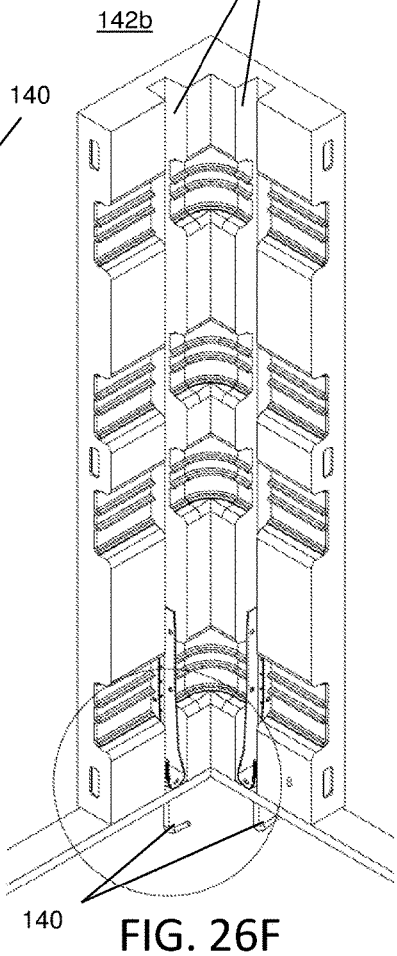
Figure 26G:
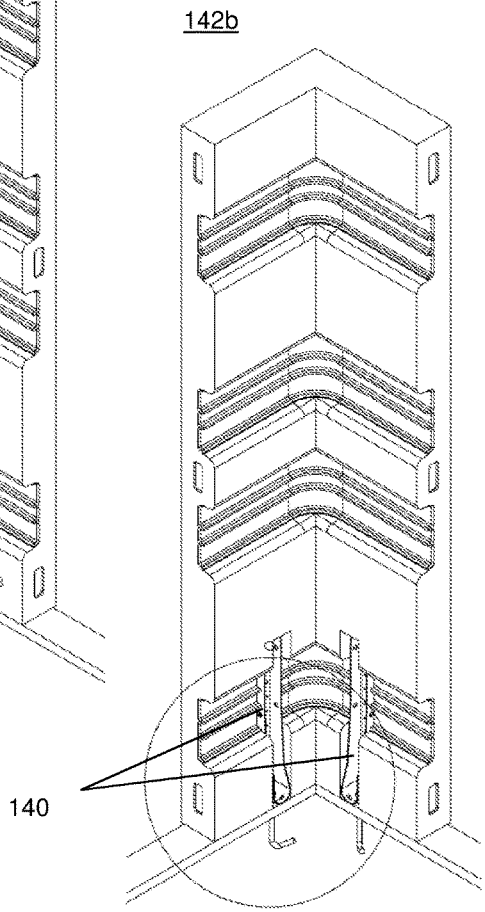
Figure 40:
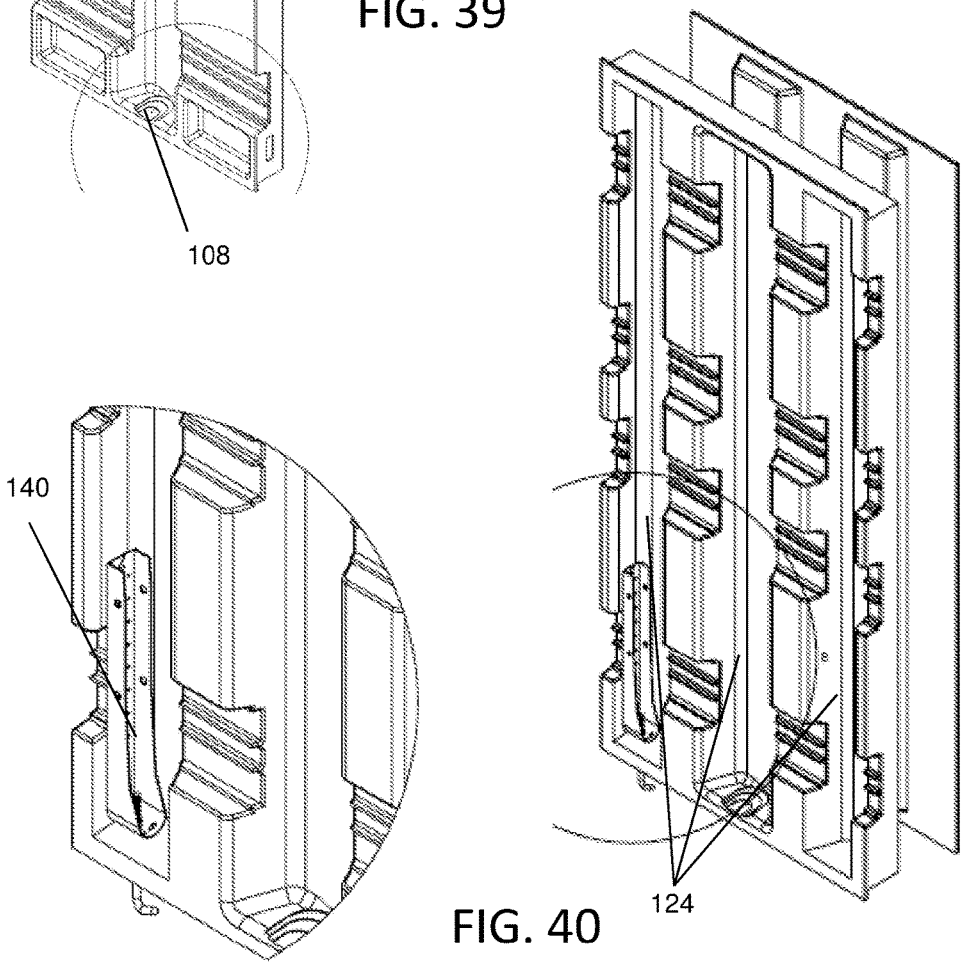

More particularly FIG. 26E shows the preferred corner as an L-Shaped corner panel having a wide vertical channel 148*a* on each side which allows for the installation of mechanical fasteners, like hold-downs, tie-downs or anchor bolts to attach the corner panel to the foundation. These panels can have any of the suggested side frame formations and panel to plate attachment variations. Another embodiment such as in FIG. 26F may have narrower vertical channels 148*b*. Further, another embodiment shown in FIG. 26G has reduced vertical channels forming corner bays to accommodate standard mechanical fasteners, both on the bottom and on top (not shown) of the panel. As shown in FIG. 36 each version of the various panel designs of the corrugated interior panel can have a formed bay recessed from the front side of the panel, located in each corner of the corrugated interior panel to create a space to install additional mechanical fasteners, like hold-downs, tie-downs or anchor bolts, to create a sturdy connection of the wall segment to the building's foundation. Additionally, the corrugated interior panel can have three vertical channels as shown in FIG. 40. As shown, a wall panel with three vertical channels accommodates structural mechanical fasteners, like hold-downs, tie-downs or anchor bolts, to attach the wall panel through the bottom plate to the foundation or though the top plate to tie a floor and wall panel assembly of a second story to the foundation. This panel can be reinforced with an additional corrugated structural core with two vertical channels and a plurality of horizontal channels. These panels can have any of the suggested side frame formations and panel to plate attachment variations.

Figure 27A:
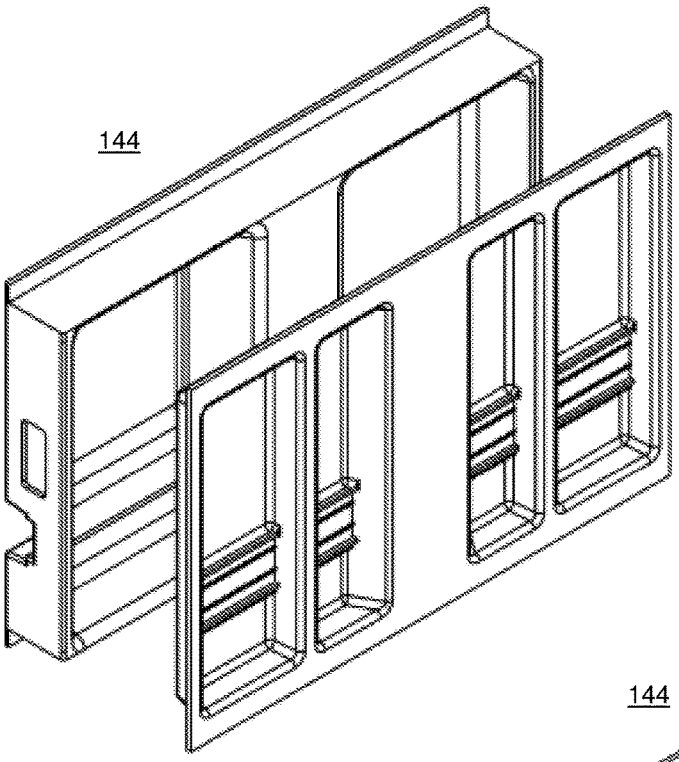
FIGS. 27A and 27B depict header panels according to the present invention.
Figure 27B:
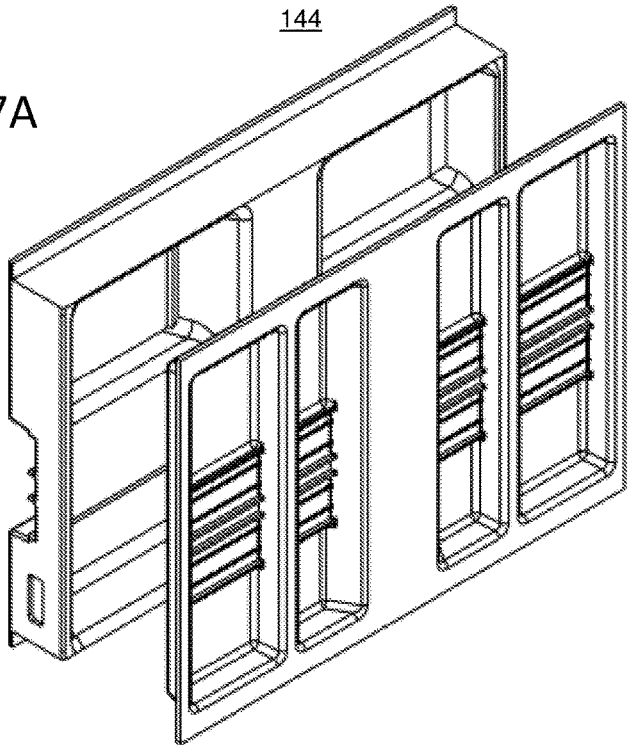

Based on the same core principle as the various wall panel assemblies, headers 144 for doors or windows can be molded, depicted in FIGS. 27A and 27B. These headers feature at least one horizontal channel of the same or similar contour as they are found in the panel adjacent to it. The horizontal channel provides space to run electrical conduits and other installations over a door or window frame. Both cripple walls and headers, which fill the area below a windows or above doors, windows or other wall openings, feature at least one horizontal channel and may feature one or more varying width vertical channels but may also not have any. These headers are based on the same design logic and construction and assembly principles as the taller wall segments variations described herein. Depending on the needed panel height, the cripple walls in general match the same number and location of horizontal channels as the next adjacent wall panel to allow for continued installation of electric and plumbing lines below windows.

Figure 28A:
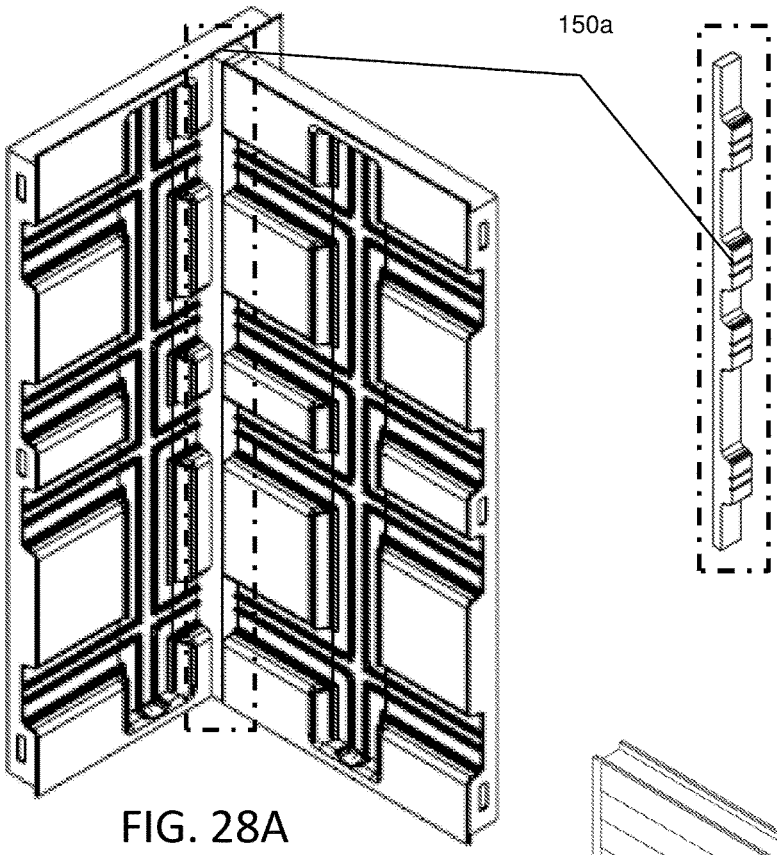
FIGS. 28A and 28B respectively depict butt joints and seam joints for use in combination with corrugated panels according to the present invention.

Another aspect of the present invention is to provide a panel connector 150*a* for abutting wall segments shown in FIG. 28A. The panel connector allows for a seamless connection of wall panels, which are perpendicular or at another angle relative to one another. The panel connector is a milled or molded solid piece of wood, wood fiber or other suitable material. It is a vertical plate equal in width and height to the wall panel assembly. The front side of the panel connector, which is facing the front side of an adjacent wall panel which stands perpendicular to the first wall panel, features a vertical contour matching the contour of the front face of the second perpendicular wall panel, thus fitting in the voids which are created by the horizontal channels of the adjacent panel.

Figure 28B:
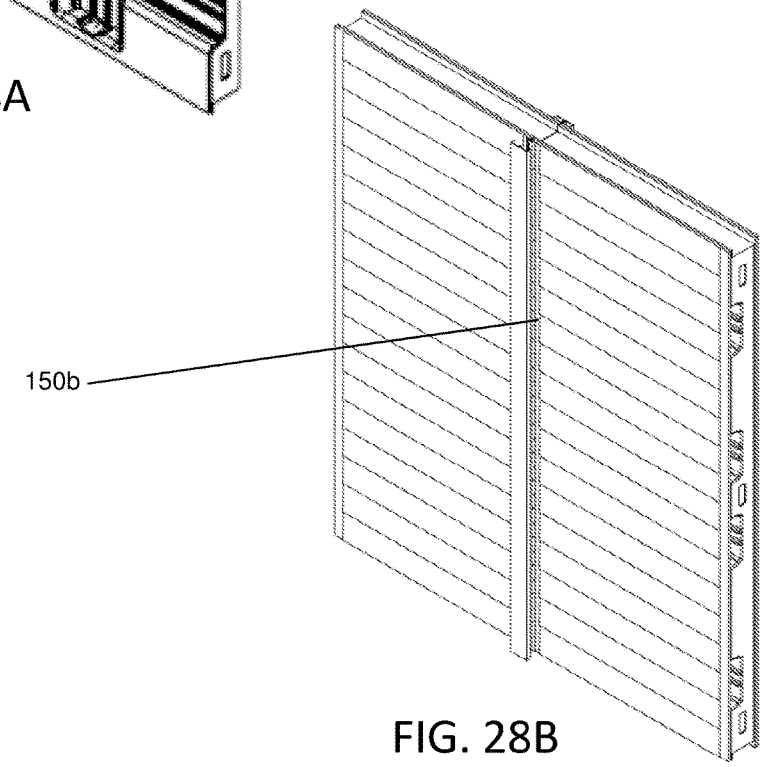

Additionally, FIG. 28B illustrates a panel seam brace 150*b* for connecting adjacent panels. As shown in the drawing an extruded profile can be inserted into vertical and horizontal seams between adjacent panels. A flange left and right of a center ridge or centered U-channel open to the panels exterior side is used to attach the profile to the panel's exterior bridging the gap between two panels. The preferably aluminum profile can be glued or attached via mechanical fasteners to create better air tightness and add attritional strength to the connector between two wall panels. Additionally, the flanges can be sealed with a liquid sealer or a soft rubber like material to increase air tightness at the seams and to prevent moisture from intruding the gap between two adjacent panels. The flanges can be additionally secured by running tape over the flange and the exterior panel to cover mechanical fasteners which can be used to secure the flanges with each adjacent panel and to create an air and water tight seal between two adjacent panels. Lastly, additional caps can be used to cover the joint for visual appeal and additional protection against water intrusion.

Figure 29A:
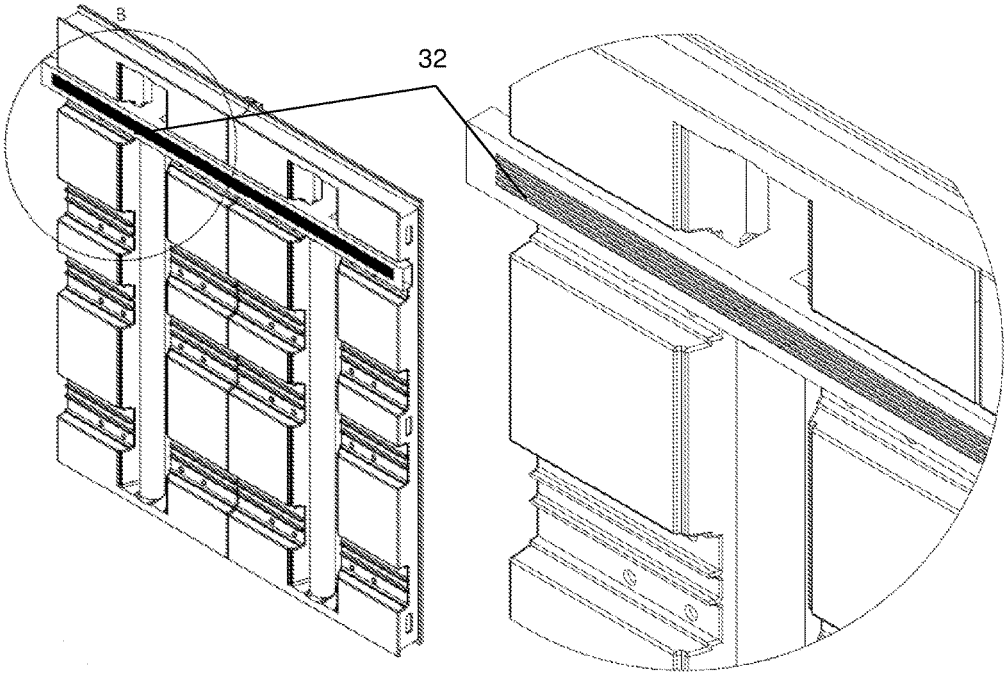
FIGS. 29A and 29B are respectively views of HVAC and lighting systems used in combination with corrugated panels according to the present invention.

FIG. 29A shows a continuous horizontal installation of HVAC vents inside the horizontal installation channels for a more even distribution of air throughout the room. In standard construction framing air registers are limited in size to fit between two studs. In order to accommodate larger air registers a wall would have to be specifically framed for this purpose. The horizontal channels in the suggested system allow for complete flexibility as in regards to determining the length of an air register thus allowing for a much more efficient, elegant vent design and a much more equal air distribution, than conventional vents. The air registers could also run vertically and connect to a horizontal air register or horizontal air duct. The air supply duct could connect to the horizontal or vertical air registers through air duct which are either being led through the bottom plate, for a basement style air duct installation, or through air ducts, which are led through the top plate into the wall for a typical attic style installation.

Figure 29B:
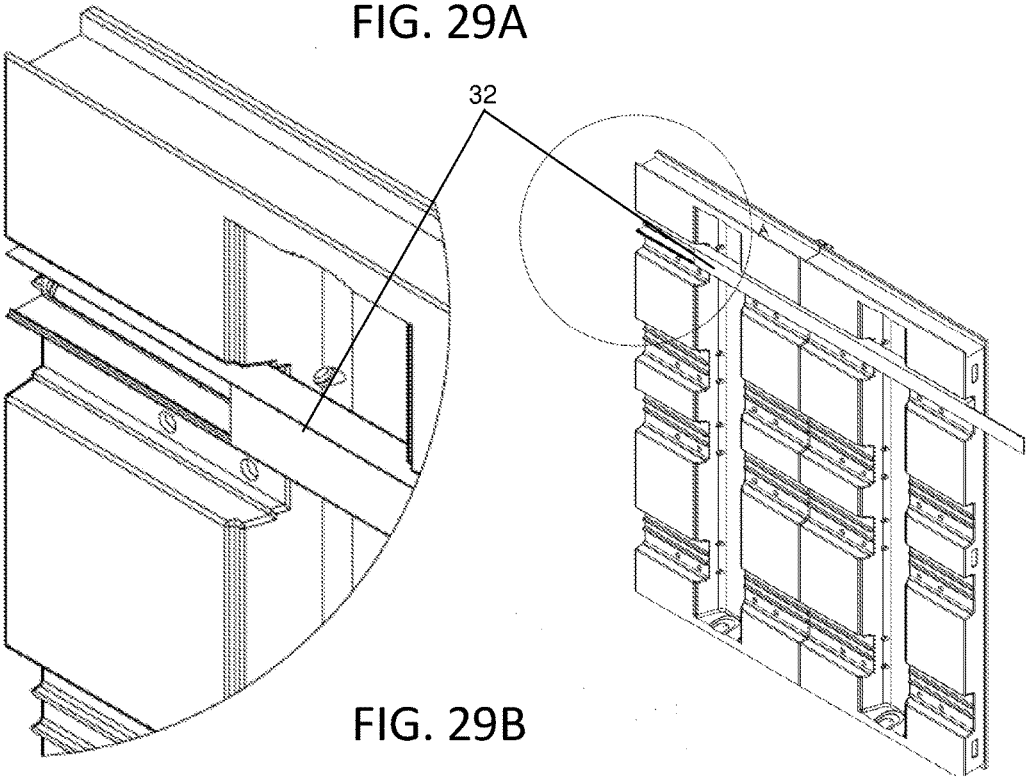

Similar to the HVAC installation described above FIG. 29B shows an in-wall-light channel installation. In standard construction, light fixtures are most commonly limited to be mounted on the walls finished surface and attached to standard j-boxes inside the wall. Today's architecture style seeks ways to implement indirect linear lighting where the body of the light fixture is integrated inside a wall panel and flush with the wall finish. Standard framing techniques would only allow for a vertical installation of such linear fixtures which sit flush with the wall finish, as the horizontal installation of fixtures are wider than the standard distance between studs would require time consuming and cumbersome modification of framing to allow for such and installation. Such modifications would weaken the structural integrity of a wall segment. The suggested panel designs with continuous horizontal installation channels allows for an unlimited length of such channel lights as well as an easy and quick installation without compromising the structural integrity. This technical feature allows the install of a light channel alongside an entire length of a wall perimeter and could also be used as up-lighting for lighting a ceiling or accentuating a crown molding.

Figure 30:
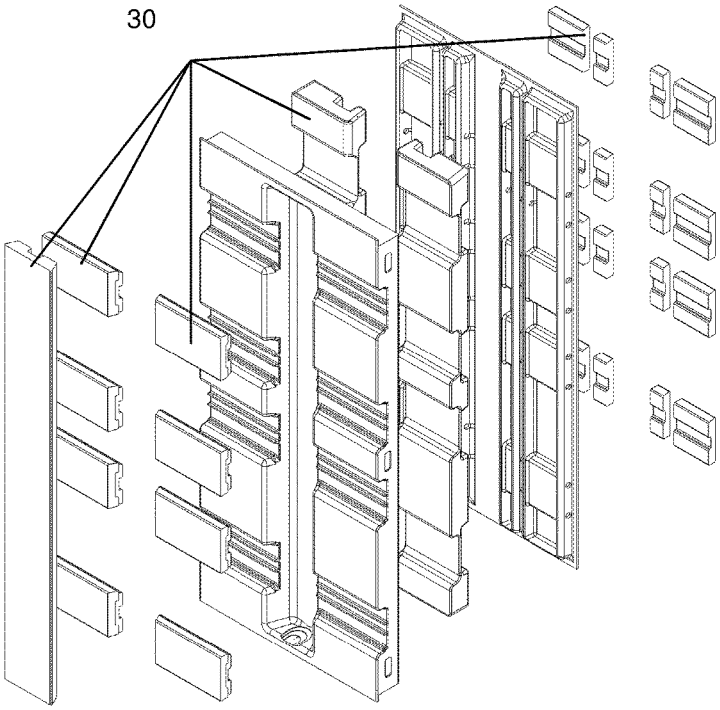
FIG. 30 depicts insulation used in combination with corrugated panels according to the present invention.

FIG. 30 shows typical wall panel assembly and exterior wall showing insulation 30 between the outer flat panel and the backside of the corrugated interior panel and foam insulation inserts in the horizontal channels. The foam insulation covers the space between the bottom of the vertical channel and the second filler 109*b* panel and is held in place by the channel brace or the filler panel in addition to a second insert covering the space of the vertical channel between the front of the filler panel or channel brace and the front face of the corrugated interior panel. The insulation a can be either pre-molded foam insert made of oil based or plant based materials that can be inserted into the open horizontal and vertical channels, or it can be fiberglass-batts, spray-in foam insulation, or blow-in insulation or any other suitable material In the preferred embodiment solid pre-molded insulation 30 inserts are placed in the horizontal and vertical channels. These foam inserts are removable to permit access to the horizontal and vertical installation channels. These pre-molded insulation inserts can have various methods of holding them in place including but not limited to pins, staples and tension wire clips which can be integrated in the pre-molded foam inserts. Tension wire clips could either secure the foam insert from falling out of the channel by pressing against the sloped sides of the channels or by insertion into preformed or machined nobs or apertures in the channel sides. In another version the pre-molded insulation inserts can have nobs protruding from the side which snap into molded indentations or apertures in the sloped side walls of the installation channels. Other suitable attachment methods such as glue, adhesive tape, staples, pins, snap fasteners, tension wires, hook and loop fasteners or other suitable attachment methods could also be used.

Figure 31:
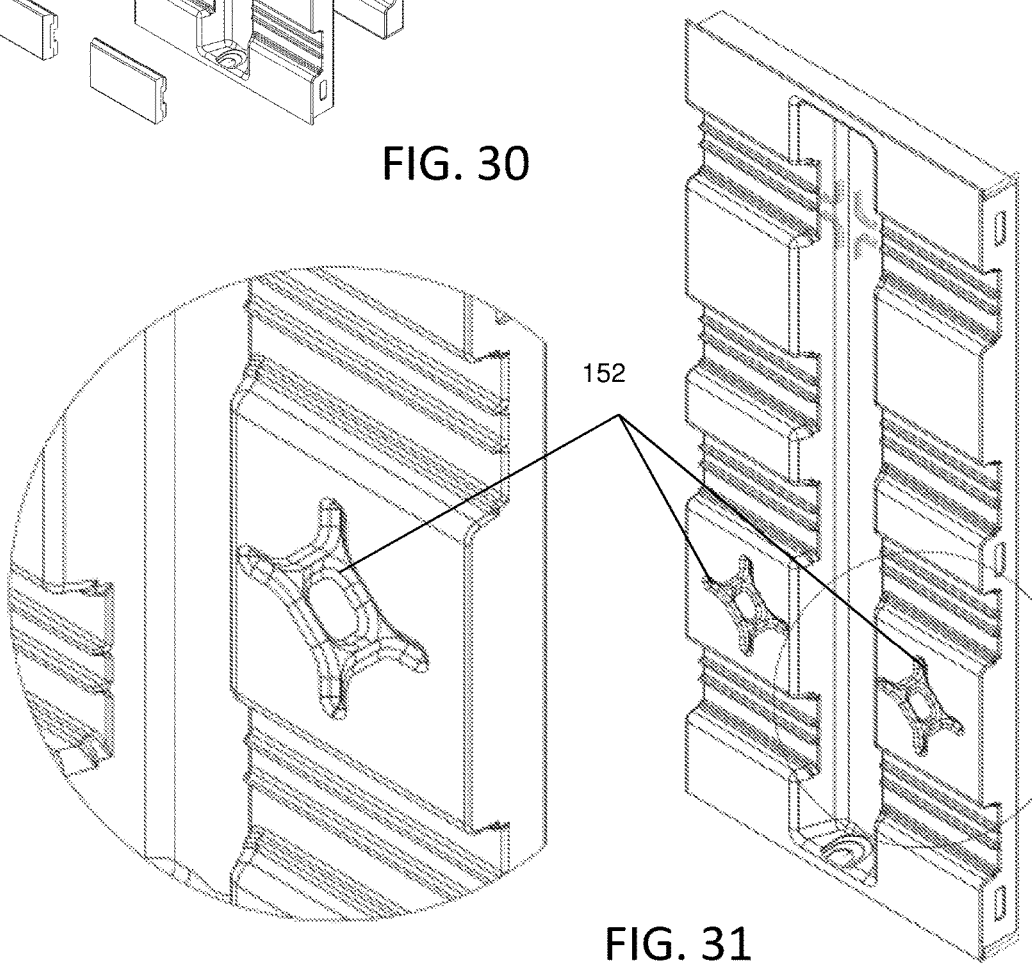
FIG. 31 illustrates a means for providing rigidity to a corrugated panel according to the present invention.
Figure 32:
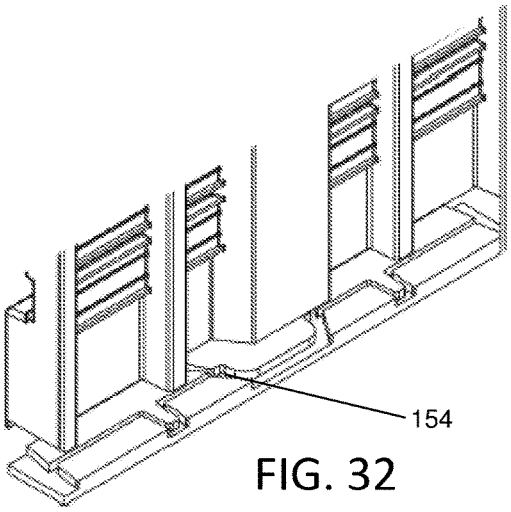
FIGS. 32-40 illustrate alternative mounting means for a corrugated panel according to the present invention

Other features that may be used with the corrugated wall panel described herein include surface depressions 152 that provide stiffness. As shown in FIG. 31 these surface depression can be various shapes and are molded depressions in flat areas on the front side of the panel, to add stiffness to larger surface areas. FIG. 32 depicts a groove cut 154 from the bottom place that mirrors the contours of the corrugated panel. Accordingly, the corrugation slides into these slots in the top plate (not shown) and bottom plate and is glued or mechanically fastened therein.

Figure 33:
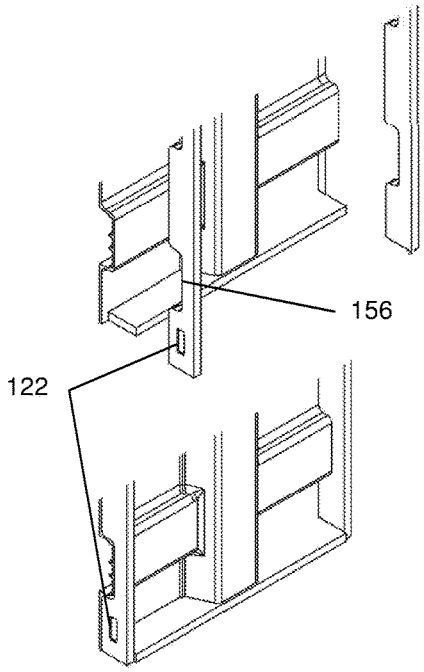

Another feature shown in FIG. 33 is a corrugated interior panel combined with a milled lumber, molded wood, plastic or metal stud formed 156 to fit the spaces of the corrugated interior panel's vertical interior contours. Additionally, these studs feature milled or preformed recesses in the stud sides to accommodate mechanical fasteners to attach the panel to adjacent panel or a standard lumber plate. Thus, where a top or bottom plate is attached to the panel and there are independent studs to which the panel is attached, the solid vertical members can either be solid, which would interrupt the continuity of the horizontal channel, or the studs can have cutouts matching the contour of the horizontal channels. Additionally, the solid studs can have apertures within the perimeter of each horizontal channel to lead wiring or plumbing through the stud.

Figure 34A:
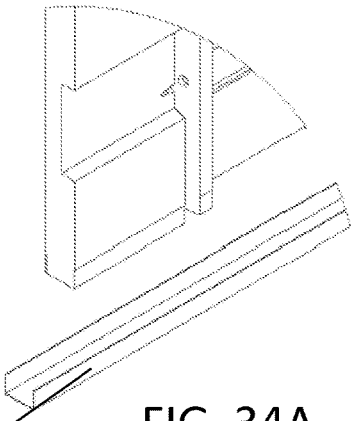
Figure 34B:
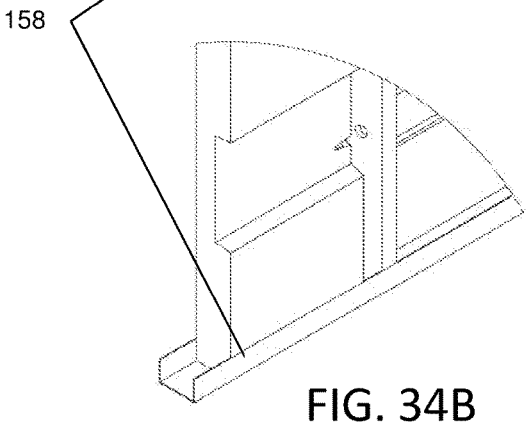

Additionally, the panels can have varying means for connecting the top and bottom panel to their respective top and bottom plates. For example, FIGS. 34A and 34B shows a panel which sits within a U-shaped plate 158. Further, the panel can be held in the U-shaped plate by a friction fit or other adhesive or mechanical fastener.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A wall system for construction of a building, comprising:

a corrugated panel having a top side, a bottom side, a first side end, a second side end, a front face, and a back face, the corrugated panel comprising at least one vertical channel and a plurality of horizontal channels, wherein the corrugated panel has a panel width between the first side end and the second side end, wherein the corrugated panel has a panel height between the top side and the bottom side, wherein the vertical channel is recessed from the front face by a first depth and extends between the bottom side and the top side and has a vertical channel width less than one fourth of the panel height, wherein the horizontal channels are recessed from the front face by a second depth and extend the entire panel width from the first side end to the second side end and intersect with the vertical channel between the first side end and the second side end, wherein a lowermost horizontal channel most proximate to the bottom side of the corrugated panel is spaced a first distance from the bottom side of the corrugated panel, wherein an uppermost horizontal channel is spaced a second distance from the top side of the corrugated panel, wherein the second distance is different from the first distance, wherein a third distance between a first pair of the horizontal channels adjacent to each other is greater than a fourth distance between a second pair of the horizontal channels adjacent to each other, and wherein a panel wall thickness between the front face and the back face is thinner than the first depth.

2. The wall system of claim 1, wherein the plurality of horizontal channels is further comprised of a plurality of middle horizontal channels distributed between the lowermost horizontal channel and the uppermost horizontal channel, wherein the third distance is greater than the vertical channel width, wherein the fourth distance is less than the vertical channel width, wherein each one of the horizontal channels and the vertical channel have a solid bottom between a pair of sloping sidewalls, wherein the vertical channel has a vertical channel width less than one fifth of the panel height or less than one third the panel width, and wherein the vertical channel and the horizontal channels are open to the front face of the corrugated panel and closed to the back face of the corrugated panel.

3. The wall system of claim 1, wherein the corrugated panel further comprises a first side frame member and a second side frame member at the first side end and the second side end, respectively, wherein each one of the first side frame member and the second side frame member extend from the top side to the bottom side of the corrugated panel and have a frame thickness at the back face of the corrugated panel that is at least 10 percent greater than the panel wall thickness at the horizontal channels and the vertical channel, wherein the first side frame member and the second side frame member extend a frame distance away from the first side end and the second side end, respectively to a frame depth, and wherein the frame depth is approximately equal to the first depth.

4. The wall system of claim 3, further comprising a second corrugated panel situated adjacent to the corrugated panel, wherein the second corrugated panel comprises a third side frame member and a fourth side frame member, wherein the third side frame member in the second corrugated panel has a flush joint with the second side frame member in the corrugated panel, wherein the frame thickness at the back face of the corrugated panel for at least one of the side frame members is least 50 percent greater than the panel wall thickness at the horizontal channels and the vertical channel, and wherein the frame thickness further comprises a taper narrowing away from the back face.

5. The wall system of claim 3, further comprising a backside panel with a first face facing toward the corrugated panel's back face and a second face facing away from the corrugated panel's back face, wherein the corrugated panel and the backside panel are connected along at least one of the first side frame member and the second side frame member to form a first structural panel assembly with an interior space.

6. The wall system of claim 5, further comprising a second structural panel assembly adjacent to the first structural panel assembly, wherein the second structural panel assembly is connected to the first structural panel assembly along at least one of the first side frame member and the second side frame member, wherein the second structural panel assembly is comprised of a second corrugated panel and a second backside panel, wherein the second corrugated panel is comprised of a second vertical channel and a second set of horizontal channels, wherein the second set of horizontal channels are recessed into the second structural panel assembly by the same second depth as the plurality of horizontal channels are recessed into the first structural panel assembly, wherein the plurality of horizontal channels in the first structural panel assembly are distributed at varying heights relative to the bottom side, and wherein the second set of horizontal channels in the second structural panel assembly are respectively aligned with the plurality of horizontal channels at each one of the varying heights.

7. The wall system of claim 6, further comprising a j-box, a plurality of conduits, and an interior wall panel, wherein the second corrugated panel has a side end adjacent to at least one of the corrugated panel's first side end and the backside panel, wherein the j-box is situated in at least one of the horizontal channels and the vertical channel, wherein the conduits are situated in the horizontal channels and the vertical channel, wherein at least one of the conduits extends between the first structural panel assembly and the second structural panel assembly and connects with the j-box, and wherein the conduits are selected from the group of conduits consisting of plumbing pipes, electrical power lines, electrical communication wires, HVAC ducts, central vacuum tubes, and any combination thereof, wherein the interior wall panel covers the conduits in the horizontal channels, and wherein the interior wall panel has a cutout over the j-box.

8. The wall system of claim 1, wherein the corrugated panel further comprises a perimeter frame, wherein the perimeter frame is comprised of a first side frame member, a second side frame member, a top frame member, and a bottom frame member, wherein the top frame member and the bottom frame member extend the frame distance away from the top side and the bottom side, respectively to the frame depth, wherein the top frame member and the bottom frame member are further comprised of the frame thickness, wherein at least one of the bottom frame member and the top frame member are comprised of a plurality of semi-circular stepped markings, and wherein the perimeter frame extends perpendicular to the front face of the corrugated panel.

9. The wall system of claim 8, further comprising a top plate connected to the panel at the top side, a bottom plate connected to the panel at the bottom side, and a flange extending from the perimeter frame, wherein the top plate and the bottom plate respectively attach the corrugated panel to a ceiling and a floor of the building, and wherein the top plate and the bottom plate are connected to the panel by the flange.

10. The wall system of claim 1, wherein the vertical channel partially extends between the top side and the bottom side of the corrugated panel, and wherein the vertical channel comprises an end surface spanning the first depth from a bottom of the vertical channel to the front face.

11. The wall system of claim 1, further comprising a plurality of vertical channels and a channel brace spanning at least one of the vertical channels.

12. A wall system for construction of a building, comprising:

a corrugated panel having a top side, a bottom side, a first side end, a second side end, a front face, and a back face, the corrugated panel comprising at least one vertical channel and a plurality of horizontal channels, wherein the corrugated panel has a panel width between the first side end and the second side end, wherein the vertical channel is recessed from the front face by a first depth and extends between the bottom side and the top side, wherein the horizontal channels are recessed from the front face by a second depth and extend the entire panel width from the first side end to the second side end and intersect with the vertical channel between the first side end and the second side end, wherein a lowermost horizontal channel most proximate to the bottom side of the corrugated panel is spaced a first distance from the bottom side of the corrugated panel, wherein an uppermost horizontal channel is spaced a second distance from the top side of the corrugated panel, wherein the second distance is different from the first distance, wherein a third distance between a first pair of the horizontal channels adjacent to each other is greater than a fourth distance between a second pair of the horizontal channels adjacent to each other, and wherein a panel wall thickness between the front face and the back face is thinner than the first depth; and a first side frame member and a second side frame member at the first side end and the second side end, respectively, wherein each one of the first side frame member and the second side frame member extend from the top side to the bottom side of the corrugated panel and have a frame thickness at the back face of the corrugated panel that is at least 10 percent greater than the panel wall thickness at the horizontal channels and the vertical channel, wherein the first side frame member and the second side frame member extend a frame distance away from the first side end and the second side end, respectively to a frame depth, and wherein the frame depth is approximately equal to the first depth.

13. The wall system of claim 12, wherein the corrugated panel further comprises a perimeter frame, wherein the perimeter frame is comprised of the first side frame member, the second side frame member, a top frame member and a bottom frame member, wherein the top frame member and the bottom frame member extend the frame distance away from the top side and the bottom side, respectively to the frame depth, wherein the top frame member and the bottom frame member are further comprised of the frame thickness, wherein at least one of the bottom frame member and the top frame member are comprised of a plurality of semi-circular stepped markings, and wherein the perimeter frame extends perpendicular to the front face of the corrugated panel.

14. The wall system of claim 13, further comprising a top plate connected to the panel at the top side, a bottom plate connected to the panel at the bottom side, and a flange extending from the perimeter frame, wherein the top plate and the bottom plate respectively attach the corrugated panel to a ceiling and a floor of the building, and wherein the top plate and the bottom plate are connected to the panel by the flange.

15. The wall system of claim 12, wherein the vertical channel has a vertical channel width less than one third the panel width or less than one fifth of the panel height.

16. The wall system of claim 12, further comprising a second corrugated panel situated adjacent to the corrugated panel, wherein the second corrugated panel comprises a third side frame member and a fourth side frame member, wherein the third side frame member in the second corrugated panel has a flush joint with the second side frame member in the corrugated panel, wherein the frame thickness at the back face of the corrugated panel for at least one of the side frame members is least 50 percent greater than the panel wall thickness at the horizontal channels and the vertical channel, and wherein the frame thickness further comprises a taper narrowing away from the back face of the corrugated panel.

17. A wall system for construction of a building, comprising:

a corrugated panel having a top side, a bottom side, a first side end, a second side end, a front face, and a back face, the corrugated panel comprising a plurality of vertical channels and a plurality of horizontal channels, wherein the corrugated panel has a panel width between the first side end and the second side end, wherein the vertical channels are recessed from the front face by a first depth and extend between the bottom side and the top side and each one of the vertical channels has a vertical channel width less than one fifth of the panel height, wherein the horizontal channels extend between the vertical channels, wherein a lowermost horizontal channel most proximate to the bottom side of the corrugated panel is spaced a first distance from the bottom side of the corrugated panel, wherein an uppermost horizontal channel is spaced a second distance from the top side of the corrugated panel, wherein the second distance is different from the first distance, wherein a third distance between a first pair of the horizontal channels adjacent to each other is greater than a fourth distance between a second pair of the horizontal channels adjacent to each other, and wherein a panel wall thickness between the front face and the back face is thinner than the first depth.

18. The wall system of claim 17, wherein the horizontal channels are recessed from the front face by a second depth and extend the entire panel width from the first side end to the second side end, and wherein each one of the horizontal channels is continuous across the entire panel width and intersect with each one of the vertical channels between the first side end and the second side end.

19. The wall system of claim 17, wherein the each one of the horizontal channels is formed by a plurality of discontinuous channel segments extending between each one of the vertical channels, and wherein each one of the discontinuous channel segments is comprised of a shallow channel between a pair of ridges.

20. The wall system of claim 19, wherein the vertical channels are further comprised of a wall separating adjacent discontinuous channel segments, and wherein the wall is comprised of a plurality of apertures between the adjacent discontinuous channel segments for a plurality of the horizontal channels.

* * * * *